US011217905B2

(12) United States Patent
Fleancu et al.

(10) Patent No.: US 11,217,905 B2
(45) Date of Patent: Jan. 4, 2022

(54) DUAL-POLARIZED CROSSED DIPOLE AND ANTENNA ARRANGEMENT HAVING TWO SUCH DUAL-POLARIZED CROSSED DIPOLES

(71) Applicant: TELEFONAKTIEBOLAGET LM ERICSSON (PUBL), Stockholm (SE)

(72) Inventors: Dan Fleancu, Griesstätt (DE); Andreas Vollmer, Rosenheim (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 16/620,741

(22) PCT Filed: Jun. 8, 2018

(86) PCT No.: PCT/EP2018/065207
§ 371 (c)(1),
(2) Date: Dec. 9, 2019

(87) PCT Pub. No.: WO2018/224666
PCT Pub. Date: Dec. 13, 2018

(65) Prior Publication Data

US 2020/0106195 A1 Apr. 2, 2020

(30) Foreign Application Priority Data

Jun. 9, 2017 (DE) ..... 10 2017 112 811.5
Jul. 26, 2017 (DE) ..... 10 2017 116 920.2

(51) Int. Cl.
*H01Q 21/26* (2006.01)
*H01Q 1/48* (2006.01)

(52) U.S. Cl.
CPC ..... *H01Q 21/26* (2013.01); *H01Q 1/48* (2013.01)

(58) Field of Classification Search
CPC ..... H01Q 21/26; H01Q 1/246; H01Q 1/50; H01Q 1/523; H01Q 21/08; H01Q 25/001;
(Continued)

(56) References Cited

U.S. PATENT DOCUMENTS 6,072,439 A 6/2000 Ippolito et al.
7,616,168 B2 * 11/2009 Tillery ..... H01Q 1/246 343/797

(Continued)

FOREIGN PATENT DOCUMENTS

CN 2879454 3/2007
CN 201112567 9/2008

(Continued)

OTHER PUBLICATIONS

International Preliminary Report on Patentability and Written Opinion for corresponding PCT/EP2018/065207, dated Dec. 10, 2019; 12 pages.

(Continued)

*Primary Examiner* — Linh V Nguyen
(74) *Attorney, Agent, or Firm* — Sage Patent Group

(57) ABSTRACT

A dual-polarized crossed dipole (1) comprises a first and a second dipole antenna element (2, 3). Each dipole antenna element (2, 3) comprises two dipole halves (2*a*, 2*b*, 3*a*, 3*b*), each having an earth connector (4, 8), a signal connector (6, 10), a dipole earth wing (5, 9) and a dipole signal wing (7, 11). The signal connector (6) of the first dipole antenna element (2) runs parallel to the earth connector (4) of the first dipole antenna element (2), and the signal connector (10) of the second dipole antenna element (3) runs parallel to the earth connector (8) of the second dipole antenna element (3). The dipole signal wing (7) and the dipole earth wing (5) of the first dipole antenna element (2) run in opposite directions. The same applies to the dipole signal wing (11) and the (Continued)

Figure 1B:
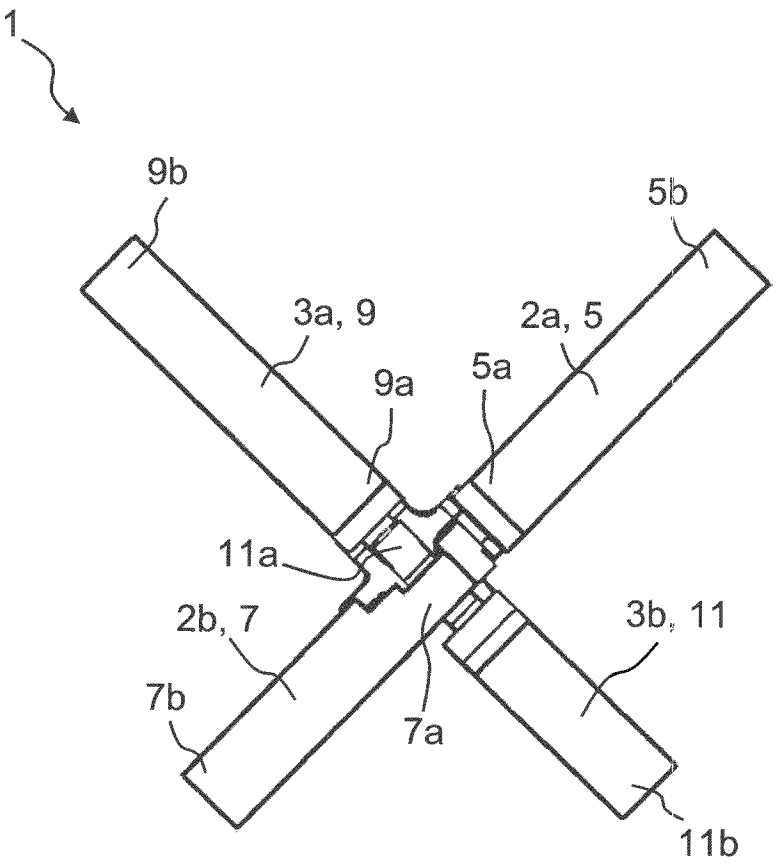

dipole earth wing (9) of the second dipole antenna element (3). Each dipole half (2*a*, 2*b*, 3*a*, 3*b*) is of single-part design in each case. The dipole signal wing (11) of the second dipole antenna element (3) passes through beneath the dipole signal wing (7) of the first dipole antenna element (2), or the dipole earth wing (9) of the second dipole antenna element (3) passes through beneath the dipole earth wing (5) of the first dipole antenna element (2).

18 Claims, 28 Drawing Sheets

(58) Field of Classification Search
CPC ..... H01Q 9/065; H01Q 9/285; H01Q 21/24; H01Q 9/16; H01Q 9/28
USPC ..... 343/798, 797, 795, 820, 821, 6
See application file for complete search history.

(56) References Cited

U.S. PATENT DOCUMENTS

| | | | | |
|---|---|---|---|---|
| 8,354,972 | B2 | 1/2013 | Borja et al. | |
| 2002/0163476 | A1* | 11/2002 | Eriksson | H01Q 9/16 343/815 |
| 2007/0080883 | A1* | 4/2007 | Boss | H01Q 21/0087 343/797 |
| 2008/0074339 | A1* | 3/2008 | Lee | H01Q 21/24 343/803 |
| 2011/0298682 | A1* | 12/2011 | Piet | H01Q 21/06 343/797 |
| 2012/0098725 | A1* | 4/2012 | Lytle | H01Q 1/246 343/797 |
| 2012/0242554 | A1* | 9/2012 | Gunnels | H01Q 9/10 343/816 |
| 2013/0307743 | A1* | 11/2013 | Moon | H01Q 21/08 343/833 |
| 2014/0125539 | A1 | 5/2014 | Katipally et al. | |
| 2014/0240188 | A1* | 8/2014 | Mamo | H01Q 5/385 343/798 |
| 2017/0085009 | A1 | 3/2017 | Watson | |
| 2018/0337462 | A1* | 11/2018 | Vollmer | H01Q 1/246 |
| 2019/0140364 | A1* | 5/2019 | Mirmozafari | H01Q 21/24 |

FOREIGN PATENT DOCUMENTS

| | | |
|---|---|---|
| CN | 103682678 | 3/2014 |
| DE | 196 27 015 | 1/1998 |
| DE | 197 22 742 | 12/1998 |
| DE | 10 2015 007 504 | 12/2016 |
| GN | 1231527 A | 10/1999 |
| KR | 100563118 B1 | 3/2006 |
| WO | 2014/132254 | 9/2014 |

OTHER PUBLICATIONS

"Notification of the First Office Action" dated Oct. 22, 2020 in Chinese counterpart patent application No. 201880046038.9.
International Search Report for PCT/EP2018/065207, dated Aug. 23, 2018, 5 pages.
English translation of Chinese Office Action issued in Chinese Application No. 201880046038.9 dated Oct. 22, 2020 (6 pages).

* cited by examiner

DUAL-POLARIZED CROSSED DIPOLE AND ANTENNA ARRANGEMENT HAVING TWO SUCH DUAL-POLARIZED CROSSED DIPOLES

This application is the U.S. national phase of International Application No. PCT/EP2018/065207 filed 8 Jun. 2018, which designated the U.S. and claims priority from DE Patent Application No. 10 2017 112 811.5 filed 9 Jun. 2017, and DE Patent Application No. 10 2017 116 920.2 filed 26 Jul. 2017, the entire contents of each of which are hereby incorporated by reference.

The invention relates to a dual-polarized crossed dipole and an antenna arrangement having two such dual-polarized crossed dipoles.

Dipole antenna elements are known for example from publications DE 197 22 742 A and DE 196 27 015 A. Dipole antenna elements of this kind may have a conventional dipole structure or, for example, may consist of a crossed dipole or a dipole square, etc.

Dipole antenna elements of this kind are usually fed such that a dipole or antenna element half is connected to an outer conductor by way of a DC connection (i.e. galvanically) or capacitively or inductively (i.e. electromagnetically), whereas the inner conductor of a coaxial connection cable is connected to the second dipole or antenna element half by way of a DC connection (i.e. again galvanically) or capacitively or inductively. The feed is achieved here at each of the end regions of the dipole or antenna element halves pointing towards one another.

This is clear for example from DE 10 2015 007 504 A, which shows an antenna element arrangement in dipole form. This comprises four mutually distanced dipole wings which do not overlap and are arranged distanced from a reflector by a carrier. The feed takes place via appropriate feed lines or printed circuit boards, which are coupled galvanically or capacitively to the corresponding wings. These feed lines of the different dipole antenna elements cross one another.

A conventional structure of this kind can also be found in WO 2014/132254 A1. The individual dipole wings are arranged distanced from one another without overlaps. They are also arranged distanced from the reflector via appropriate carriers. Feed lines such as cables or microstrips are guided up along the carrier from the reflector in the direction of the corresponding dipole wing and cross one another in the upper end region, before they are galvanically soldered to the corresponding dipole wing.

A disadvantage here, on the one hand, is that a very large number of component parts are required. These are the individual carriers with the dipole wings, and the feed lines, A disadvantage of the crossed dipoles from the prior art is additionally that the manufacturing outlay and the resultant costs are high. In addition, there is also an increased weight, which means that these component parts cannot be placed automatically on a main body in an SMD placement process.

The object of the present invention here is therefore to create a dual-polarized crossed dipole which can be structured more easily and conveniently than the crossed dipoles known previously in the prior art, wherein at least similar electrical properties should be achieved.

The object is achieved by the dual-polarized crossed dipole described in example non-limiting embodiments herein and by an antenna arrangement having at least two such dual-polarized crossed dipoles as described herein in conjunction with non-limiting embodiments. Advantageous developments of the dual-polarized crossed dipole can be found herein, and other descriptions herein contain a development of the antenna arrangement.

The dual-polarized crossed dipole according to the invention comprises a first dipole antenna element and a second dipole antenna element. These are rotated through 90° relative to one another such that the crossed dipole transmits and/or receives in two polarization planes arranged perpendicularly to one another. The first and the second dipole antenna elements each comprise two dipole halves. The first dipole half of the first dipole antenna element comprises an earth connector and a dipole earth wing. A first end of the dipole earth wing is connected to a first end of the earth connector, wherein a second end of the earth connector is arrangeable on at least one main body and is connectable to a reference earth. The second dipole half of the first dipole antenna element comprises a signal connector and a dipole signal wing. The dipole signal wing is connected via its first end to a first end of the signal connector. The same applies also to the first dipole half and the second dipole half of the second dipole antenna element.

The signal connector of the first dipole antenna element runs parallel, or with a component predominantly parallel to the earth connector of the first dipole antenna element. The same applies also to the signal connector of the second dipole antenna element. The dipole signal wing and the dipole earth wing of the first dipole antenna element run in opposite directions, in particular run offset in relation to one another by 180° in plan view. The same applies also to the dipole signal wing and the dipole earth wing of the second dipole antenna element. The first dipole half of the first and second dipole antenna element is preferably of single-part design. The same applies also to the second dipole half of the first and second dipole antenna element.

The dipole signal wing of the second dipole antenna element passes through beneath the dipole signal wing of the first dipole antenna element. Conversely, the dipole earth wing of the second dipole antenna element could of course also pass through beneath the dipole earth wing of the first dipole antenna element. It could also be that the dipole earth wing 5 of the first dipole antenna element passes through beneath the dipole signal wing of the second dipole antenna element, or that the dipole signal wing of the second dipole antenna element passes through beneath the dipole earth wing of the first dipole antenna element.

In other words, in particular, precisely one wing of a dipole antenna element passes through precisely once beneath precisely one wing of another dipole antenna element.

In the case of the dual-polarized crossed dipole it is particularly advantageous that the dipole halves are each of single-part design. The corresponding dipole earth wing with its earth connector is thus of single-part design, and the dipole signal wing with its signal connector. The structure is thus heavily simplified, because there is no longer any need to guide up and cross the signal line or earth line of a waveguide, which must be connected galvanically or capacitively to the dipole wings. The earth connector is connected merely preferably at its second end to a reference earth, whereas the signal connector is preferably connected at its second end (which is opposite the first end) to a first or second high-frequency line and is thus fed.

In particular, the dual-polarized crossed dipole is formed from sheet metal parts which preferably have a thickness of less than 1 mm, less than 0.9 mm, 0.8 mm, 0.7 mm, 0.6 mm, or 0.5 mm, but preferably of more than 0.3 mm, 0.5 mm, or 0.7 mm. The first and/or second dipole half of both dipole antenna elements is preferably formed from a stamped sheet metal part and/or cut sheet metal part (for example laser cut parts). In particular, this is therefore produced in a sheet-metal stamping and/or sheet-metal cutting method, which includes a laser cutting method. The first and/or second dipole half of both dipole antenna elements is likewise formed preferably or additionally from a bent sheet metal part and/or angled sheet metal part, that is to say is produced in a corresponding method of this kind. It would also be possible for each dipole half of both dipole antenna elements to be produced in a single part from a flexible printed circuit board.

Further preferably, the dual-polarized crossed dipole may also be produced from printed circuit boards or by means of a 3D printing method.

The dipole signal wings and/or the dipole earth wings of both dipole antenna elements lie in a common plane or in different planes based on their predominant length, wherein the common plane or the different planes are arranged parallel to one another and in particular parallel to at least one main body (for example reflector), on which the dual-polarized crossed dipole is arranged. Here, the largest surface of the dipole signal wing or dipole earth wing runs parallel, or with a component predominantly parallel to the at least one main body.

In a preferred embodiment the dipole signal wings and the dipole earth wings of the first and/or second dipole antenna element are divided over the majority of their length or over their entire length by a separating slot into two wing segments running distanced from one another, wherein the wing segments running distanced from one another are of different lengths. The two dipole antenna elements may thus send and receive in different frequency bands. A galvanic connection of the two wing segments takes place only at the first end, via which the wing segments are connected to the corresponding earth connectors or signal connectors.

In another embodiment of the crossed dipole according to the invention the dipole signal wings and/or the dipole earth wings of the first and/or second dipole antenna element are divided in each case into at least two segments, which run parallel, or with a component predominantly parallel to one another, wherein these segments are arranged in different planes and are connected to one another in each case via at least one intermediate segment. A stepped profile results, whereby the dipole signal wings or the dipole earth wings may be passed through one beneath the other more easily.

The segments which are each arranged closer to the first end of the signal connector or earth connector may also be arranged closer in the direction of the at least one main body compared with the first ends of the signal connector or earth connector, whereby the corresponding dipole signal wing or dipole earth wing has a U-shaped profile at least in the region of this segment.

In a further exemplary embodiment of the crossed dipole the earth connectors of the first and second dipole antenna element are electrically conductively connected to one another at their second end and on the whole are of single-part design. This means that the first dipole half of the first dipole antenna element and the first dipole half of the second dipole antenna element are formed from a common element, in particular a common sheet metal part. The corresponding earth connectors are preferably connected to one another exclusively at their second end. They are galvanically isolated from one another via a slot starting from their second end in the direction of their first end. In particular at their first end, the earth connectors of both dipole antenna elements are preferably arranged distanced from one another.

In another development of the crossed dipole the earth connector of the first and/or second dipole antenna element at its second end has an opening, through which the corresponding signal connector, which runs parallel to the earth connector, is passed via its second end, wherein both the second end of the signal connector of the first or second dipole antenna element and the second end of the earth connector of the first or second dipole antenna element end or are arrangeable on the same side of the at least one main body. This allows the dual-polarized crossed dipole to be SMD-solderable, that is to say formed as an SMD component part. The dual-polarized crossed dipole has a weight of more than 0.3 g, 0.5 g, 1 g, 2 g, or 3 g, but preferably of less than 2.9 g, 1.9 g, 0.9 g, or less than 0.4 g, when designed for a frequency range of from 3 GHz to 4 GHz and manufactured from aluminium.

In this regard it is of course also possible that the dual-polarized crossed dipole is fittable on the at least one main body. In this case the second end of the signal connector of the first and second dipole antenna element would protrude, i.e. project, beyond the second end of the earth connector of the first or second dipole antenna element, wherein the at least one main body would be penetrable by the second end of the corresponding signal connector.

In a development of the crossed dipole it comprises a first and a second holding device. The first and second holding device consist of or comprise a dielectric material and are arranged between the corresponding earth connector and the signal connector of the first and second dipole antenna element respectively. The first and second holding device comprise a plurality of holding means, which are both engaged with the earth connector and/or are engaged with the signal connector of the corresponding dipole antenna element and thus prevent a displacement of the earth connector and of the signal connector relative to one another.

The first and the second holding device may preferably be formed from a common element, that is to say in a single part, and preferably may be produced in a plastics injection-moulding process.

The antenna arrangement according to the invention comprises at least one first and preferably also one second dual-polarized crossed dipole. The antenna arrangement additionally comprises at least one main body, on which the first and the second dual-polarized crossed dipole are arranged. For example, the at least one main body may be a printed circuit board and/or a reflector. The signal connectors of the two crossed dipoles are connected to one another preferably as described hereinafter. A second end of the signal connection of the first dipole antenna element of the first dual-polarized crossed dipole is galvanically connected via a first connection (high-frequency line) to a second end of the signal connector of the first dipole antenna element of the second dual-polarized crossed dipole. Conversely, a second end of the signal connector of the second dipole antenna element of the first dual-polarized crossed dipole is galvanically connected via a second connection (high-frequency line) to the second end of the signal connector of the second dipole antenna element of the second dual-polarized crossed dipole. A first and a second high-frequency signal may thus be supplied very easily to the corresponding signal connectors via the second end thereof. The first or high-frequency signal is preferably coupled into and out of the first connection and the second connection in the middle thereof. Such an antenna arrangement may also comprise further dual-polarized crossed dipoles of this kind. The antenna arrangement may also be referred to as a mobile communications antenna. The antenna arrangement is preferably also surrounded by a housing, which is permeable or has only a low damping for the first and second high-frequency signal.

The dual-polarized cross-dipole operates with a very wide bandwidth and may be used at frequencies of from 100 MHz to 6 GHz, or to 10 GHz. Particularly good results are achieved at frequencies of approximately 2.6 GHz and 3.5 GHz.

Figure 1A:
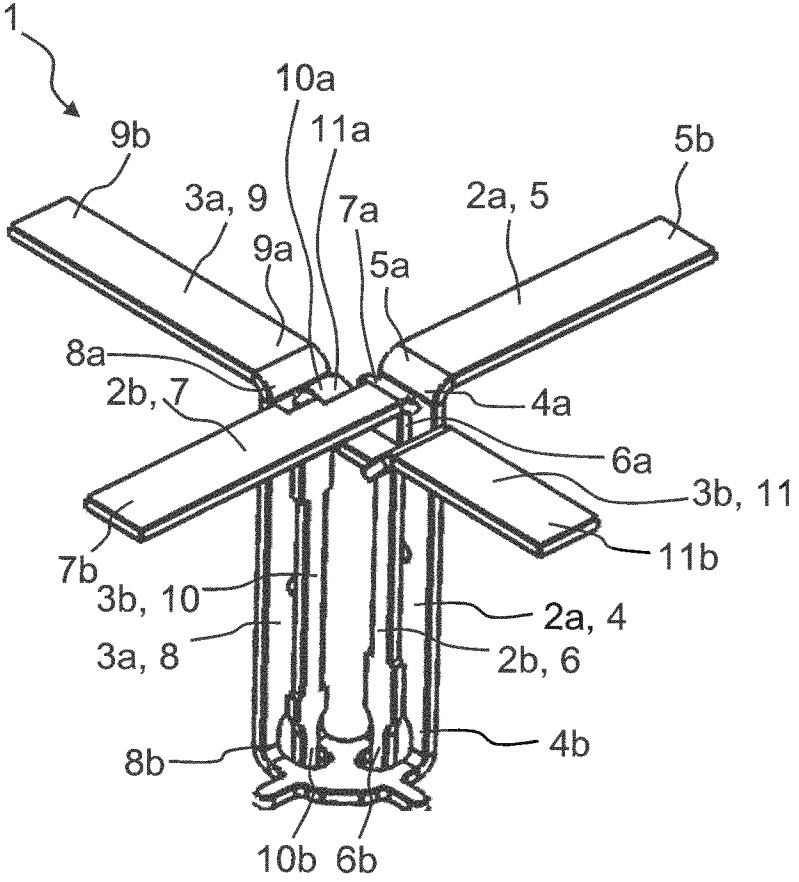
Figure 4A:
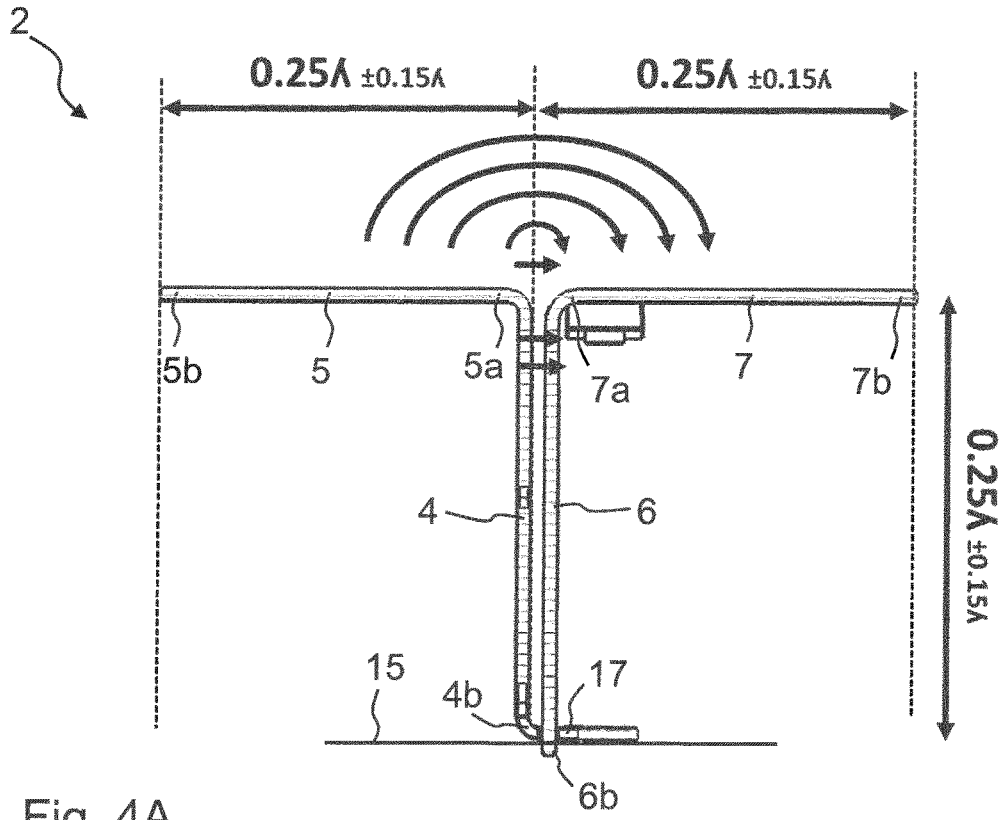
Figure 4B:
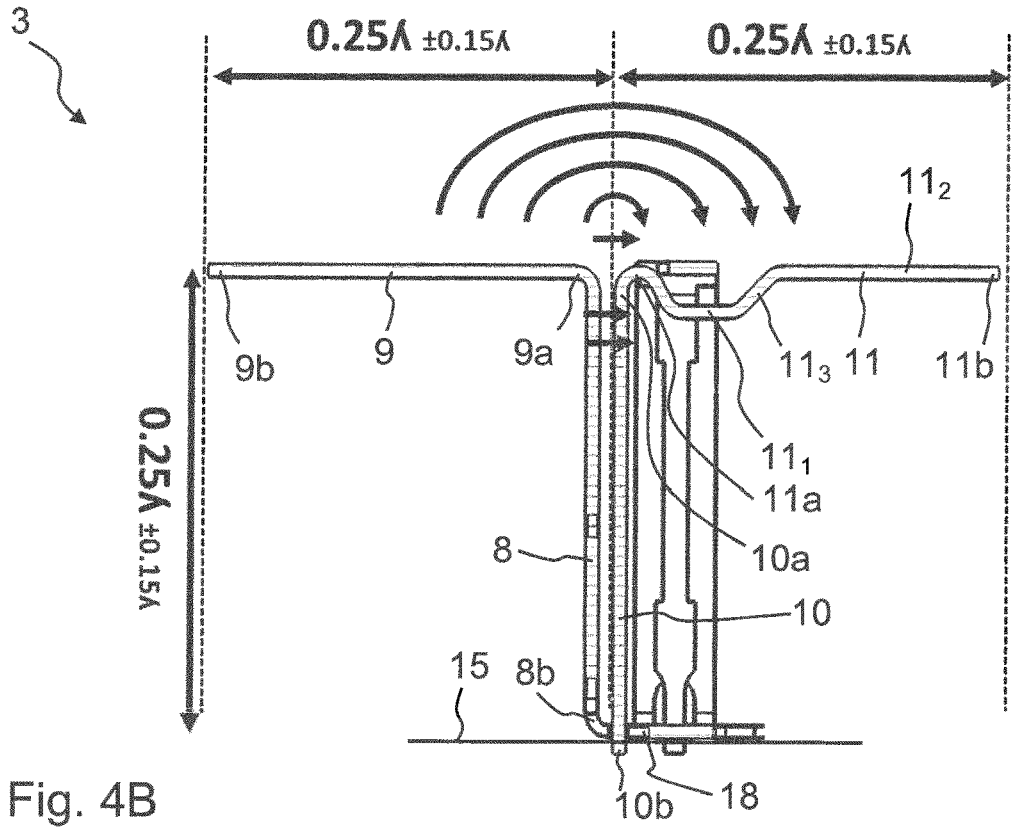
Figure 5:
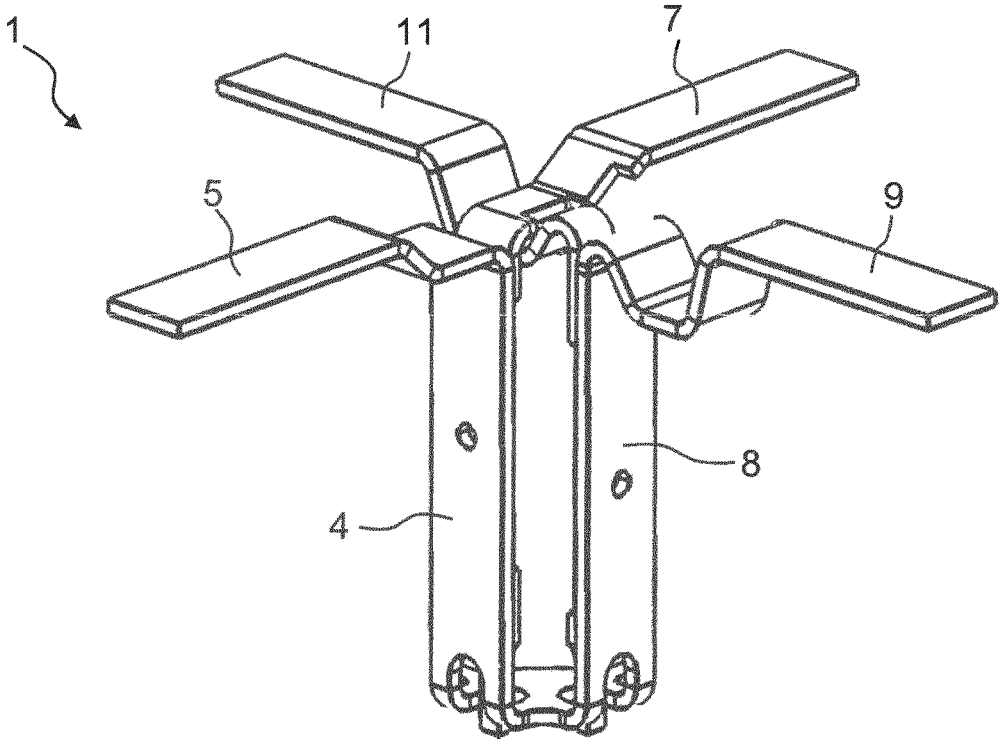
Figure 6A:
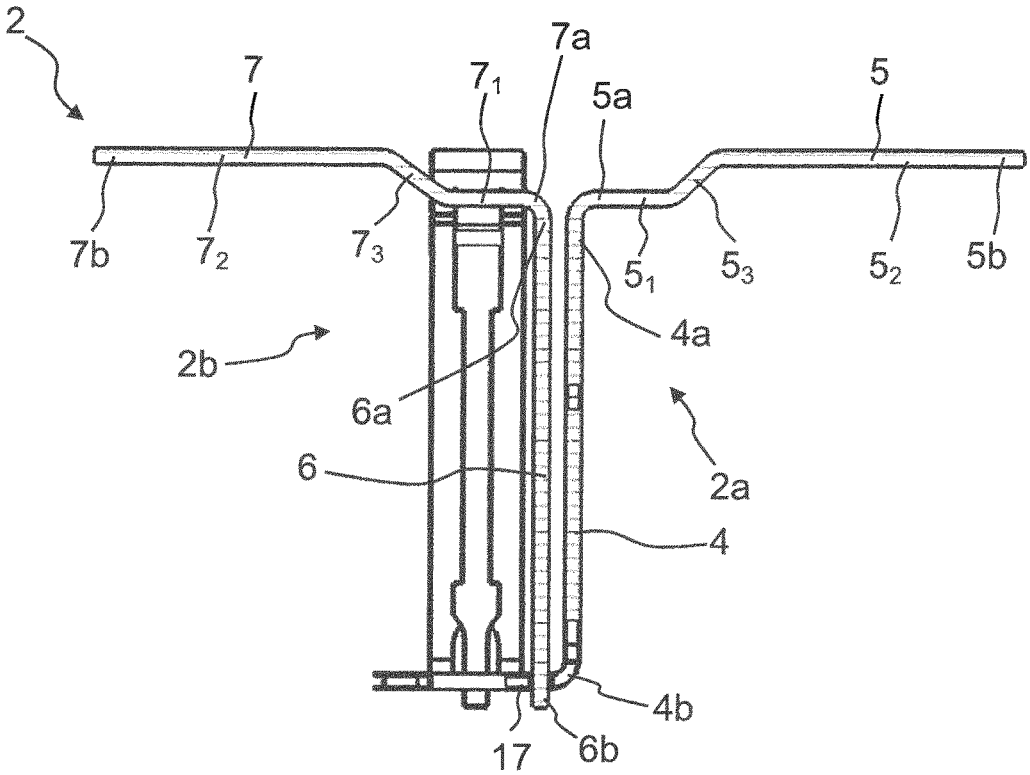
Figure 6B:
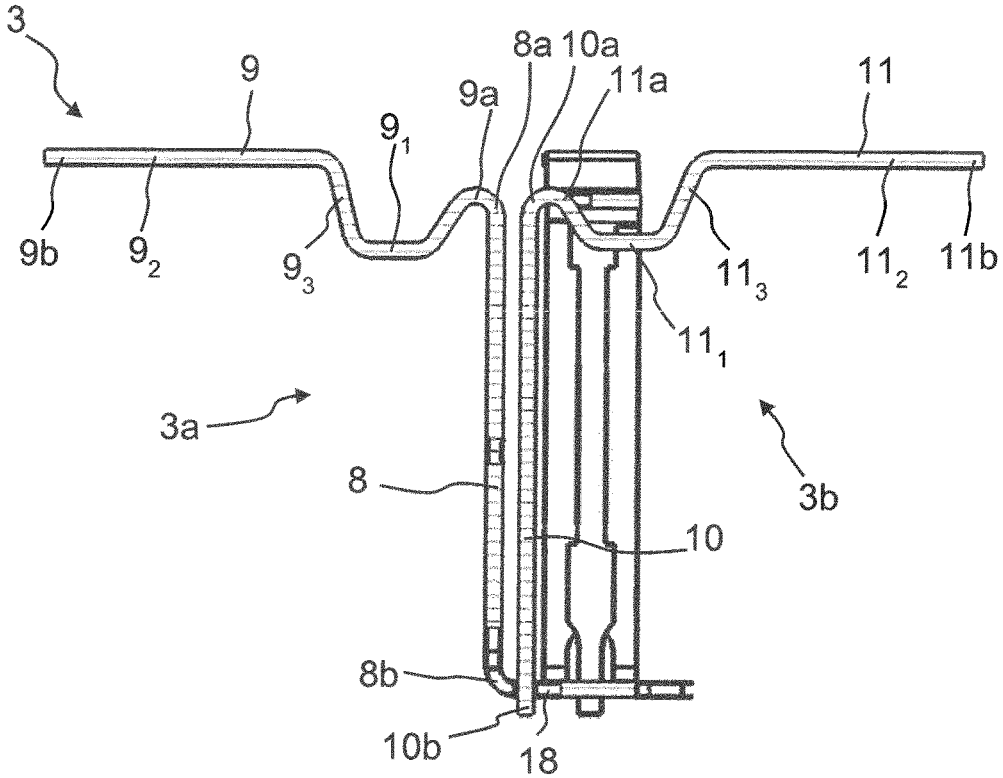
Figure 7:
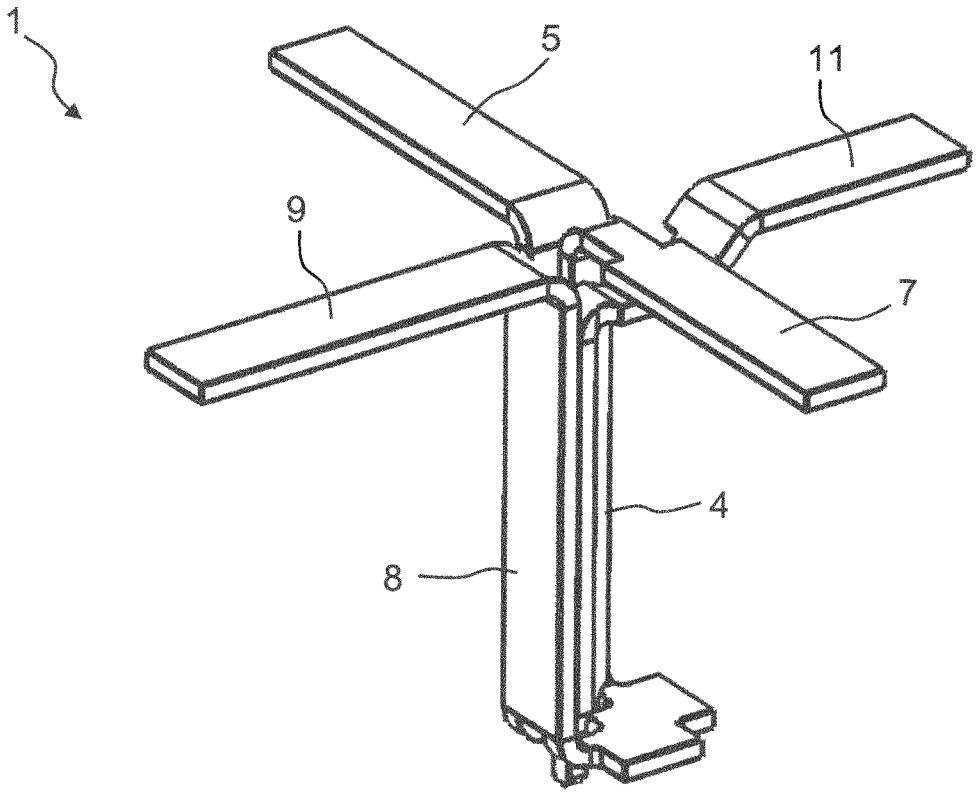
Figure 8A:
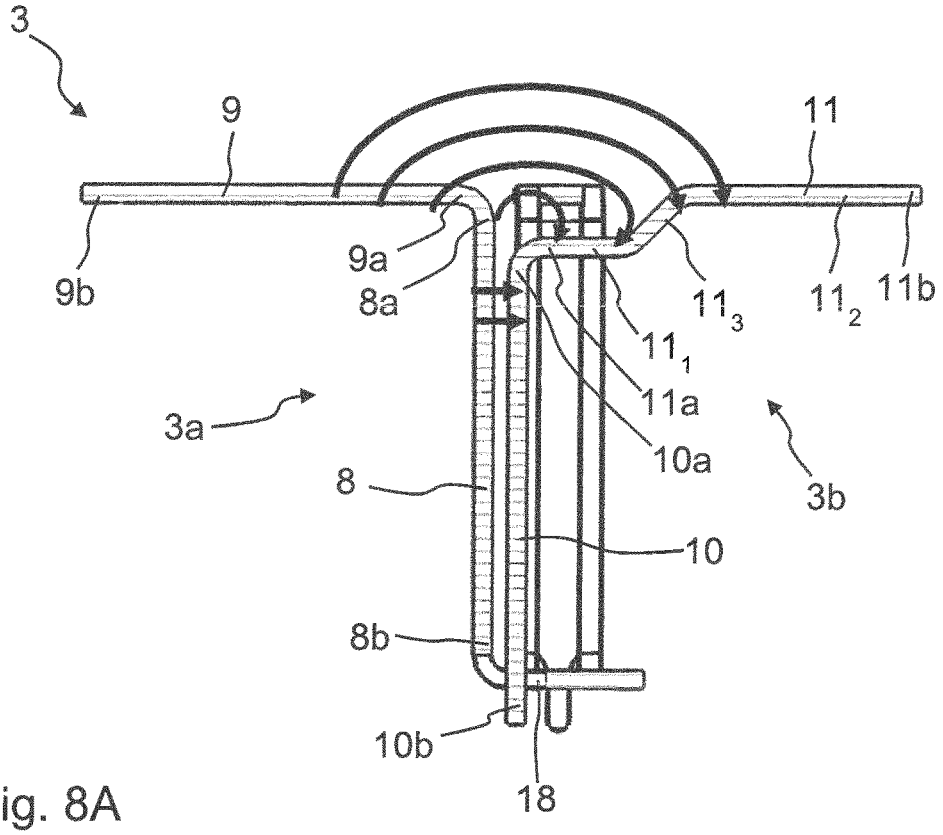
Figure 8B:
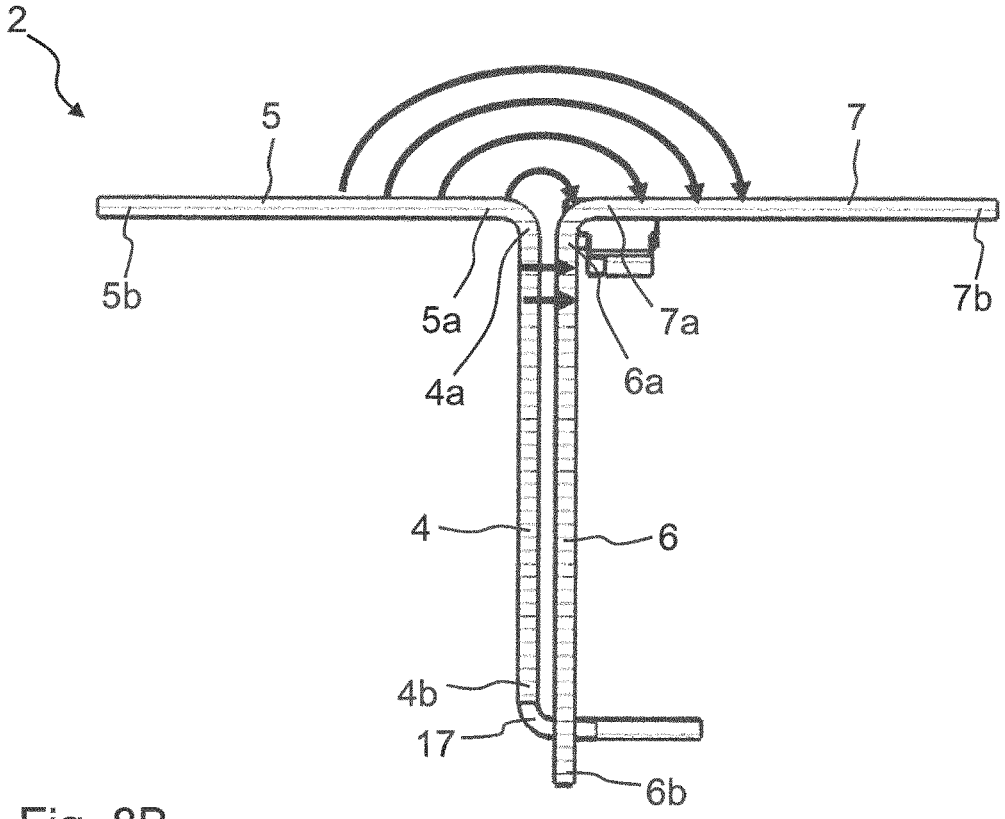
Figure 9:
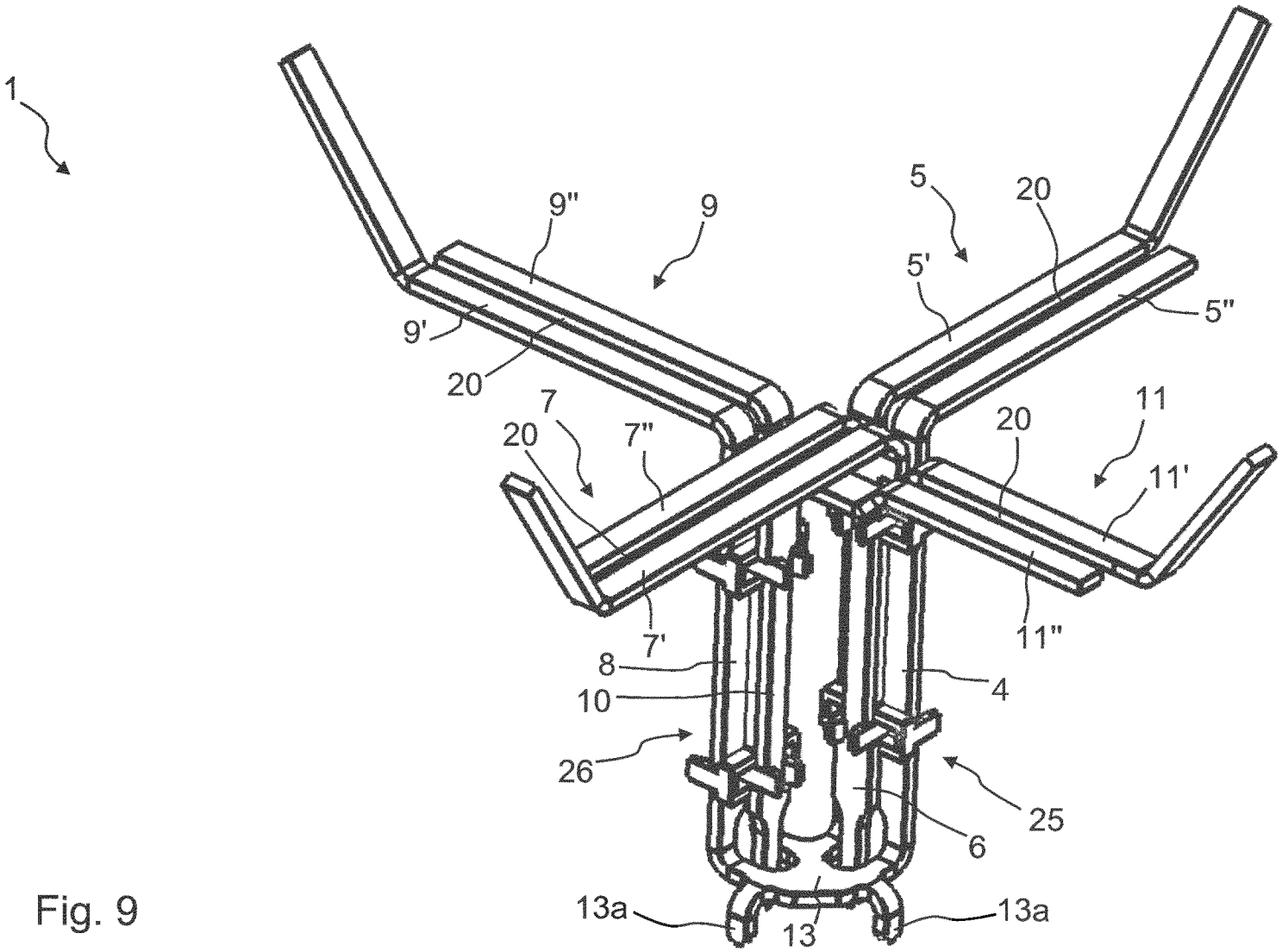
Figure 10:
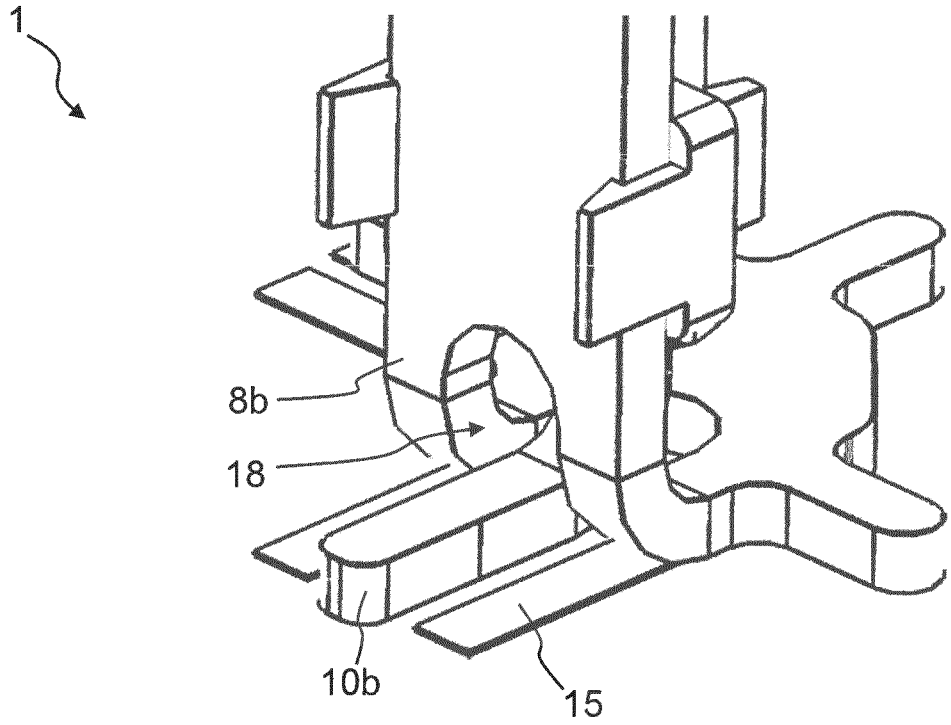
Figure 11A:
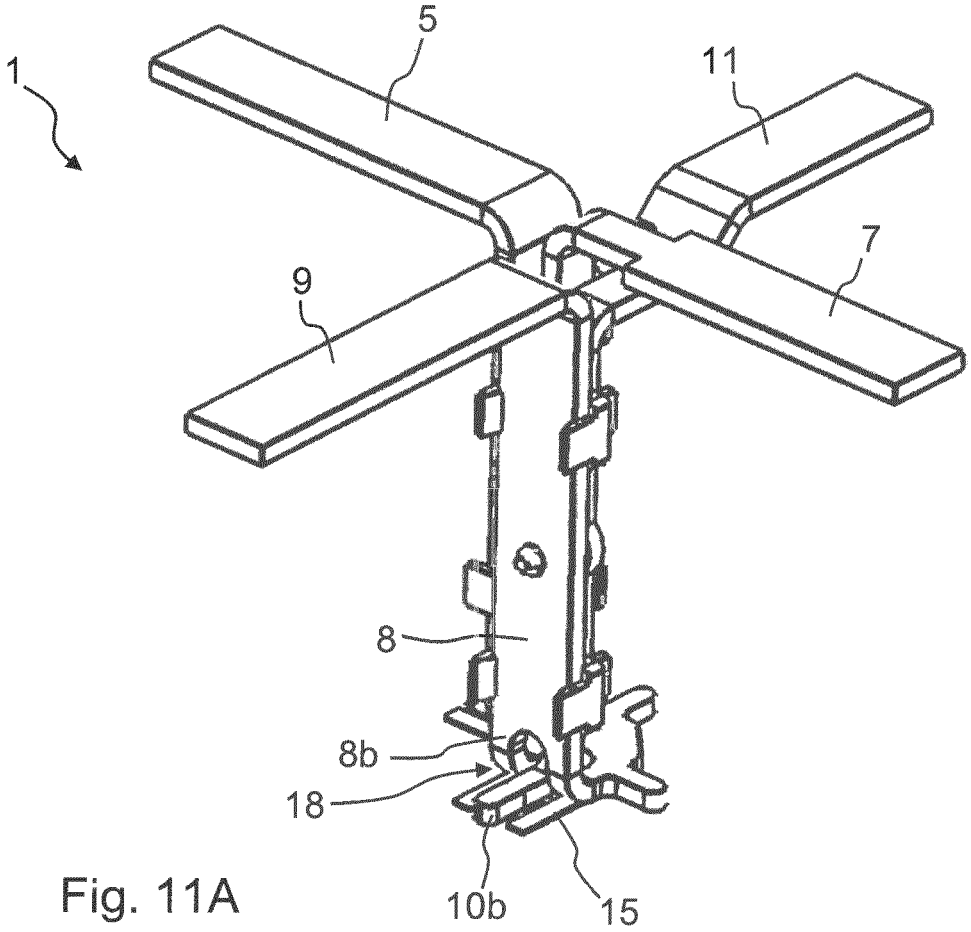
Figure 11B:
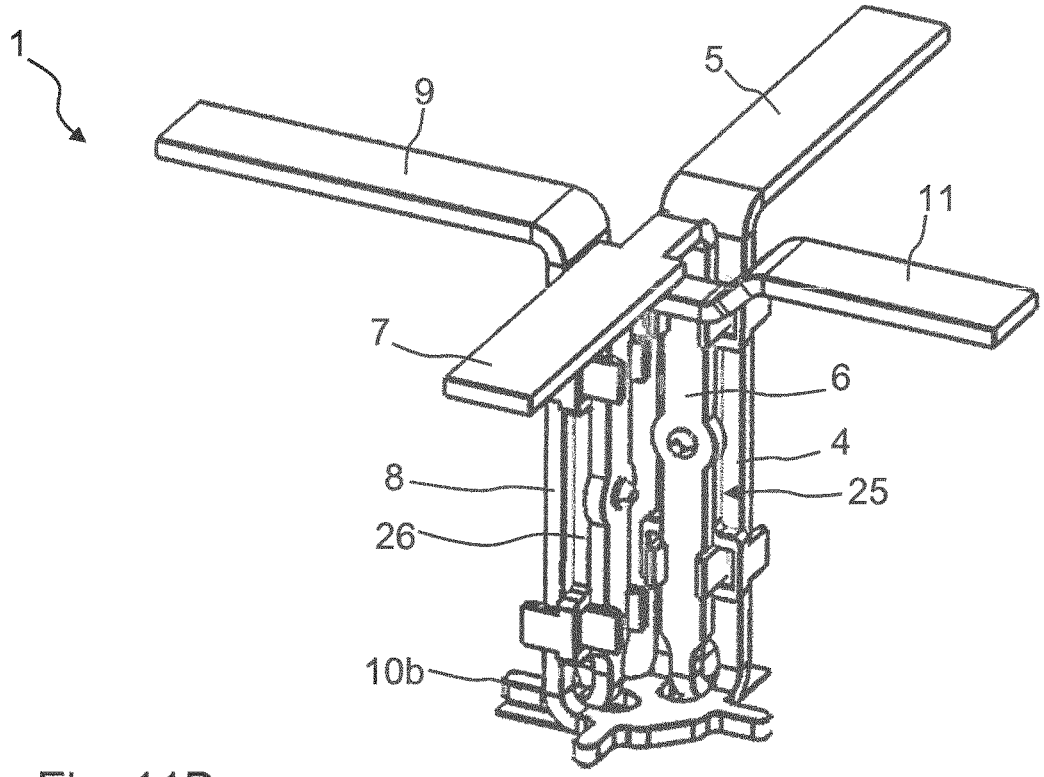
Figure 12:
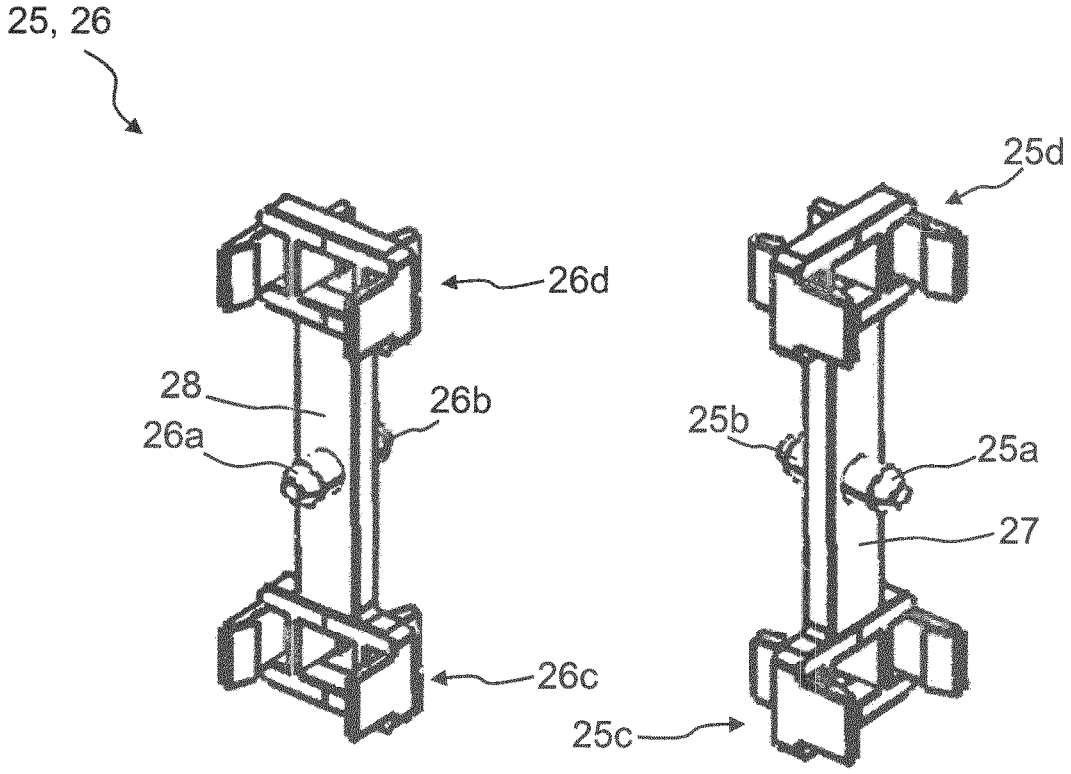
Figure 13A:
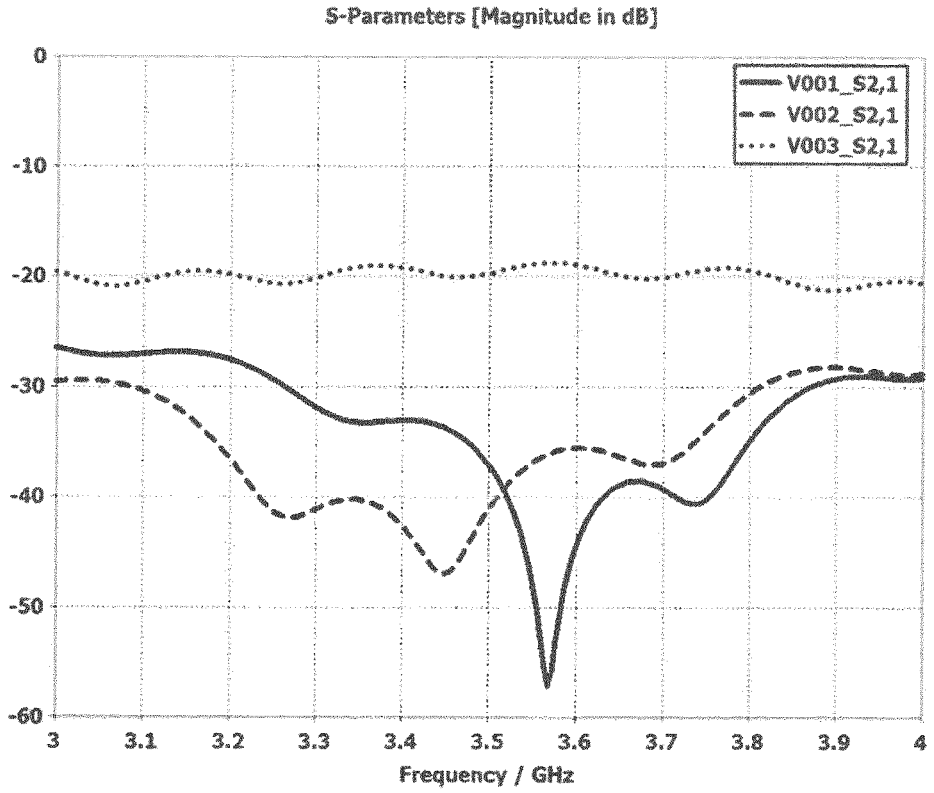
Figure 13B:
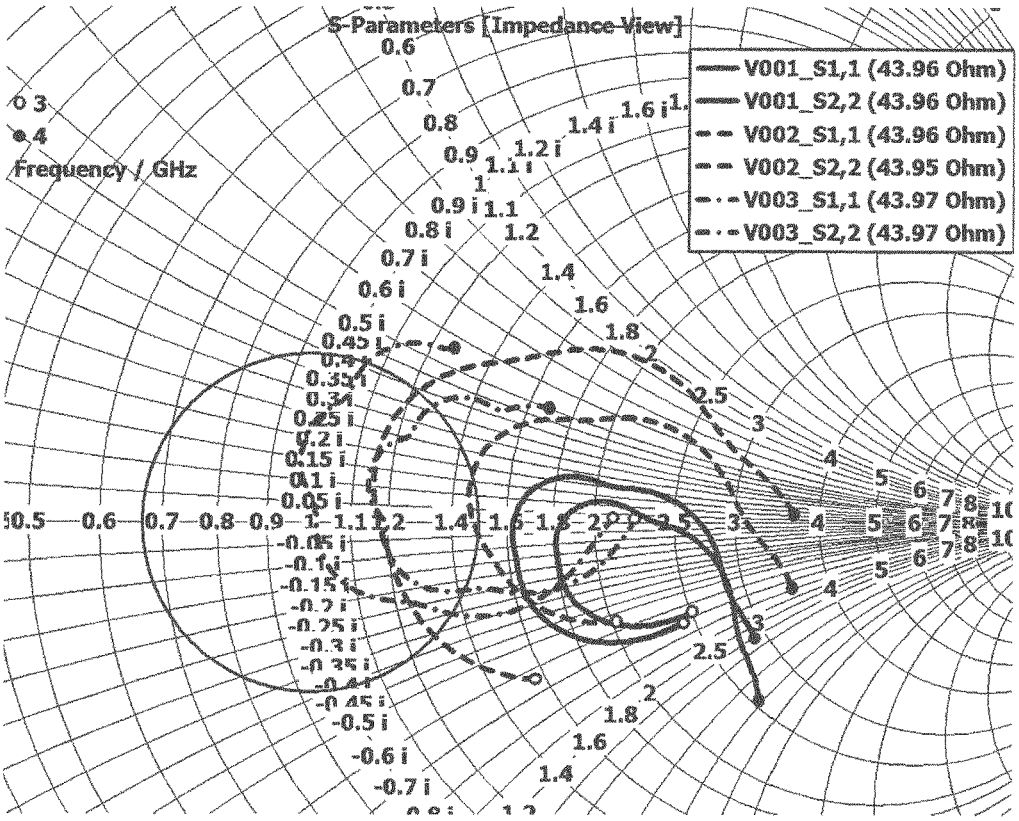
Figure 14:
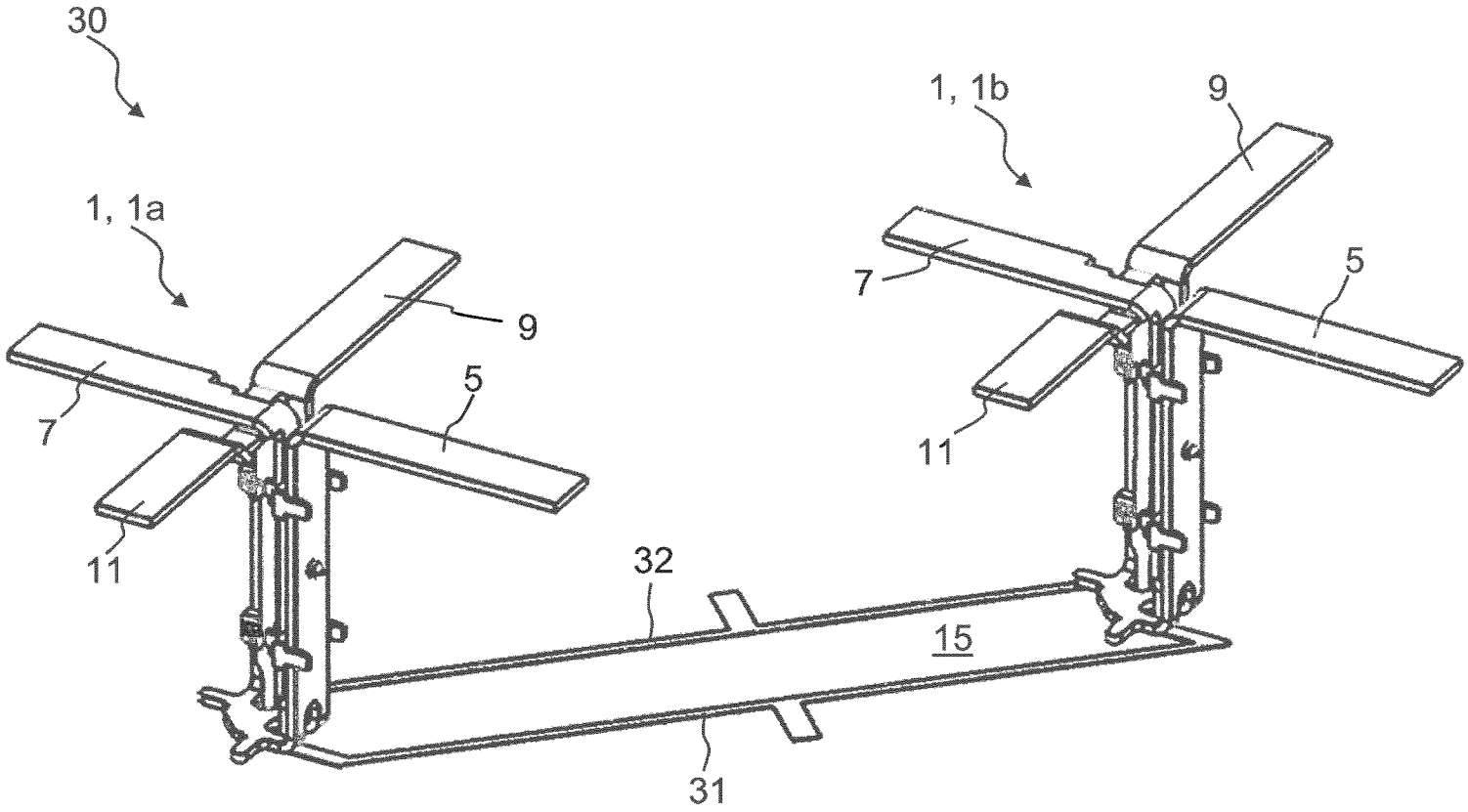
Figure 16A:
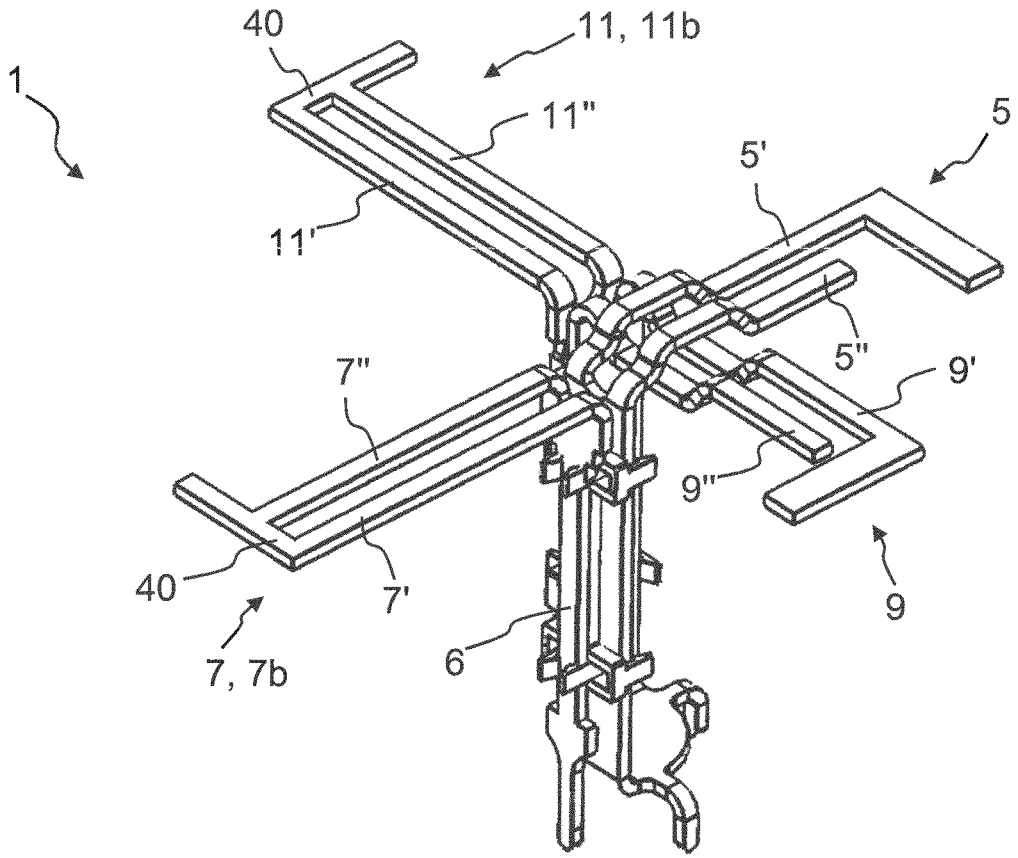
Figure 16B:
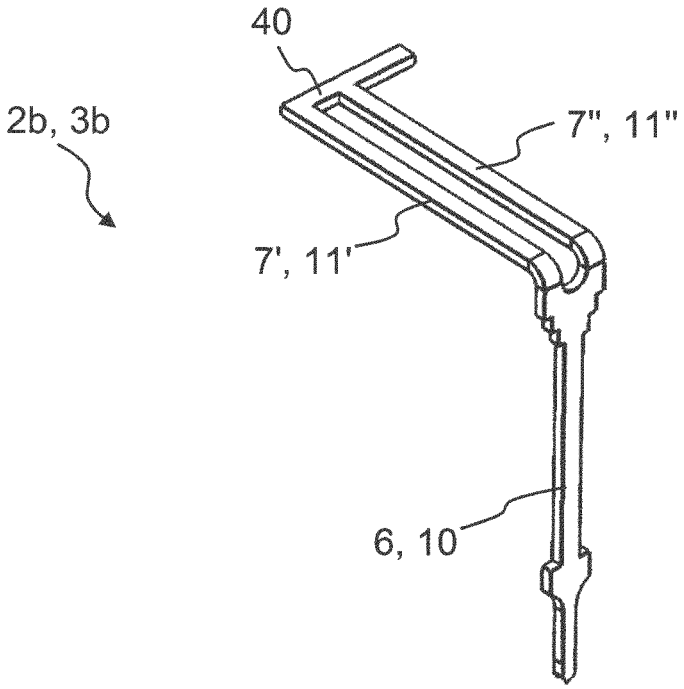
Figure 16C:
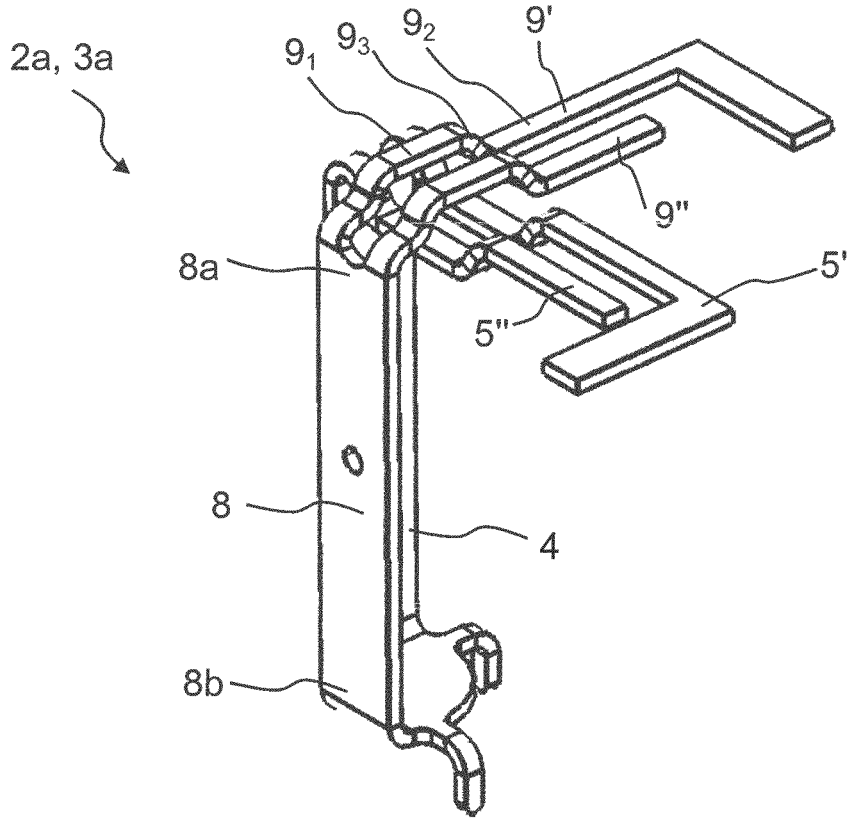
Figure 17A:
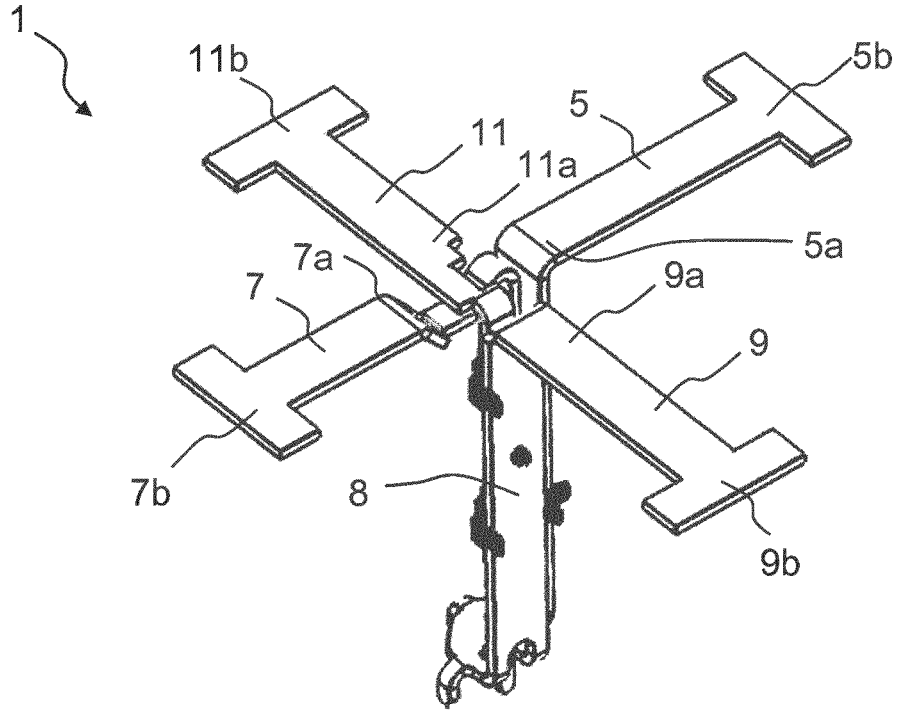
Figure 17B:
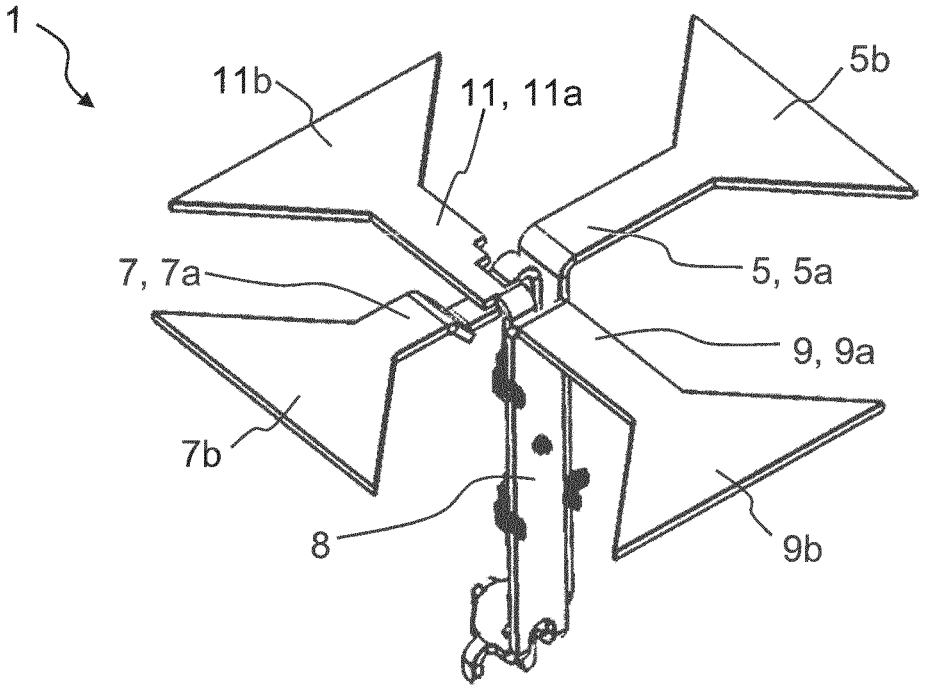
Figure 19A:
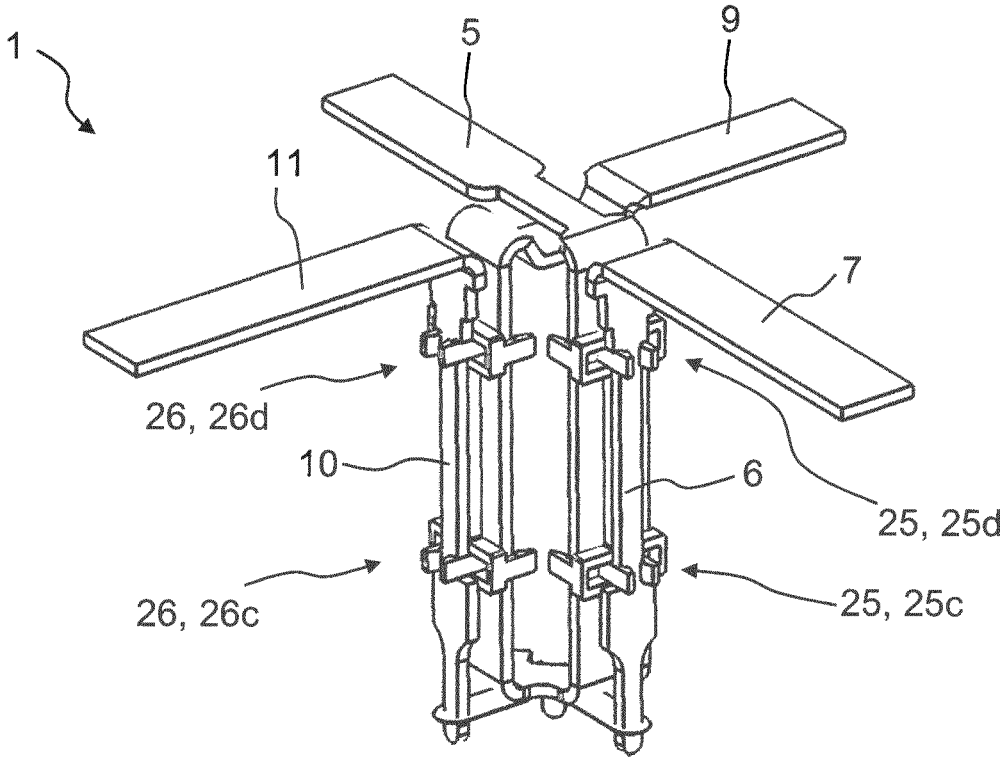
Figure 19B:
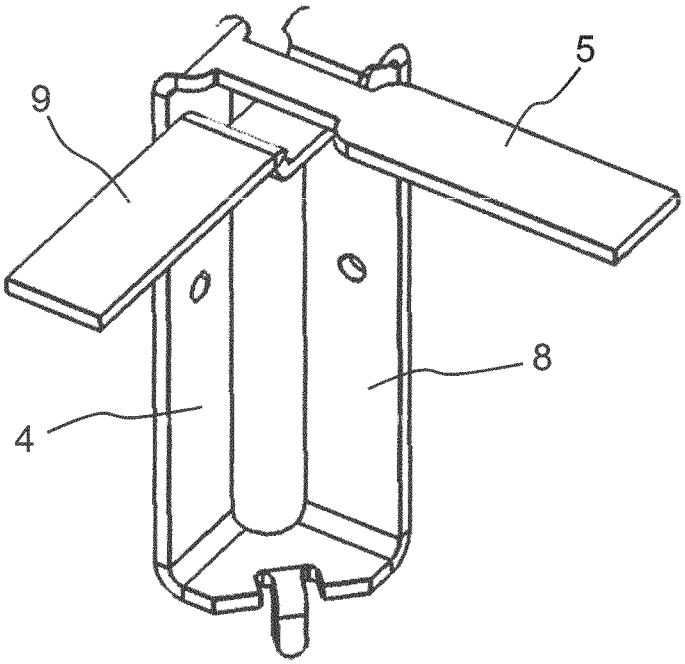
Figure 19C:
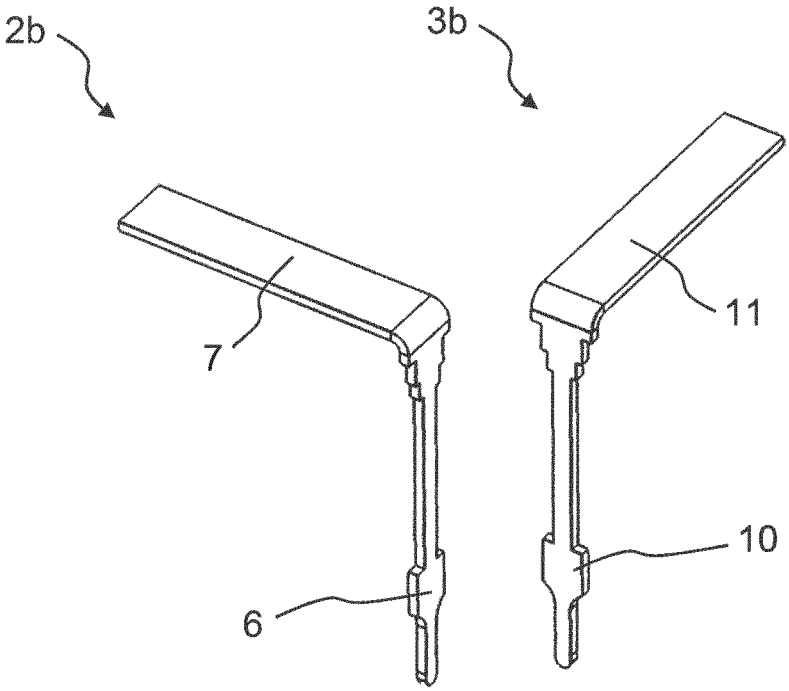
Figure 20A:
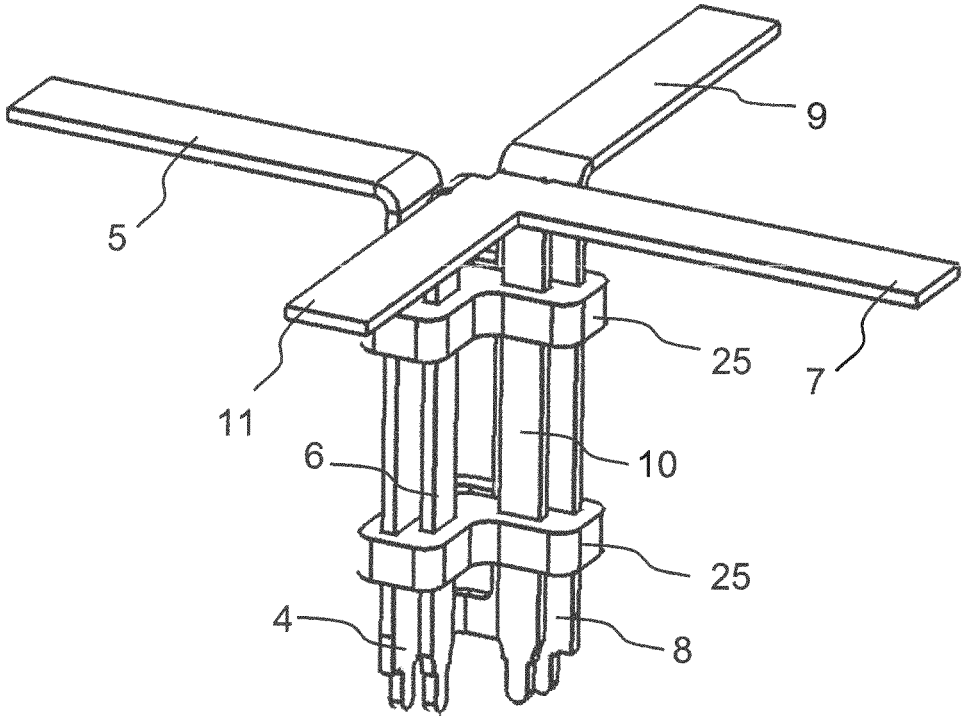
Figure 20B:
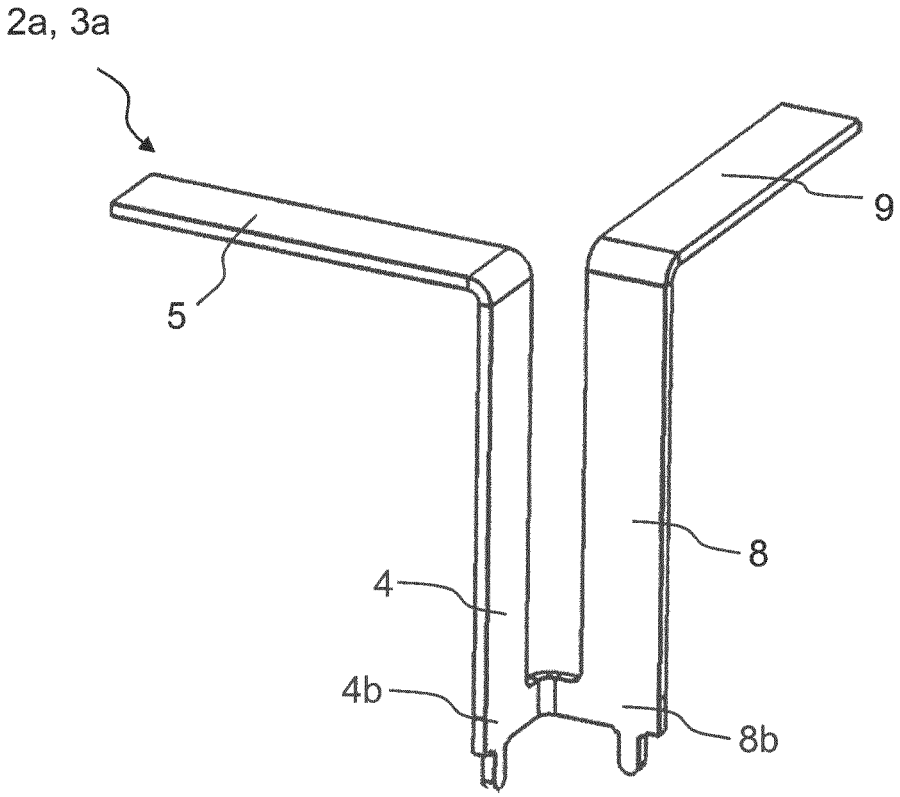
Figure 20C:
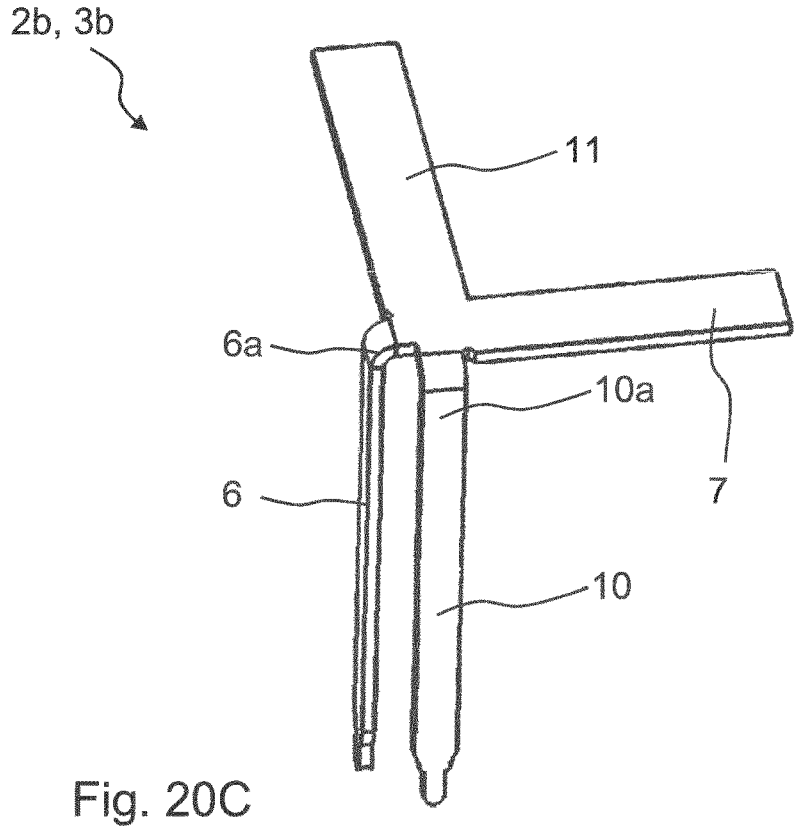
Figure 21A:
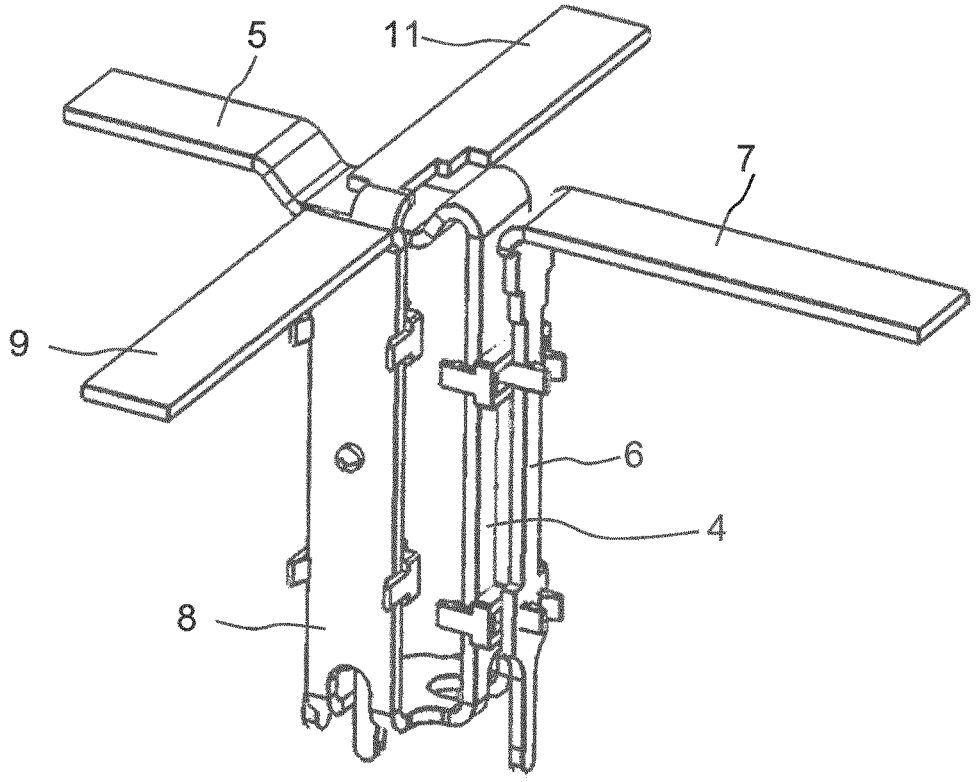
Figure 21B:
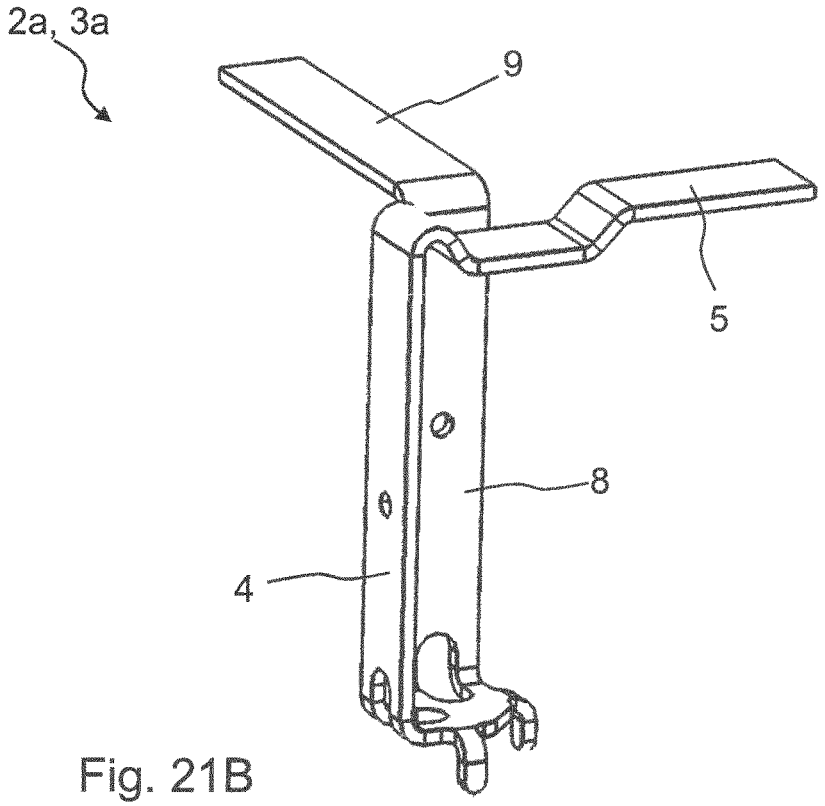
Figure 21C:
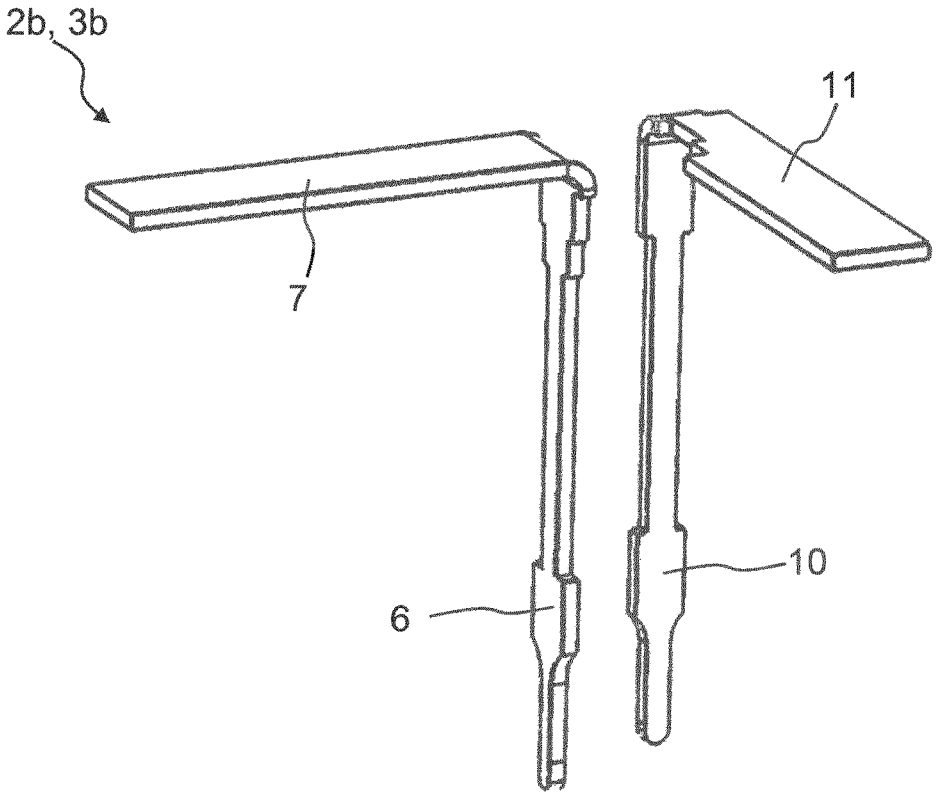
Figure 22A:
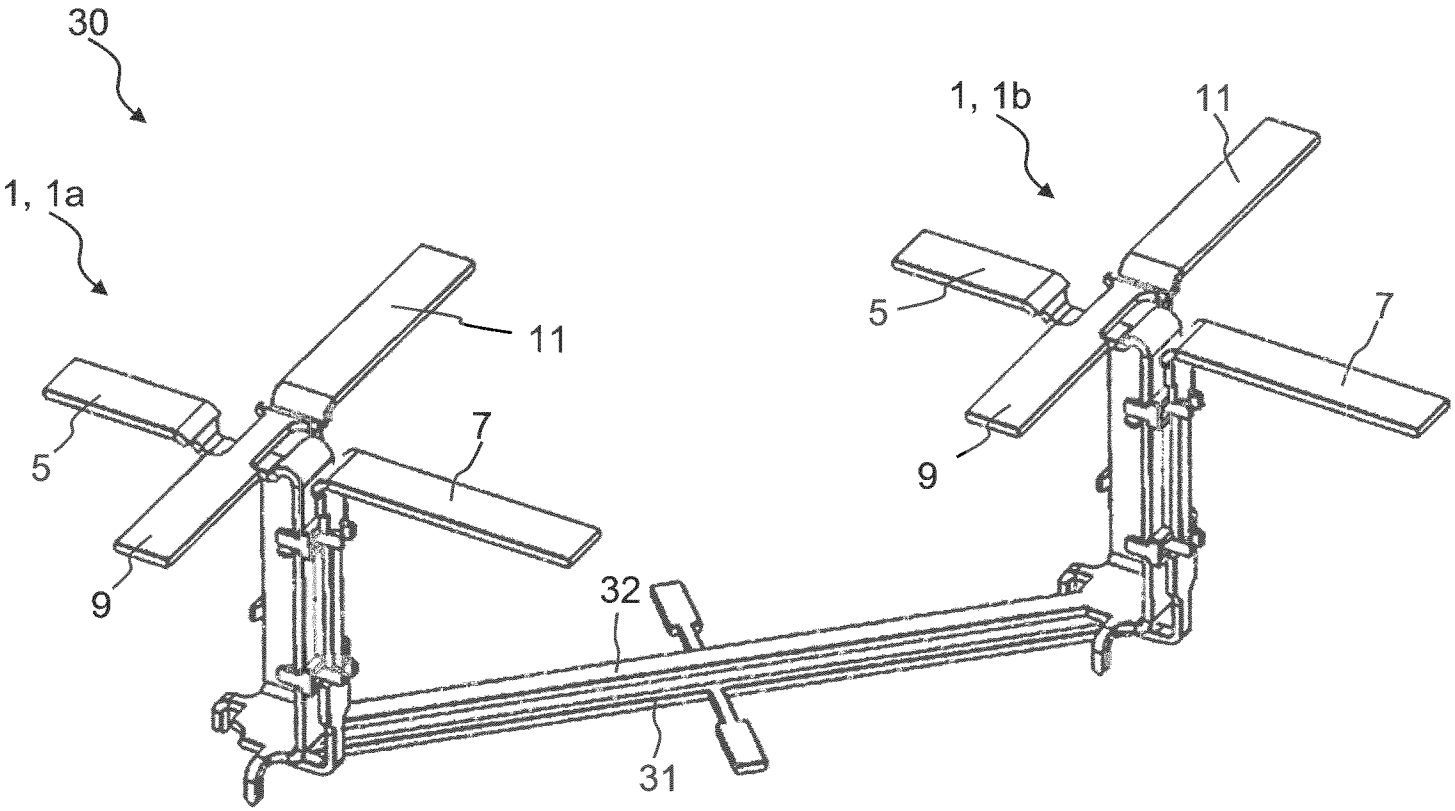
Figure 22B:
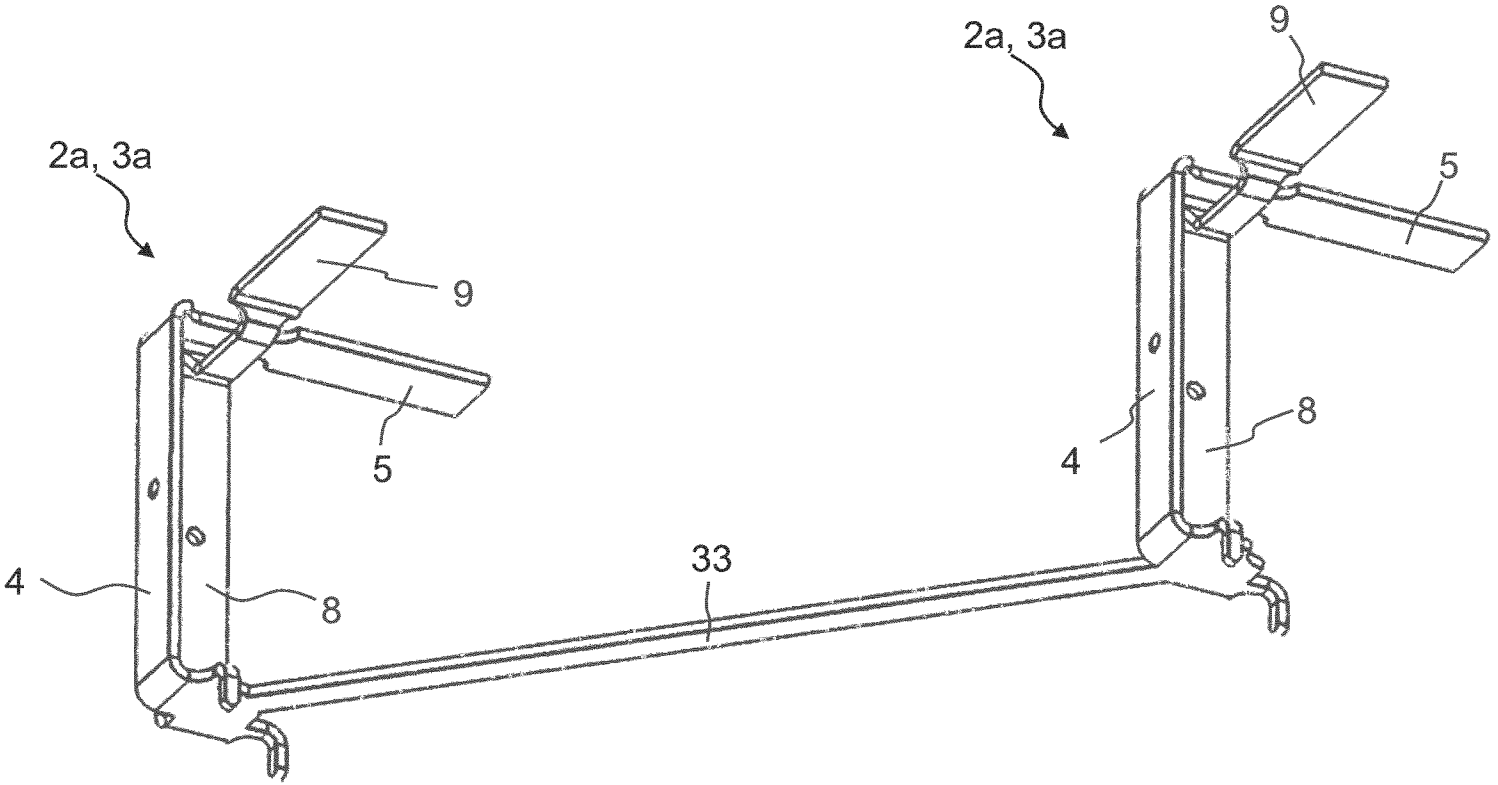
Figure 22C:
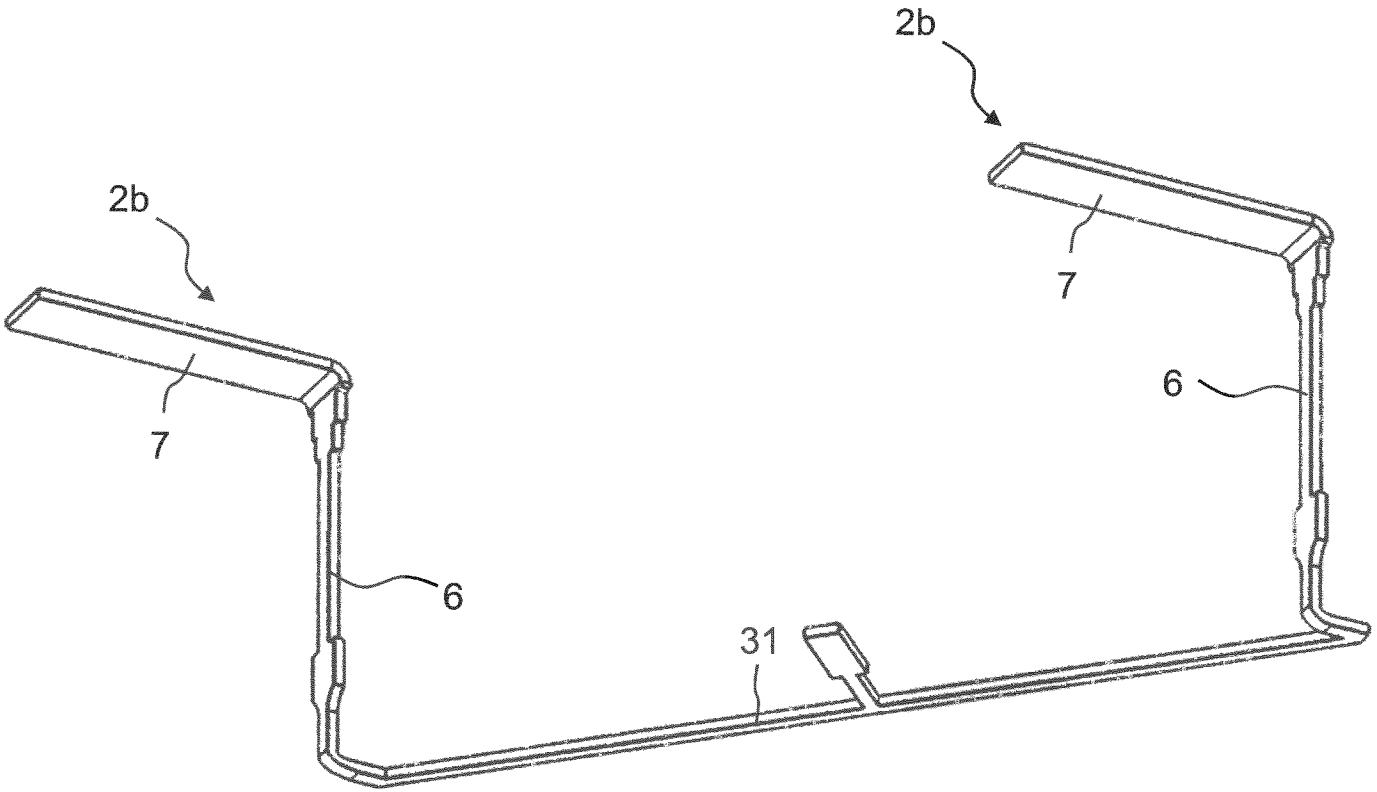
Figure 23:
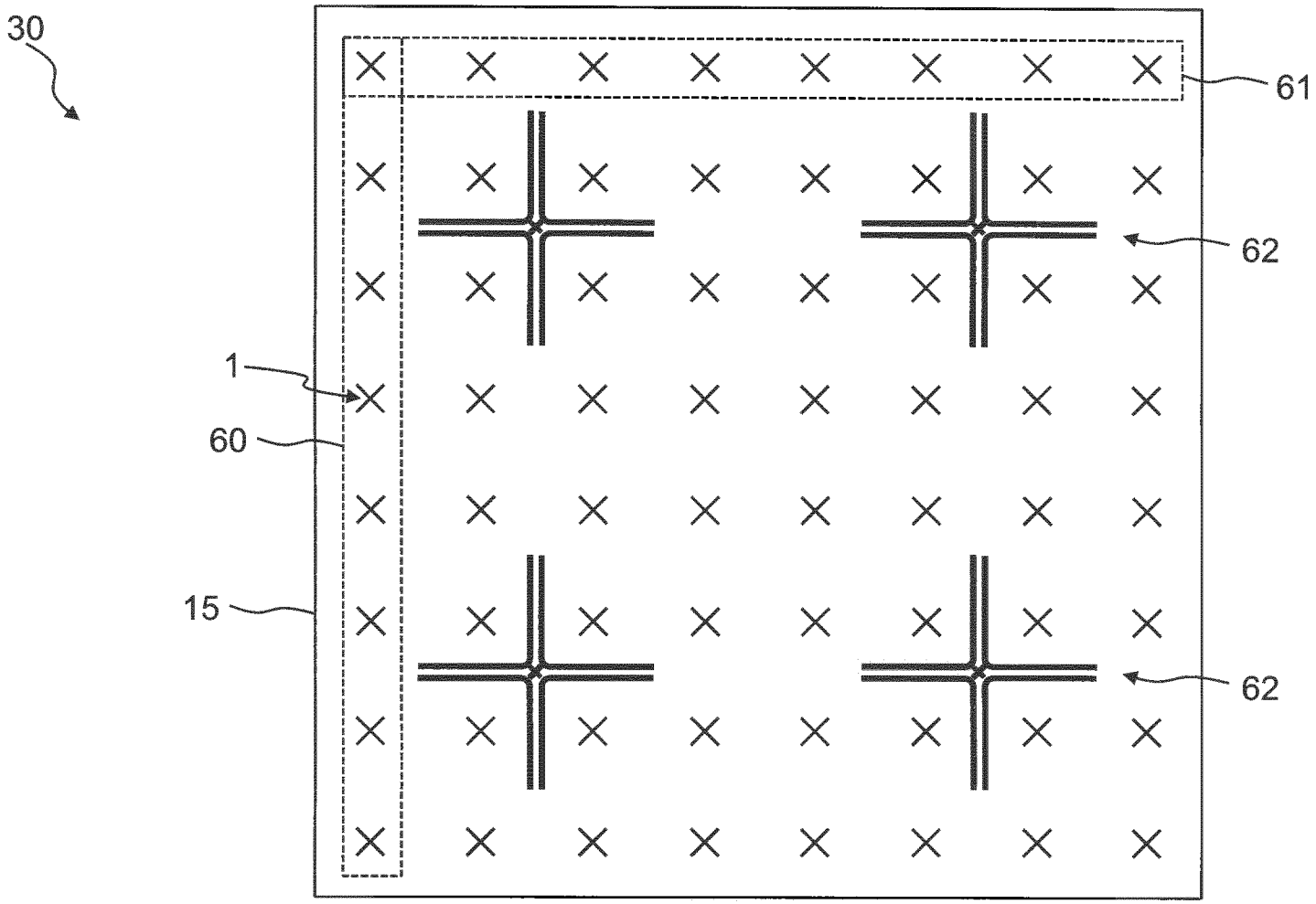

Various exemplary embodiments of the invention will be described by way of example hereinafter with reference to the drawings. Like parts have the same reference signs. The corresponding figures of the drawings show, specifically:

FIGS. 1A, 1B: various illustrations of a first exemplary embodiment of the crossed dipole according to the invention;

FIGS. 2A, 2B, 3A, 3B: various three-dimensional illustrations of different dipole halves of the first exemplary embodiment of the crossed dipole according to the invention;

FIGS. 4A, 4B: various illustrations, from the side, of different dipole halves of the first exemplary embodiment of the crossed dipole according to the invention;

FIG. 5: a three-dimensional illustration of a second exemplary embodiment of the crossed dipole according to the invention;

FIGS. 6A, 6B: various illustrations, from the side, of different dipole halves of the second exemplary embodiment of the crossed dipole according to the invention;

FIG. 7: a three-dimensional illustration of a third exemplary embodiment of the crossed dipole according to the invention;

FIGS. 8A, 8B: various illustrations, from the side, of different dipole halves of the third exemplary embodiment of the crossed dipole according to the invention;

FIG. 9: a three-dimensional illustration of a fourth exemplary embodiment of the crossed dipole according to the invention;

FIG. 10: a three-dimensional illustration which explains that the crossed dipole is configured as an SMD component part;

FIGS. 11A, 11B: various three-dimensional illustrations of the crossed dipole according to the invention, showing a first and second holding device;

FIG. 12: an enlarged three-dimensional illustration of the first and second holding device from FIGS. 11A and 11B;

FIGS. 13A, 13B: show an overview of various exemplary embodiments of the crossed dipole via the electrical adjustment and insulation of the two dipole antenna elements to/from one another;

FIG. 14: shows a three-dimensional illustration of an antenna arrangement according to the invention having at least two crossed dipoles;

FIGS. 15A, 15B, 15C, 15D, 15E, 15F: show various further three-dimensional illustrations of the fourth exemplary embodiment of the crossed dipole according to the invention;

FIGS. 16A, 16B, 16C: show various further three-dimensional illustrations of an exemplary embodiment of the crossed dipole according to the invention;

FIGS. 17A, 17B: show various further three-dimensional illustrations of an exemplary embodiment of the crossed dipole according to the invention;

FIGS. 18A, 18B, 18C, 18D: show various further three-dimensional illustrations of the crossed dipole according to the invention, which is constructed from printed circuit boards;

FIGS. 19A, 19B, 19C: show various further three-dimensional illustrations of another exemplary embodiment of the crossed dipole according to the invention;

FIGS. 20A, 20B, 20C: show various further three-dimensional illustrations of a fifth exemplary embodiment of the crossed dipole according to the invention;

FIGS. 21A, 21B, 21C: show various further three-dimensional illustrations of a further exemplary embodiment of the crossed dipole according to the invention;

FIGS. 22A, 22B, 22C: show various three-dimensional illustrations of a further antenna arrangement according to the invention having at least two crossed dipoles;

FIG. 23: shows an antenna arrangement with a plurality of crossed dipoles according to the invention in different sizes, so as to be able to cover different frequency ranges.

Figure 2B:
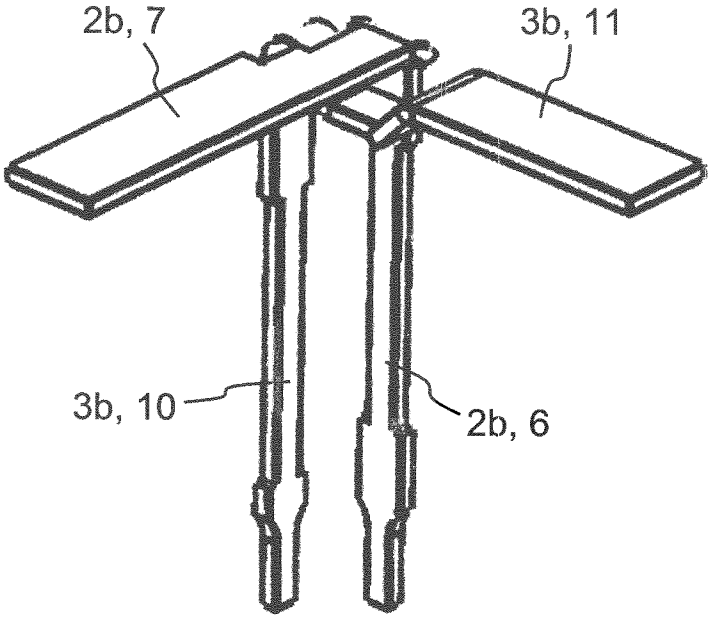

Different exemplary embodiments of the dual-polarized crossed dipole 1 according to the invention will be described hereinafter. FIG. 1A shows a three-dimensional view of a first exemplary embodiment of the dual-polarized crossed dipole 1 according to the invention. FIG. 1B shows a plan view of this first exemplary embodiment. The dual-polarized crossed dipole 1 comprises a first dipole antenna element 2 and a second dipole antenna element 3. The first dipole antenna element 2 is shown for example in FIG. 4A, and the second dipole antenna element 3 is shown in FIG. 4B. The first dipole antenna element 2 comprises two dipole halves 2*a*, 2*b*. The second dipole antenna element 3 likewise comprises two dipole halves 3*a*, 3*b*. The first dipole half 2*a* of the first dipole antenna element 2 is shown by way of example in FIG. 2A. The second dipole half 2*b* of the first dipole antenna element 2 is shown in FIG. 3B. The first dipole half 3*a* of the second dipole antenna element 3 can be seen in FIG. 2A, whereas the second dipole half 3*b* of the second dipole antenna element 3 can be seen in FIG. 3A. The second dipole halves 2*b*, 3*b* of both dipole antenna elements 2, 3 are shown in FIG. 2B.

The first dipole half 2*a* of the first dipole antenna element 2 comprises an earth connector 4 and a dipole earth wing 5. A first end 5*a* of the dipole earth wing 5 is galvanically and mechanically connected to a first end 4*a* of the earth connector 4. A second end 4*b* of the earth connector 4 is arrangeable on at least one main body 15. This main body 15 is shown for example in FIGS. 4A and 4B.

The second dipole half 2*b* of the first dipole antenna element 2 comprises a signal connector 6 with a first end 6*a* and an opposite, second end 6*b* and a dipole signal wing 7, wherein a first end 7*a* of the dipole signal wing 7 is galvanically and mechanically connected to the first end 6*a* of the signal connector 6. The first dipole half 3*a* of the second dipole antenna element 3 comprises an earth connector 8 and a dipole earth wing 9. A first end 9*a* of the dipole earth wing 9 is galvanically and mechanically connected to a first end 8*a* of the earth connector 8. A second end 8*b* of the earth connector 8 is arrangeable or arranged on the at least one main body 15. The second dipole half 3*b* of the second dipole antenna element 3 comprises a signal connector 10 with a first end 10*a* and an opposite second end 10*b*. The second dipole half 3*b* of the second dipole antenna element 3 additionally comprises a dipole signal wing 11, wherein a first end 11*a* of the dipole signal wing 11 is galvanically and mechanically connected to the first end 10*a* of the signal connector 10.

The signal connector 6 of the first dipole antenna element 2 runs parallel, or with a component predominantly parallel to the earth connector 4 of the first dipole antenna element 2. The signal connector 10 of the second dipole antenna element 3 runs parallel, or with a component predominantly parallel to the earth connector 8 of the second dipole antenna element 3. The wording "with a component predominantly parallel" is understood to mean that also angles of less than 45° are enclosed between the earth connectors 4, 8 and the corresponding signal connectors 6, 10. The angle, however, is preferably less than 40°, more preferably less than 35°, 30°, 25°, 20°, 15°, 10° or 5°.

A distance between the earth connectors 4, 8 and the corresponding signal connectors 6, 10 is preferably selected such that a waveguide and preferably a microstrip is created. With regard to the dimensioning it must be ensured that air or dielectric is situated between the signal line and the earth line.

If the distance is designed as a microstrip, the distance between the earth connectors 4, 8 and the corresponding signal connectors 6, 10 in the case of an air microstrip is less than 5 mm, 4 mm, 3 mm, 2 mm, 1 mm, 0.8 mm, 0.6 mm, or 0.2 mm, and more preferably greater than 0.3 mm, 0.5 mm, 0.7 mm, 0.9 mm, 1.1 mm, 2.1 mm, 3.1 mm, 4.1 mm, or 5.1 mm.

The dipole signal wing 7 and the dipole earth wing 5 of the first dipole antenna element 2 run in opposite directions. This means that, in plan view (FIG. 1B), an angle of approximately 180° is formed between the dipole signal wing 7 and the dipole earth wing 5 of the first dipole antenna element 2. The wording "approximately" means that a deviation of less than 10°, 8°, 7°, 5°, 3°, or 1° therefrom is also included.

The same applies also to the dipole signal wing 11 and the dipole earth wing 9 of the second dipole antenna element 3, which likewise run in opposite directions.

The first dipole half 2*a* of the first dipole antenna element 2 is of single-part design, as is also the second dipole half 2*b* of the first dipole antenna element 2. In respect of FIG. 2A, this means that the dipole earth wing 5 of the first dipole antenna element 2 and the earth connector 4 of the first dipole wing 2 are formed from a common (sheet metal) part. In respect of FIGS. 2B and 3B, the same applies likewise for the dipole signal wing 7 of the first dipole antenna element 2 and the signal connector 6 of the first dipole antenna element 2. These are also of single-part design and consist of a single (sheet metal) part.

The same applies also for the first dipole half 3*a* of the second dipole antenna element 3 and the second dipole half 3*b* of the second dipole antenna element 3. The first dipole half 3*a* is shown for example in FIG. 2A. The earth connector 8 of the second dipole antenna element 3 and the dipole earth wing 9 of the second dipole antenna element 3 are of single-part design and consist solely of a common (sheet metal) part. In respect of FIGS. 2B and 3A it is shown that the signal connector 10 of the second dipole antenna element 3 and dipole signal wing 11 of the second dipole antenna element 3 are also of single-part design and consist of a single common (sheet metal) part.

In respect of FIG. 1A and FIG. 2B it is additionally shown that the dipole signal wing 11 of the second dipole antenna element 3 passes through, that is to say runs through, beneath the dipole signal wing 7 of the first dipole antenna element 2 without contact. The two dipole signal wings 7, 11 are galvanically isolated from one another.

In principle it could also be that the dipole earth wing 9 of the second dipole antenna element 3 passes through beneath the dipole earth wing 5 of the first dipole antenna element 2 without contact.

The first and/or second dipole half 2*a*, 2*b* of the first dipole antenna element 2, as already explained, are/is formed from a single (common) (sheet metal) part. In particular the first and/or second dipole half 2*a*, 2*b* are/is formed from a stamped sheet metal part and/or cut sheet metal part. A cut sheet metal part is understood to be a sheet metal cut by a laser and/or a blade. A sheet metal consists here of an electrically conductive metal or a metal alloy.

The first and/or second dipole half 2*a*, 2*b* of the first dipole antenna element 2 may be formed alternatively or additionally also of a bent sheet metal part and/or angled sheet metal part, such that a certain shaping is achieved.

The same applies also for the first and/or second dipole half 3*a*, 3*b* of the second dipole antenna element 3.

Figure 2A:
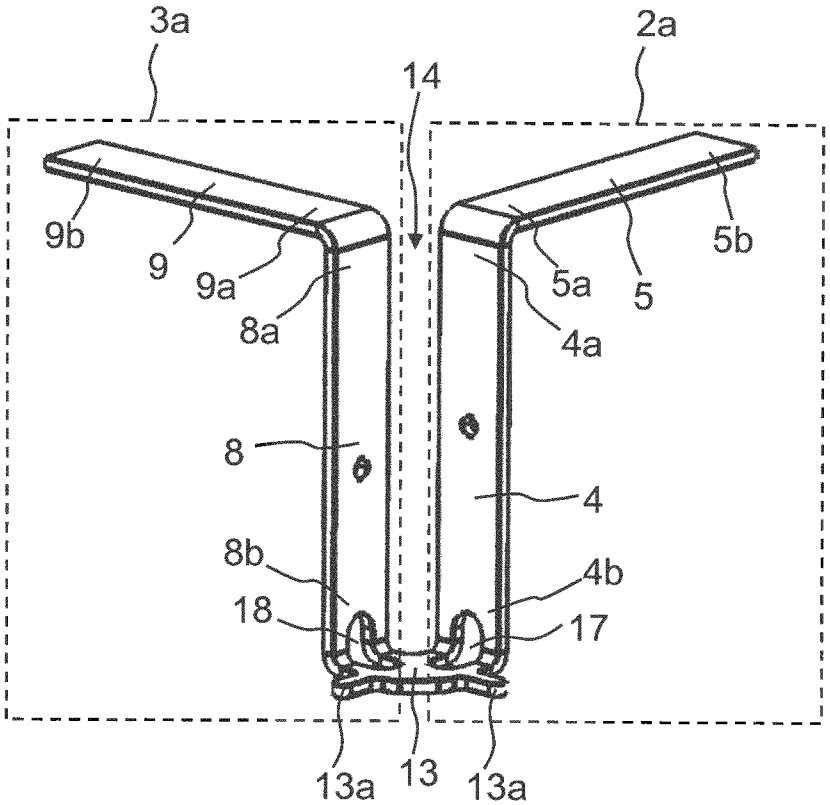
Figure 3A:
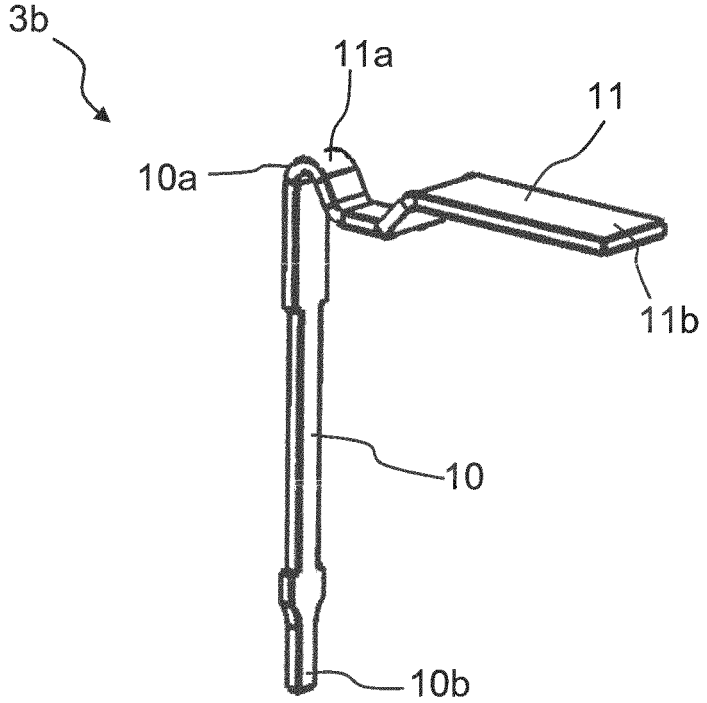
Figure 3B:
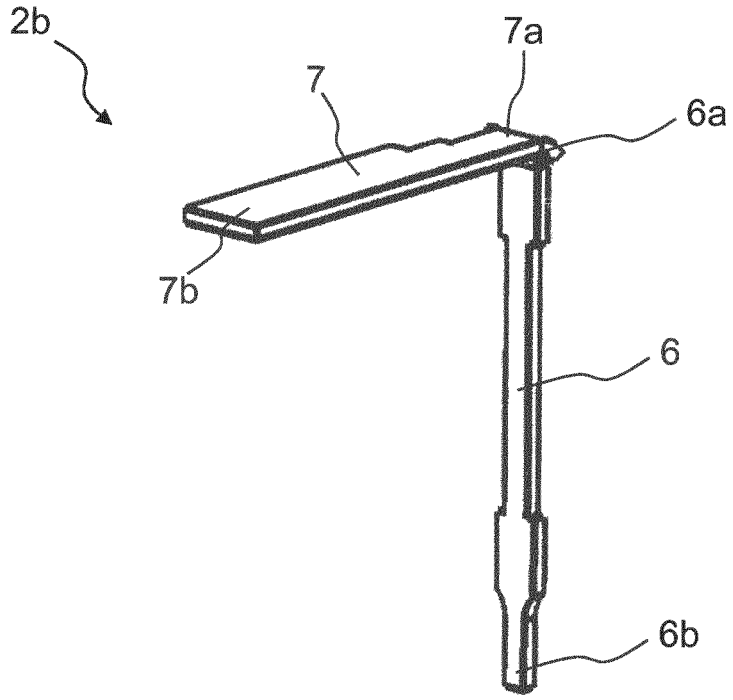

It is additionally shown in FIGS. 2A and 2B that the first dipole halves 2*a*, 3*a* of both dipole antenna elements 2, 3 and the second dipole halves 2*b*, 3*b* of both dipole antenna elements 2, 3 are formed on the whole of precisely three metal parts, which are constructed differently from one another, wherein at least two metal parts are preferably produced using the same tool.

In FIG. 1B the dipole signal wings 7, 11 of both dipole antenna elements 2, 3 run approximately at an angle of 90° to one another. The same applies also for the dipole earth wings 5, 9 of both dipole antenna elements 2, 3. The dipole earth wing 5 of the first dipole antenna element 2 is additionally arranged offset by an angle of approximately 90° in relation to the dipole signal wing 11 of the second dipole antenna element 3. The wording "approximately" means that deviations from 90° of less than 5°, 4°, 3°, 2°, or 1° are also included.

The same also applies for the dipole earth wing 9 of the second dipole antenna element 3. This runs likewise at an angle of approximately 90° to the dipole signal wing 7 of the dipole antenna element 2.

FIGS. 1A and 1B show the orientation of the dipole earth wings 5, 9 and the dipole signal wings 7, 11 of both dipole antenna elements 2, 3. These are not arranged upright in relation to the at least one main body 15, but instead lengthwise. The cross-section through the dipole earth wings 5, 9 and through the dipole signal wings 7, 11 is rectangular. The longer sides of the rectangle run parallel, or with a component predominantly parallel to the at least one main body 15, whereas the short sides of the rectangle run perpendicularly, or with a component predominantly perpendicularly to the at least one main body 15. This means that, in plan view of the dual-polarized crossed dipole 1 (FIG. 1B), the larger surface of the dipole earth wings 5, 9 and the dipole signal wings 7, 11 is visible, as compared with the side view in FIGS. 4A and 4B.

In FIG. 1B it is also shown that the dipole earth wings 5, 9 of both dipole antenna elements 2, 3 are of equal length. It would also be possible for these to be of different lengths. The same applies also for the dipole signal wings 7, 11 of both dipole antenna elements 2, 3. In the exemplary embodiment from FIG. 1B they are also of equal length. However, they could also be of different lengths. On closer inspection it should be noted that the dipole signal wings 7, 11 of both dipole antenna elements 2, 3 are of the same length as the dipole earth wings 5, 9 of the two dipole antenna elements 2, 3. It would be conceivable here as well that at least one dipole signal wing 7, 11 or both dipole signal wings 7, 11 are longer or shorter than one or both dipole earth wings 5, 9.

It is also conceivable that the dipole signal wing 7 and/or dipole earth wing 5 of the first dipole antenna element 2 has a widening over a partial length. In respect of FIG. 1B this is the case for the dipole signal wing 7 of the first dipole antenna element 2, which is narrower at its first end 7*a*. The dipole signal wing 7 and the dipole earth wing 5 of the first dipole antenna element 2 are of equal width over the majority of the length. The same applies also for the dipole signal wing 11 and the dipole earth wing 9 of the second dipole antenna element 3.

In FIG. 2A it can be seen in addition that the earth connector 4 of the first dipole antenna element 2 and the earth connector 8 of the second dipole antenna element 3 are electrically conductively connected to one another at their second end 4*b*, 8*b* and, on the whole, are of single-part design. The first dipole halves 2*a*, 3*a* of both dipole antenna elements 2, 3 are therefore formed from a single (common) (sheet metal) part. At their second ends 4*b*, 8*b* the two earth connectors 4, 8 comprise a support face 13 or a base. The dual-polarized crossed dipole 1 is arrangeable on the main body 15 via this support face 13. This support face 13 may also have additional tabs 13*a*, which protrude outwardly, so as to prevent the dual-polarized crossed dipole 1 from tipping over, in particular if the dipole is embodied as an SMD component. Such a contact face 13, however, is not absolutely necessary. The earth connectors 4, 8 could also be insertable in the at least one main body 15.

The earth connector 4 of the first dipole antenna element 2 and the earth connector 8 of the second dipole antenna element 3 are preferably electrically conductively connected to one another exclusively at their second 3*nd* 4*b*, 8*b*. This means that the earth connector 4 of the first dipole antenna element 2 and the earth connector 8 of the second dipole antenna element 3 are galvanically isolated from one another between their second ends 4*b*, 8*b* and the first ends 4*a*, 8*a* by a slot 14.

In FIG. 1A it can additionally be seen that the earth connector 4 of the first dipole antenna element 2 is wider along its entire length than the signal connector 6 of the first dipole antenna element 2. The same applies also for the earth connector 8 of the second dipole antenna element 3 in relation to the signal connector 10 of the second dipole antenna element 3. In principle it would also be possible for the earth connectors 4, 8 of both dipole antenna elements 2, 3 to be wider at least along a partial length than the corresponding signal connectors 6, 10.

The at least one main body 15 comprises a printed circuit board and/or a reflector. The reflector could also be formed as a conductive layer on one side of the printed circuit board.

The at least one main body 15 could also be part of the dual-polarized crossed dipole 1.

In the dual-polarized crossed dipole 1 the electrical phase centre and the mechanical (for example rotation/weight) centre are offset in relation to one another. This means that these centres pass through different regions of the dual-polarized crossed dipole 1. The first dipole antenna element 2 and the second dipole antenna element 3 each have their own electrical phase centre. Both electrical phase centres are offset in relation to one another. By means of such a structure, very high insulation values of at least −20 dB, −30 dB, or −40 dB are achieved at the foot of the crossed dipole 1.

FIGS. 4A and 4B show different side (sectional) illustrations of different dipole halves 2*a*, 2*b* and 3*a*, 3*b* of the crossed dipole 1 according to the invention. The dipole earth wing 5 and the dipole signal wing 7 of the first dipole antenna element 2 lie in a common plane over their entire length. This plane is oriented parallel, or with a component predominantly parallel to the at least one main body 15. In principle it would also be possible for the dipole earth wing 5 and the dipole signal wing 7 of the first dipole antenna element 2 to lie in a common plane at least over the majority of their longitudinal extent. The same applies also for the dipole earth wing 9 and the dipole signal wing 11 of the second dipole antenna element 3.

The dipole signal wings 7, 11 of both dipole antenna elements 2, 3 and/or the dipole earth wings 5, 9 of both dipole antenna elements 2, 3 preferably lie in the common plane over the majority of their longitudinal extent or over their entire longitudinal extent, or are arranged in at least two different planes which are parallel to one another.

In FIGS. 4A and 4B the field distribution of the E-field is shown by arrows. This distribution is predominantly symmetrical and there is a high symmetry in particular at the transition of the E-field between the corresponding earth connectors 4, 8 of both dipole antenna elements 2, 3 and the corresponding signal connectors 6, 10 of both dipole antenna elements 2, 3 to the dipole earth wings 5, 9 and the dipole signal wings 7, 11 of both dipole antenna elements 2, 3.

Approximate dimensioning specifications of the dipole signal wings 7, 11 and the dipole earth wings 5, 9 of both dipole antenna elements 2, 3 are also indicated in FIGS. 4A and 4B. Furthermore, a height, i.e. a distance of the dipole signal wings 7, 11 or the dipole earth wings 5, 9 from the at least one main body 15 is also indicated.

The length of the dipole signal wing 7 and of the dipole earth wing 5 of the first dipole antenna element 2 is preferably 0.25λ, wherein λ is the centre frequency of a first high-frequency signal transmittable and receivable via the first dipole antenna element 2. A deviation of ±0.15λ is permissible. A distance between the dipole signal wing 7 and the dipole earth wing 5 and the at least one main body 15 is likewise preferably 0.25λ, wherein a deviation of ±0.15λ is again permissible.

The same applies also for the dipole signal wing 11 and the dipole earth wing 9 of the second dipole antenna element 3. These likewise have a length corresponding to approximately 0.25λ, wherein A in this case is the centre frequency of a second high-frequency signal transmittable and receivable via the second dipole antenna element 2. A distance between the dipole signal wing 11 and the dipole earth wing 9 of the second dipole antenna element 3 and the at least one main body 15 is likewise approximately 0.25λ. Here as well a deviation of ±0.15λ is admissible.

The centre frequencies of the first and the second high-frequency signal may be the same or different.

In FIG. 4B a curved profile of the dipole signal wing 11 of the second dipole antenna element 3 is also shown. The dipole signal wing 11 of the second dipole antenna element 3 is divided into at least two segments $\mathbf{11}_1$ and $\mathbf{11}_2$, which run parallel, or with a component predominantly parallel to one another. These segments $\mathbf{11}_1$, $\mathbf{11}_2$, however, are arranged in different planes (at different distances from the at least one main body 15). These segments $\mathbf{11}_1$, $\mathbf{11}_2$ are connected to one another galvanically and mechanically via an intermediate segment $\mathbf{11}_3$. The first segment $\mathbf{11}_1$ is arranged closer to at least one main body 15 and thus closer to the second end 10*b* of the signal connector 10 of the second dipole antenna element 3 than the second segment $\mathbf{11}_2$. The first segment $\mathbf{11}_1$ of the dipole signal wing 11 of the second dipole antenna element 3, which is also connected to the first end 10*a* of the signal connector 10 of the second dipole antenna element 3, is additionally arranged closer to the second end 10*b* of the signal connector 10 than the first end 10*a* of the signal connector 10. The dipole signal wing 11 thus has a U-shaped profile (falling and rising profile) over a partial length, in particular over the length of the first segment $\mathbf{11}_1$.

As will also be explained later, such a profile is also possible for the other dipole signal wing 7 of the first dipole antenna element 2 and/or for the dipole earth wings 5, 9 of both dipole antenna elements 2, 3.

In FIGS. 4A and 4B it is additionally shown that the second end 6*b*, 10*b* of both signal connectors 6, 10 of both dipole antenna elements 2, 3 projects beyond the second end 4*b*, 8*b* of the earth connectors 4, 8 of both dipole antenna elements 2, 3. It is thus possible that the second end 6*b*, 10*b* of the signal connectors 6, 10 of both dipole antenna elements 2, 3 is introducible into a corresponding receiving opening in the at least one main body 15 or that the second ends 6*b*, 10*b* of both signal connectors 6, 10 of both dipole antenna elements 2, 3 pass through the main body 15. In this case the two signal connectors 6, 10 of both dipole antenna elements 2, 3 would be fed from the second side of the at least one main body 15, that is to say from the side that is opposite the upper side, that is to say the first side of the at least one main body 15, on which (the upper side) the earth connectors 4, 8 are arranged or fastened via their second ends 4*b*, 8*b*.

In principle it would be possible for an inner conductor of each of two coaxial cables to be galvanically connected one to each second end 6*b*, 10*b* of the two signal connectors 6, 10 via a plugged, screwed and/or soldered connection, whereas the corresponding outer conductors of the coaxial cables are galvanically connected one to each second end 4*b*, 8*b* of the earth connectors 4, 8, directly or indirectly via a further earth face (for example on the at least one main body 15).

In FIG. 2A two openings 17, 18 are formed in the support face 13 or the two second ends 4*b*, 8*b* of the earth connectors 4, 8 of both dipole antenna elements 2, 3. A first opening 17 is formed here at the second end 4*b* of the earth connector 4 of the second end of the first dipole antenna element 2. A second opening 18 is formed at the second end 8*b* of the earth connector 8 of the second dipole antenna element 3. In respect of FIGS. 4A and 4B the second end 6*b*, 10*b* of the signal connectors 6, 10 of the two dipole antenna elements 2, 3 passes through these openings 17, 18 in the second ends 4*b*, 8*b* of the two earth connectors 4, 8. The signal connectors 6, 10 of both dipole antenna elements 2, 3 are arranged here contact-free, that is to say galvanically isolated from the earth connectors 4, 6 of both dipole antenna elements 2, 3.

In this regard, reference is made to another exemplary embodiment in FIG. 10. FIG. 10 shows that the dual-polarized crossed dipole 1 is formed as an SMD component part. The first and the second opening 17, 18 extend (also) laterally on the earth connectors 4, 8 of both dipole antenna elements 2, 3, such that each signal connector 6, 10 is guided (bent) through the corresponding openings 17, 18 via its second end 6*b*, 10*b*, wherein both the second end 6*b*, 10*b* of the signal connectors 6, 10 of both dipole antenna elements 2, 3 and the second end 4*b*, 8*b* of both earth connectors 4, 8 of both dipole antenna elements 2, 3 end in the same plane and in particular are arrangeable on the same side of the at least one main body 15.

The second ends 6*b*, 10*b* of both signal connectors 6, 10 and the second ends 4*b*, 8*b* of both earth connectors 4, 8 of the two dipole antenna elements 2, 3 are therefore SMD-solderable. Such a soldering process may be implemented by way of a reflow method.

FIG. 5 shows a second exemplary embodiment of the dual-polarized crossed dipole 1 according to the invention. The crossed dipole 1 shown there is constructed substantially similarly to the first exemplary embodiment, and reference is made to said exemplary embodiment in this regard. Only the differences, which are relatively small, will be discussed hereinafter. Both dipole signal wings 7, 11 of both dipole antenna elements 2, 3 and both dipole earth wings 5, 9 of the two dipole antenna elements 2, 3 have an at least partially curved or stepped profile. FIG. 6A shows a (sectional) illustration, from the side, of the first and second dipole halves 2*a*, 2*b* of the first dipole antenna element 2, whereas FIG. 6B shows a (sectional) illustration, from the side, of the first and second dipole halves 3*a*, 3*b* of the second dipole antenna element 3.

With regard to FIG. 6A it is shown that the dipole signal wing 7 of the first dipole antenna element 2 is divided into at least two segments $\mathbf{7}_1$ and $\mathbf{7}_2$. Both segments $\mathbf{7}_1$, $\mathbf{7}_2$ run parallel, or with a component predominantly parallel to one another. These segments $\mathbf{7}_1$, $\mathbf{7}_2$ are then arranged in different planes and are connected to one another galvanically and mechanically via at least one intermediate segment $\mathbf{7}_3$. This results in the stepped profile shown in FIG. 6A.

The same applies also for the dipole earth wing 5 of the first dipole antenna element 2. This is likewise divided into two segments $\mathbf{5}_1$, $\mathbf{5}_2$ which are arranged parallel, or with a component predominantly parallel to one another. These segments $\mathbf{5}_1$, $\mathbf{5}_2$ run in different planes and are connected to one another galvanically and mechanically via at least one intermediate segment $\mathbf{5}_3$. This results, here as well, in a stepped profile.

The dipole signal wing 7 and the dipole earth wing 5 of the first dipole antenna element 2 in this case are constructed identically or approximately identically. FIG. 5 shows that the first segment $\mathbf{7}_1$ of the dipole signal wing 7 has a smaller width than the first segment $\mathbf{5}_1$ of the dipole earth wing 5 of the first dipole antenna element 2. This is due to the fact that the dipole signal wing 7 of the first dipole antenna element 2 runs above the dipole signal wing 11 of the second dipole antenna element 3, and the smaller width prevents these two dipole signal wings 7, 11 from coming galvanically into contact with one another or from being (strongly) capacitively coupled.

In principle it would be possible for the first segments $\mathbf{7}_1$ and $\mathbf{5}_1$ of, respectively, the dipole signal wing 7 and the dipole earth wing 5 to extend in the direction of the at least one main body 15, whereby, in particular in the region of the first segments $\mathbf{5}_1$, $\mathbf{7}_1$, a U-shaped profile of the dipole signal wing 7 and of the dipole earth wing 5 of the first dipole antenna element 2 would be achieved.

A U-shaped profile of this kind is shown in FIG. 6B for the dipole signal wing 11 and the dipole earth wing 9 of the second dipole antenna element 3. As already described in relation to the dipole signal wing 11, in this exemplary embodiment the dipole earth wing 9 of the second dipole antenna element 3 also comprises a U-shaped profile. The dipole earth wing 9 of the second dipole antenna element 3 is likewise divided into at least two segments $\mathbf{9}_1$, $\mathbf{9}_2$, which run in parallel, or with a component predominantly in parallel. These segments $\mathbf{9}_1$, $\mathbf{9}_2$ are arranged in different planes and are connected to one another at least via an intermediate segment $\mathbf{9}_3$. A stepped profile would thus result initially. However, since the first segment $\mathbf{9}_1$ of the dipole earth wing 9 of the second dipole antenna element 3, which connects to the first end 8*a* of the earth connector 8 of the second dipole antenna element 3, is arranged closer in the direction of the second end 8*b* of the earth connector 8, that is to say closer in the direction of the at least one main body 15, than the first end 8*a* of the earth connector 8, there is initially a falling and then, due to the connection segment $\mathbf{9}_3$, a rising profile of the dipole earth wing 9, such that this has a U-shaped profile at least in the region of the first segment $9_1$.

In principle, the dipole signal wing 11 and the dipole earth wing 9 of the second dipole antenna element could have merely a stepped profile, wherein the term "stepped profile" is understood to mean that the first segment $11_1$ or $9_1$ of the dipole signal wing 11 or of the dipole earth wing 9 are not arranged closer to the at least one main body 15 than the second end of the corresponding signal connector 10 or earth connector 8, and therefore in particular an ever-rising profile is provided in the direction of the second end 11*b* or 9*b* of the dipole signal wing 11 or the dipole earth wing 9.

FIG. 7 shows a third exemplary embodiment of the dual-polarized crossed dipole 1 according to the invention. FIGS. 8A and 8B show different (sectional) illustrations, from the side, of different dipole halves 2*a*, 2*b* or 3*a*, 3*b* of the dual-polarized crossed dipole 1.

The dual-polarized crossed dipole 1 of FIGS. 7, 8A, 8B is constructed substantially in accordance with the previous exemplary embodiments, to which reference is hereby made.

FIG. 8B shows that the dipole signal wing 7 and the dipole earth wing 5 of the first dipole antenna element 2 are constructed symmetrically to one another. A high level of symmetry at the transition of the E-field between the signal connector 6 and the earth connector 4 to the dipole signal wing 7 and the dipole earth wing 5 of the first dipole antenna element 2 is thus achieved. The principal distribution of the E-field in the feed region of the wings 5, 7 is shown by the arrows in FIG. 8B.

In FIG. 8A it is shown that merely the dipole signal wing 11 of the second dipole antenna element 3 has a stepped profile. This means that the first end 10*a* of the signal connector 10 is arranged closer to the at least one main body 15 than the first end 8*a* of the earth connector 8 of the second dipole antenna element 3. There is thus a height offset between the first end 11*a* of the dipole signal wing 11 and the first end 9*a* of the dipole earth wing 9 of the second dipole antenna element 3 towards the at least one main body 15. This height offset leads to a slightly asymmetric E-field distribution, but still to practically identical S parameters and a practically identical far field compared with the crossed dipole from FIG. 4B, in which there is a symmetrical widening of the microstrip (signal connector 10 or earth connector 8).

In FIG. 13A, some of the electrical properties of the first three exemplary embodiments of the dual-polarized crossed dipole 1 according to the invention are compared. The first exemplary embodiment (V001) is shown in FIGS. 1A to 4B, whereas the second exemplary embodiment (V002) is shown in FIGS. 5 to 6B, and wherein the third exemplary embodiment (V003) is shown in FIGS. 7 to 8B. FIG. 13A shows electrical values that reflect the electrical insulation of the two dipole antenna elements 2, 3 from one another for each of the three exemplary embodiments in a frequency range of from 3 GHz to 4 GHz. The first exemplary embodiment (V001) is shown by a solid line, whereas the second exemplary embodiment (V002) is shown by a dashed line, and wherein the third exemplary embodiment (V003) is shown by a dotted line. Besides the frequency, the S parameters are also plotted, wherein the second end 6*b* or 10*b* of a signal connector 6 or 10 is fed and the second end 10*b* or 6*b* of the other signal connector 10 or 6 is measured in respect of the signal level. The third exemplary embodiment (V003) indeed has the lowest insulation between the individual dipole antenna elements 2, 3, but the most constant profile. The highest insulation is achieved in the first exemplary embodiment (V001), wherein the second exemplary embodiment (V002) is better suited for lower frequencies. The first exemplary embodiment (V001) also shows the adaptation with the widest bandwidth, because it has the most compact curve in the Smith graph. In this regard see FIG. 13B. Since two crossed dipoles 1 will preferably be connected together later, the impedance curve in the Smith graph should ideally lie in a very compact manner on the real axis at approximately 100 ohms. On the whole, it can be seen that a symmetrical structure of the individual dipole earth wings 5, 9 with respect to the dipole signal wings 7, 11 running in opposite directions is desirable, and that in particular the U-shaped profile delivers good results. In the case of the U-shaped profile it is ensured that the first ends 4*a*, 6*a* and 8*a*, 10*a* of the earth connectors 4, 8 and the signal connectors 6, 10 running parallel to one another end at approximately the same height (above the at least one main body 15). A dipole signal wing 11 only from this common height then starts to pass through beneath the other dipole signal wing 7.

FIG. 9 shows a three-dimensional illustration of a fourth exemplary embodiment of the dual-polarized crossed dipole 1 according to the invention.

The dipole earth wing 5 and the dipole signal wing 7 of the first dipole antenna element 2 are divided over the majority of their longitudinal extent or along their entire length by a separating slot 20 into two wing segments 5', 5" and 7', 7" respectively, running distanced from one another. These wing segments 5', 5" and 7', 7" run distanced from one another, that is to say isolated galvanically from one another. The wing segments 5', 5" of the dipole earth wing 5 are preferably of different lengths. The same applies likewise for the wing segments 7', 7" of the dipole signal wing 7 of the first dipole antenna element 2.

The same preferably applies likewise for the second dipole antenna element 3. The dipole earth wing 9 and the dipole signal wing 11 of the second dipole antenna element 3 are likewise divided over the majority of their longitudinal extent or along their entire length by a separating slot 20 into two wing segments 9', 9" and 11', 11" respectively, running distanced from one another. These wing segments 9', 9" and 11', 11" run distanced from one another, that is to say isolated galvanically from one another and are preferably of different lengths. The wing segments 9', 9" of the dipole earth wing 9 of the second dipole antenna element 3 are of different lengths, and the wing segments 11', 11" of the dipole signal wing 11 of the second dipole antenna element 3 are preferably likewise of different lengths.

Due to a similar length of the wing segments 5', 5", 7', 7", 9', 9", 11', 11", the resonance frequency range of the crossed dipole 1 may be increased, for example. Due to a different length of the wing segments 5', 5", 7', 7", 9', 9", 11', 11", at least one further resonance frequency range may be produced, for example. A continuous range with a return loss of better than 6 dB and preferably better than 10 dB and more preferably better than 14 dB is preferably defined in each case as the resonance frequency range of a crossed dipole 1.

It is additionally conceivable that the wing segments 5', 5" of the dipole earth wing 5 and/or the wing segments 7', 7" of the dipole signal wing 7 of the first dipole antenna element 2 do not run parallel to one another over part of their length or over the majority of their length, but instead are arranged at an angle greater than 10°, 20°, 30°, 40°, 50°, 60°, 70° or 80°. The same may also apply for the wing segments 9', 9" of the dipole earth wing 9 and/or the wing segments 11', 11" of the dipole signal wing 11 of the first dipole antenna element 3. In particular, the wing segments 5', 5", 7', 7", 9', 9", 11', 11" thus also form a square dipole and/or ultra-wideband (UWB) dipole.

It has been found that a simple crossed dipole 1, as described in the paragraphs and figures above, may also demonstrate dual-band behaviour or multi-band behaviour. Due to the co-operation of maximum dipole extent orthogonally to the main body 15 (height of the dipole) and length of the waveguide between the earth connectors 4, 8 and the corresponding signal connectors 6, 10, as well as maximum dipole extent parallel to the main body 15 (length of the wing segments 5, 7, 9, 11), a resonance frequency range of the crossed dipole 1 may be extended and/or at least two resonance frequency ranges may be produced. The height of the crossed dipole 1 and/or the length of the waveguide, which for example may be changed by meandering profiles, thus likewise plays a significant role.

In addition, it has been found that the wing segments 5', 5", 7', 7", 9', 9", 11', 11" may be designed arbitrarily and may be adapted to electrical requirements and production methods.

The individual wing segments 5', 5" of the dipole earth wing 5 of the first dipole antenna element 2 are preferably connected to one another galvanically merely at the first end 5*a* of the dipole earth wing 5 and are arranged mechanically on the earth connector 4 of the first dipole antenna element 2. The same applies likewise for the wing segments 7', 7" of the dipole signal wing 7 of the first dipole antenna element 2. These are likewise preferably connected to one another galvanically only at the first end 7*a* of the dipole signal wing 7 of the first dipole antenna element 2, and in particular are arranged at the first end 6*a* of the signal connector 6 of the first dipole antenna element 2.

The same applies likewise for the second dipole antenna element 3.

It is possible in principle that the dipole signal wing 7 or the dipole earth wing 5 of the first dipole antenna element 2 have a bent portion at their open second ends 7*b* and 5*b* respectively, which are arranged opposite the first ends 7*a* and 5*a*. This portion is bent away from the second end 4*b* of the earth connector 4 and extends preferably away (upwardly) from the at least one main body 15. The height of the dual-polarized crossed dipole 1 is thus increased.

In FIG. 9 the bent portion is arranged on one of the two wing segments 5', 5" and 7', 7", such that the wing segments 5', 5" and 7', 7" in each case are of different lengths.

A bent portion of this kind may likewise be provided in the second dipole antenna element 3. The angle between the bent portion and the rest of the region of the dipole signal wing 7 or dipole earth wing 5 of the first dipole antenna element 2 running in particular parallel to the at least one main body 15 is preferably greater than 90° and less than 180°. The angle is preferably greater than 100°, 110°, 120°, 130°, 140°, 150°, 160°, or 170°, and more preferably less than 165°, 155°, 145°, 135°, 125°, 115°, 105°, or 95°.

The angle is the smallest angle between the bent portion and the remainder of the dipole signal wing 7 or the dipole earth wing 5 of the first dipole antenna element 2. The same applies also for the second dipole antenna element 3.

It is additionally shown in FIG. 9 that the tabs 13*a* of the support face 13 are bent downwardly, that is to say in the direction of the at least one main body 15. These tabs 13*a* may likewise engage in an opening in the at least one main body 15 or even penetrate through such an opening, as has already been described with regard to the second ends 6*b* and 10*b* of the signal connectors 6 and 10.

A first and a second holding device 25, 26 are also shown in FIG. 9. Both holding devices 25, 26 are described in greater detail in respect of FIGS. 11A, 11B and 12. They both consist of a dielectric material. The first holding device 25 is arranged between the earth connector 4 of the first dipole antenna element 2 and the signal connector 6 of the first dipole antenna element 2. The first holding device 25 comprises a plurality of holding means 25*a*, 25*b*, 25*c*, 25*d*, which are both in engagement with the earth connector 4 of the first dipole antenna element 2 and are in engagement with the signal connector 6 of the first dipole antenna element 2 and prevent a displacement of the earth connector 4 and the signal connector 6 relative to one another.

The same applies also for the second holding device 26. This also comprises a plurality of holding means 26*a*, 26*b*, 26*c* and 26*d*. The second holding device 26 is arranged here between the earth connector 8 of the second dipole antenna element 3 and the signal connector 10 of the second dipole antenna element 3.

In principle it would also be possible for both holding devices 25, 26 to be formed from a single, that is to say common, (plastics injection-moulded) part.

FIG. 12 shows that the first holding device 25 comprises a central body 27, which has a front side and rear side. Holding means 25*a*, 25*b* are provided one on said front side and one on said rear side and are in the form of a locking pin. The locking pins protrude from the central body 27 and each dip into an opening in the earth connector 4 and in the signal connector 6 of the first dipole antenna element 2, whereby a displacement along a longitudinal axis, which runs through the dual-polarized crossed dipole 1, is prevented. These locking pins may also comprise a latching means, such that removal of the earth connector 4 and/or the signal connector 6 is hindered or prevented.

Other holding means 25C, 25D in the form of locking fingers are additionally also arranged on the front side and rear side and protrude from the central body 27 and the direction of the earth connector 4 and the signal connector 6. These locking fingers engage both the earth connector 4 of the first dipole antenna element 2 and the signal connector 6 of the first dipole antenna element 2 from behind, whereby the distance between the earth connector 4 and the signal connector 6 is prevented from becoming larger. The locking fingers are preferably formed resiliently, at least in part.

The same details apply also for the second holding device 26, which likewise has a central body 28. Here as well there are holding means 26*a*, 26*b* in the form of a locking pin and a plurality of holding means 26*c*, 26*d* in the form of locking fingers, which are used to fasten the earth connector 8 to the signal connector 10 of the second dipole antenna element 3. The structure of the second holding device 26 corresponds to that of the first holding device 25.

Figure 15A:
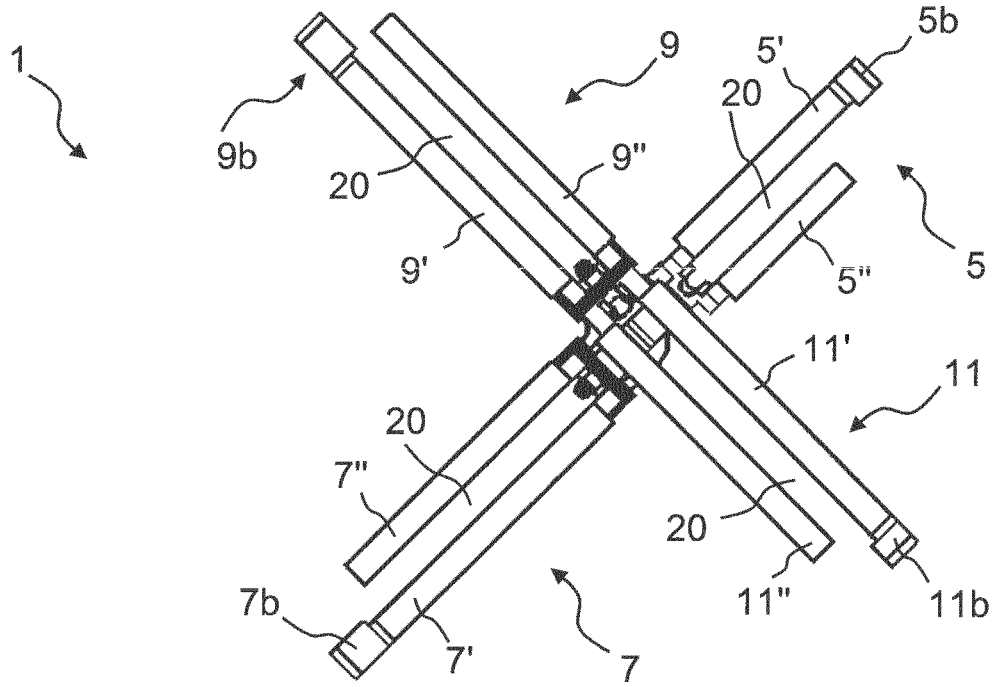
Figure 15B:
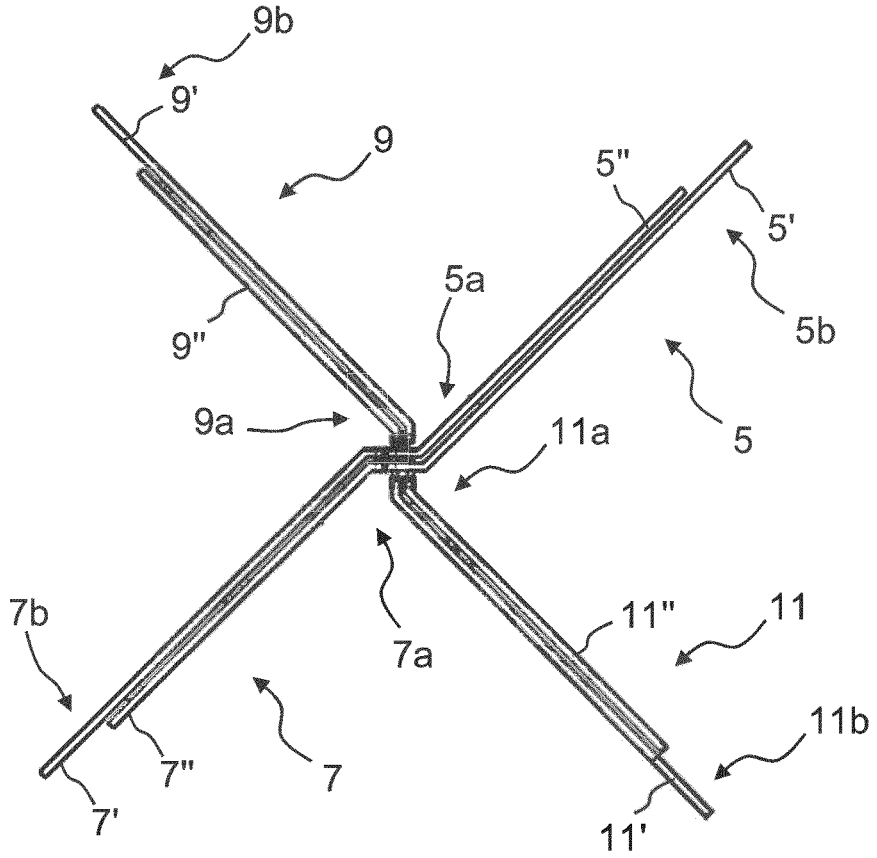
Figure 15C:
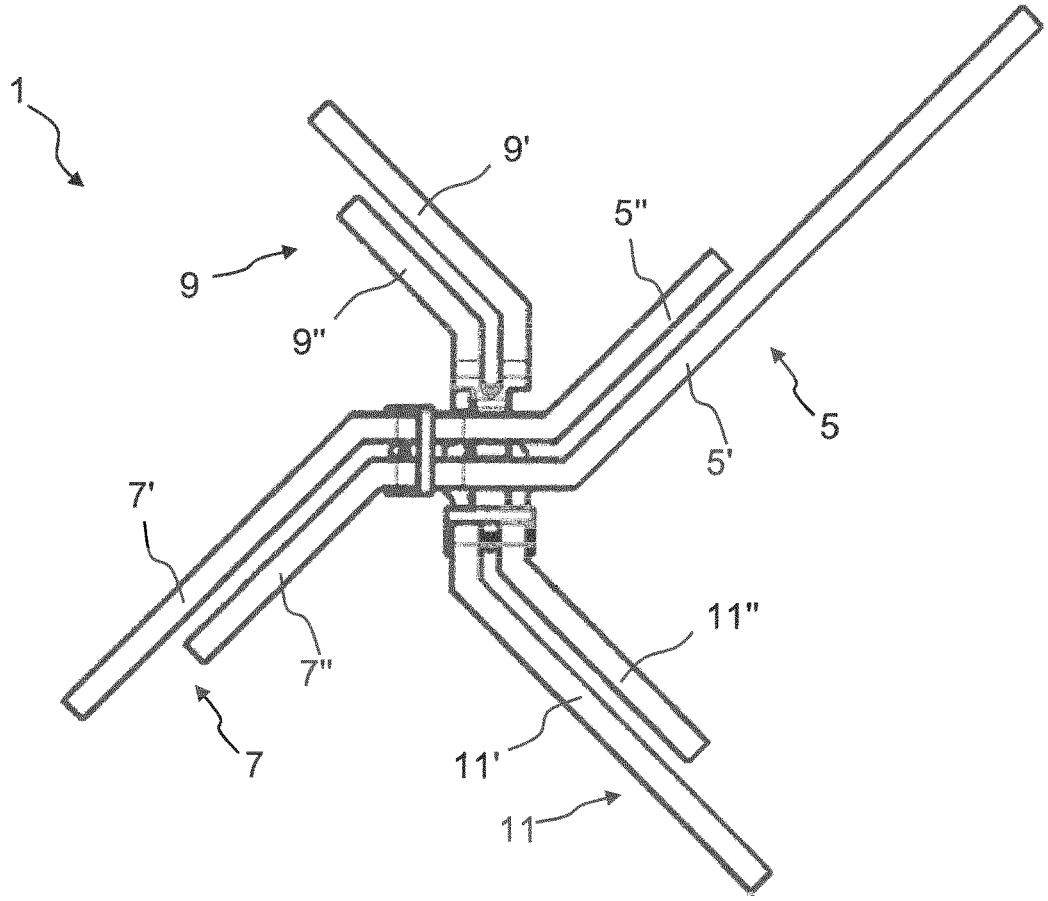

Further exemplary embodiments of the crossed dipole 1 according to the invention are shown in FIGS. 15A to 15C and are based on the fourth exemplary embodiment of the crossed dipole 1 according to FIG. 9.

In FIG. 15A the dipole earth wing 5 and the dipole signal wing 7 of the first dipole antenna element 2 is divided over the majority of its longitudinal extent or along its entire length by a separating slot 20 into two wing segments 5', 5" and 7', 7" running in each case at a distance from one another. These wing segments 5', 5" and 7', 7" run at a distance from one another, that is to say galvanically isolated from one another. Here, the wing segments 5', 5" of the dipole earth wing 5 are of different lengths. The same applies also for the wing segments 7', 7" of the dipole signal wing 7 of the first dipole antenna element 2. The same applies also for the wing segments 9', 9" of the dipole earth wing 9 and the wing segments 11', 11" of the dipole signal wing 11 of the second dipole antenna element 3.

The wing segments 5', 9' of both dipole earth wings 5, 9 of the dipole antenna elements 2, 3 are inclined towards their open ends 5*b*, 9*b*, whereby the overall height of the crossed dipole 1 increases. The inclination is provided preferably further away from the support base 13 of the crossed dipole 1 (rising inclination). The inclination could also run in the direction of the support base 13 of the crossed dipole 1 (falling inclination), that is to say in the direction of a reflector (not shown) or main body 15. The inclination is approximately 90° in FIG. 15A. A deviation from 90° of less than 40°, 30°, 20°, 15°, 10°, or 5° is also possible. The same is also true for the wing segments 7' and 11' of the dipole signal wings 7 and 11 of both dipole antenna elements 2, 3.

In FIGS. 15B and 15C the at least one wing segment 5', 5", 7', 7" or all wing segments 5', 5", 7', 7" of the dipole earth wing 5 and/or of the dipole signal wing 7 of the first dipole antenna element 2 is/are divided into at least two portions running at an angle to one another, wherein the portions preferably lie in a common plane. In FIGS. 15B and 15C the individual portions of the wing segments 5', 5" run parallel to one another. The same applies also to the portions of the wing segments 7', 7". The same applies also to the wing segments 9', 9", 11', 11" of the dipole earth wing 9 and the dipole signal wing 11 of the second dipole antenna element 3.

The individual wing segments 5', 5", 7', 7" of the dipole earth wing 5 and of the dipole signal wing 7 of the first dipole antenna element 2 may have completely different lengths. The same applies also for the wing segments 9', 9", 11', 11" of the dipole earth wing 9 and the dipole signal wing 11 of the second dipole antenna element 3.

The cross-sectional shape of at least one wing segment 5', 5", 7', 7" of the dipole earth wing 5 and/or the dipole signal wing 7 of the first dipole antenna element 2 is constant over the length of the wing segment 5', 5", 7', 7". It could also change. The same applies also for the wing segments 9', 9", 11', 11" of the dipole earth wing 9 and the dipole signal wing 11 of the second dipole antenna element 3.

Figure 15D:
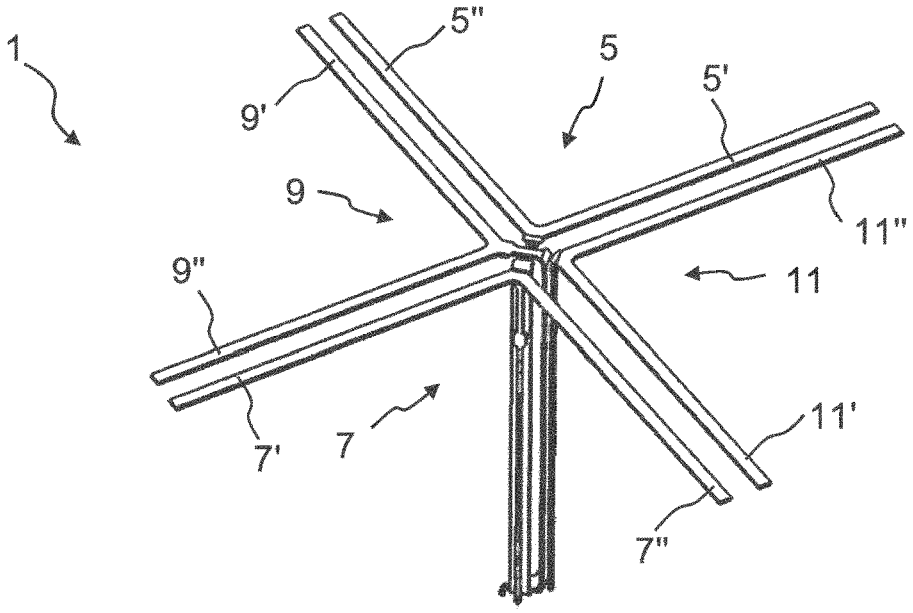
Figure 15E:
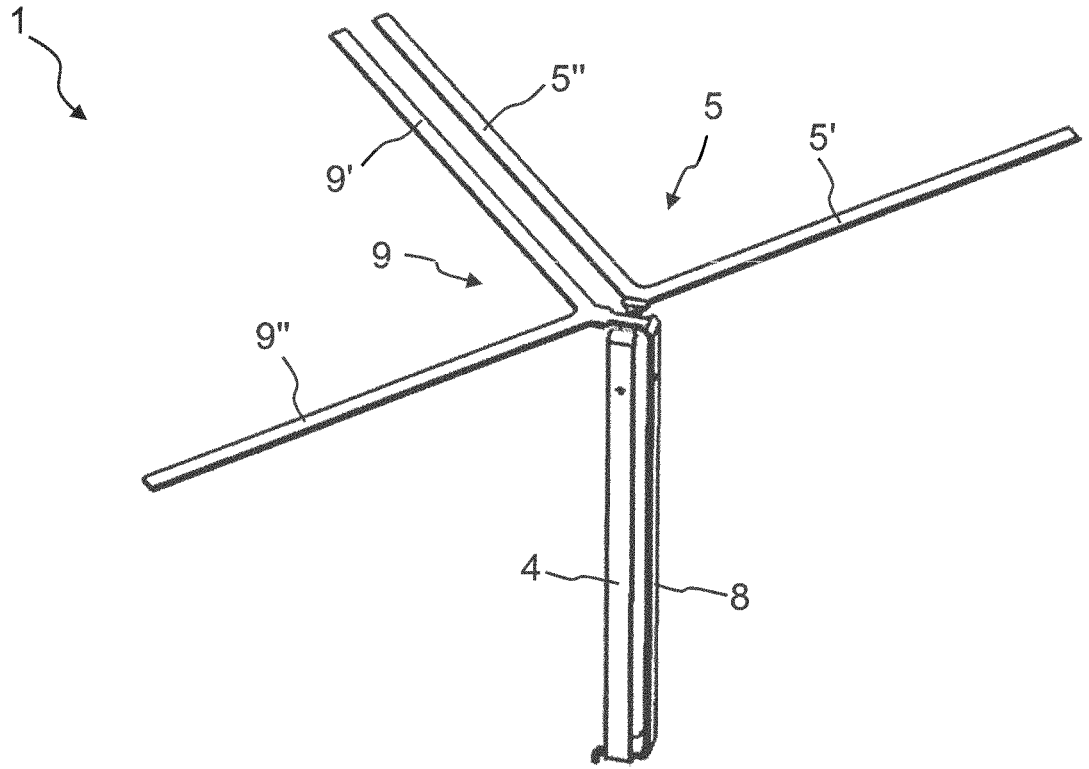
Figure 15F:
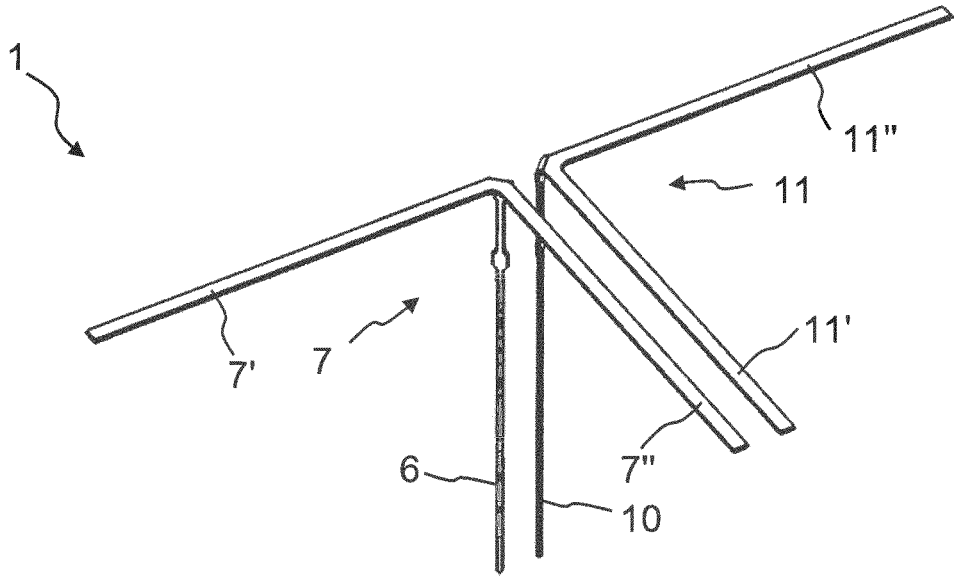

A further exemplary embodiment of the crossed dipole 1 is shown in FIGS. 15D, 15E, and 15F. The wing segments 5', 5" of the dipole earth wing 5 of the first dipole antenna element 2 run at an angle of, in particular, 90° (and less than ±10° or ±5°) away from one another. The same applies also for the wing segments 7', 7" of the dipole signal wing 7 of the first dipole antenna element 2. The same details apply also for the wing segments 9', 9" of the dipole earth wing 9 of the second dipole antenna element 3 and for the wing segments 11', 11" of the dipole signal wing 11 of the second dipole antenna element 3.

A further exemplary embodiment of the crossed dipole 1 is shown in FIGS. 16A to 16C. Here as well the dipole earth wings 5, 9 of both dipole antenna elements 2, 3 also again comprise two wing segments 5', 5" and 9', 9" respectively. The same applies also for the dipole signal wings 7, 11 of both dipole antenna elements 2, 3. In this exemplary embodiment, however, there are also connection portions 40. These galvanically connect the open ends 7*b* of the wing segments 7', 7" of the dipole signal wing 7 of the first dipole antenna element 2. The same applies also for the wing segments 11', 11" of the dipole signal wing 11 of the second dipole antenna element 3. The connection portions 40 optionally also protrude beyond at least one wing segment 7', 7", 11', 11", as is shown for example in FIG. 16A. The term "galvanically connect" may also be understood to mean a short-circuiting.

Alternatively or additionally, this may apply also for the wing segments 5', 5" of the dipole earth wing 5 of the first dipole antenna element 2 and the wing segments 9', 9" of the dipole earth wing 9 of the second dipole antenna element 3.

It is also illustrated that the open end 5*b* of the wing segment 5' of the dipole earth wing 5 of the first dipole antenna element 2 comprises an L-shaped extension, wherein this L-shaped extension is arranged in the same plane as the majority of the wing segment 5' of the dipole earth wing 5. The same applies also for the open end 9*b* of the wing segment 9' of the dipole earth wing 9 of the second dipole antenna element 3. This could apply also for the open end 7*b* of the wing segment 7' of the dipole signal wing 7 of the first dipole antenna element 2 and for the open end 11*b* of the wing segment 11' of the dipole signal wing 11 of the second dipole antenna element 11. Instead of an L-shaped extension, a T-shaped extension or an, in particular, conical widening in the direction of the open end 5*b*, 9*b*, 7*b*, 11 *b* is also conceivable.

In FIG. 16C it is also shown that a first segment $\mathbf{9}_1$ of a wing segment 9' of the dipole earth wing 9 of the second dipole antenna element 3, which connects to the first end 8*a* of the earth connector 8 of the second dipole antenna element 3, is arranged at a further distance from the second end 8*b* of the earth connector 8 than the first end 8*a* of the earth connector 8, whereby the dipole earth wing 9 of the second dipole antenna element 3 has a U-shaped profile, which is open in the direction of a reflector (not shown), over a partial length. The same applies also for the second wing segment 9". This may of course also apply for the dipole earth wing 9 itself, if this is not divided into two wing segments 9', 9". The same may apply also for the dipole earth wing 5 of the first dipole antenna element 2 and/or the dipole signal wing 7 of the first dipole antenna element 2. This may apply also for the dipole signal wing 11 of the second dipole antenna element 3.

In FIGS. 16A to 16C it is true that the dipole earth wing 9 of the second dipole antenna element 3 passes through beneath the dipole earth wing 5 of the first dipole antenna element 2. In this case the earth connectors 4, 8 of both dipole antenna elements 2, 3 are arranged closer to the centre of the crossed dipole 1 than the two signal connectors 6, 10. If the dipole earth wings 5, 9 cross, this has the advantage that the second dipole halves 2*b*, 3*b* of both dipole antenna elements 2, 3 may be assembled more easily because they are fastened to the corresponding holding device 25, 26 (for example clipped on or clicked on) merely coming from the outside.

In FIG. 17A it is shown that the dipole signal wing 7 and the dipole earth wing 5 of the first dipole antenna element 2 are T-shaped at their open second ends 7*b*, 5*b*. The second ends 7*b*, 5*b* are arranged opposite the first ends 7*a*, 5*a*, which are connected to the signal connector 6 and the earth connector 4 of the first dipole antenna element 2. Instead of a T-shaped design, they could also be L-shaped. The same may apply also for the dipole signal wing 11 and the dipole earth wing 9 of the second dipole antenna element 3.

In FIG. 17B it is shown that the dipole signal wing 7 and the dipole earth wing 5 of the first dipole antenna element 2 have a widening at their open second ends 7*b*, 5*b*. This widening is triangular or conical in plan view. The second ends 7*b*, 5*b* are preferably more than twice as wide as the first ends 7*a*, 5*a*. The widening runs preferably over less than 60%, 50%, 40%, 30%, or 20% of the length of the dipole signal wing 7 and the dipole earth wing 5 of the first dipole antenna element 2. The widening runs in a linear or stepped manner. The same may apply also for the dipole signal wing 11 and the dipole earth wing 9 of the second dipole antenna element 3.

In the crossed dipole 1 in FIGS. 16A and 16B, a higher bandwidth may be attained with the same dimensions in comparison to a crossed dipole 1 of which the second ends 5*b*, 7*b*, 9*b*, 11 *b* are unchanged (for example FIG. 1A). Should the bandwidth be the same, a more compact design is then possible with the crossed dipole 1 in FIGS. 16A and 16B.

In FIG. 19A it is shown that the dipole earth wing 9 of the second dipole antenna element 3 passes through beneath the dipole earth wing 5 of the first dipole antenna element 2. In this case the earth connectors 4, 8 of both dipole antenna elements 2, 3 are arranged closer to the centre of the crossed dipole 1 than the two signal connectors 6, 10. If the dipole earth wings 5, 9 cross, this has the advantage that the second dipole halves 2*b*, 3*b* of both dipole antenna elements 2, 3 may be assembled more easily, because they are fastened to the corresponding holding device 25, 26 (for example clipped on or clicked on) merely coming from the outside. The signal connectors 6, 10 have a different width, and therefore the holding devices 25, 26, which engage around (clip around) the signal connectors 6, 10 in a thinner region (thinner width) by means of their holding means 25*c*, 25*d*, 26*c*, 26*d*, may not shift in the direction of a thicker region (thicker width).

FIG. 19B shows again how the dipole earth wing 9 of the second dipole antenna element 3 passes through beneath the dipole earth wing 5 of the first dipole antenna element 2. In FIG. 19B the first dipole halves 2*a*, 3*a* of both dipole antenna elements 2, 3 are shown and consist of a common metal part.

FIG. 19C shows a structure of the second dipole halves 2*b*, 3*b* of both dipole antenna elements 2, 3. These are structured identically (same dimensions), and therefore the production is simplified.

It is true for the crossed dipole 1 in FIGS. 19A, 19B, 19C that assembly is easier because only two different metal parts are necessary. A first metal part comprises the first dipole halves 2*a*, 3*a* of both dipole antenna elements 2, 3, and a second metal part comprises a second dipole half 2*b*, 3*b* of the dipole antenna elements 2, 3. The assembly is therefore also simpler because two identical metal parts (second dipole halves 2*b*, 3*b*) are clicked from the outside onto the first dipole halves 2*a*, 3*a* of single-part design. There is no danger of confusion.

FIGS. 20A to 20C show a fifth exemplary embodiment of the crossed dipole 1 according to the invention. According to FIG. 20C the signal connector 6 of the first dipole antenna element 2 and the signal connector 10 of the second dipole antenna element 3 are electrically conductively connected to one another or short-circuited at their first end 6*a*, 10*a* and on the whole are of single-part design. The assembly is thus facilitated because few individual parts are necessary. However, the electrical values are worse. In particular, the insulation values at the feed point, that is to say at the second ends 6*b*, 10*b* of the signal connectors 6, 10 are worse (>10 dB, >15 dB and <20 dB). However, the insulation values are usually still sufficient for applications such as massive MIMO and/or small cell and/or automotive applications.

In this case the first dipole halves 2*a*, 3*a* and the second dipole halves 2*b*, 3*b* consist precisely of one metal part.

Here, a dipole signal wing 7, 11 or a dipole earth wing 5, 9 of the first or second dipole antenna element 2, 3 does not pass through beneath another dipole signal wing 7, 11 or a dipole earth wing 5, 9.

FIG. 20B shows that the first dipole halves 2*a*, 3*a* of both dipole antenna elements 2, 3 with their earth connectors 4, 8 in the region of the second ends 4*b*, 8*b* of the earth connectors 4, 8 have, in cross-section, an L shape or a C shape or comprise two segments running at an angle. There is no foot 13 here. The earth connectors 4, 8 are inserted preferably into a main body in the region of the second ends 4*b*, 8*b*.

In FIG. 20A at least one holding device 25 is shown, which comprises a dielectric material or consists of such material. The at least one holding device 25 is formed as a sliding holder, which comprises a central body, which is penetrated by a plurality of receiving slots, wherein the earth connectors 4, 8 and the signal connectors 6, 10 are slidable or slid into these receiving slots starting with their second ends 6*b*, 10*b*, 4*b*, 8*b*. The sliding holder is displaceable at least along a partial length of the earth connectors 4, 8 and the signal connectors 6, 10. The at least one holding device 25 could alternatively also be formed as an overmoulded part which is formed by an overmoulding of the earth connectors 4, 8 and the signal connectors 6, 10 with a plastics material.

FIGS. 21A to 21C show a further exemplary embodiment of the crossed dipole 1 according to the invention. In this exemplary embodiment the dipole earth wing 5 of the first dipole antenna element 2 passes through beneath the dipole signal wing 11 of the second dipole antenna element 3. In this case the dipole earth wings 5, 9 of both dipole antenna elements 2, 3 are arranged at different distances from the centre of the crossed dipole 1. The same applies also for the dipole signal wings 7, 11 of both dipole antenna elements 2, 3. The signal connectors 6, 10 of both dipole antenna elements 2, 3 are fastened to different sides (one on the outer side and one on the inner side) of the corresponding earth connectors 4, 8 of the dipole antenna elements 2, 3.

In FIG. 21C it is shown that the second dipole halves 2*b*, 3*b* of both dipole antenna elements 2, 3 are constructed identically or practically identically to one another. The two second dipole halves 2*b*, 3*b* of both dipole antenna elements 2, 3 may be manufactured in particular using the same tool and by means of the same production method, whereby cost-effective production is possible.

The first dipole halves 2*a*, 3*a* of both dipole antenna elements 2, 3 are again of single-part design (FIG. 21B) and consist in particular of precisely one first metal part. The dual-polarized crossed dipole 1 additionally comprises precisely two second metal parts, which are preferably constructed identically to one another, wherein each of the second dipole halves 2*b*, 3*b* of both dipole antenna elements 2, 3 is formed of a second metal part of this kind. In this case the crossed dipole 1 consists of only (precisely) two different metal parts. It is also possible that it consists of (precisely) three different metal parts. This would apply if the second dipole halves 2*b*, 3*b* of both dipole antenna elements 2, 3 were to consist of different metal parts.

The crossed dipole 1 may comprise each of the shown holding devices 25 (click holder, sliding holder, overmoulding, etc.).

In this regard it is also mentioned that the dipole signal wing 11 of the second dipole antenna element 3 could also pass through beneath the dipole earth wing 5 of the first dipole antenna element 2.

FIG. 14 shows a three-dimensional illustration of the antenna arrangement 30 according to the invention, which has at least two dual-polarized crossed dipoles 1*a*, 1*b*.

In principle, the antenna arrangement 1 could also have just one dual-polarized crossed dipole 1.

The antenna arrangement 30 comprises at least one main body 15. The first and the at least one second dual-polarized crossed dipole 1*a*, 1*b* are arranged on this at least one main body 15. A second end 6*b* of the signal connector 6 of the first dipole antenna element 2 of the first dual-polarized crossed dipole 1*a* is connected galvanically via a first connection 31 to a second end 6*b* of the signal connector 6 of the first dipole antenna element 2 of the second dual-polarized crossed dipole 1*b*. Conversely, a second end 10*b* of the signal connector 10 of the first dipole antenna element 2 of the first dual-polarized crossed dipole 1*a* is connected galvanically via a second connection 32 to a second end 10*b* of the signal connector 10 of the second dipole antenna element 3 of the second dual-polarized crossed dipole 1*b*. Both connections 32 are galvanically isolated.

A first high-frequency signal is couplable into or out from the first connection 31, whereas a second high-frequency signal is couplable into or out from the second connection 32.

The second end 4*b* of the earth connector 4 of the first dipole antenna element 2 of the first and second dual-polarized crossed dipole 1*a*, 1*b* is connected galvanically or conductively or inductively to a signal earth of the first high-frequency signal and/or to an earth of the at least one main body 15. Conversely, the second end 8*b* of the earth connector 8 of the second dipole antenna element 3 of the first and second dual-polarized crossed dipole 1*a*, 1 *b* is connected galvanically or capacitively or inductively to a signal earth of the second high-frequency signal and/or to an earth of the at least one main body 15.

The first and/or second high-frequency signal is coupled in preferably in the centre of the first connection 31 or the second connection 32.

A further exemplary embodiment of the antenna arrangement 30 according to the invention which has at least two dual-polarized crossed dipoles 1*a*, 1*b* is described in FIGS. 22A, 22B and 22C.

The signal connector 6 of the first dipole antenna element 2 of the first dual-polarized crossed dipole 1, 1*a* and the signal connector 6 of the first dipole antenna element 2 of the second dual-polarized crossed dipole 1, 1*b* are formed together with their first connection 31 in a single part from a common bent and/or stamped and/or laser and/or angled part. They are single bodies.

The same applies also for the signal connector 10 of the second dipole antenna element 3. The signal connector 10 of the second dipole antenna element 3 of the first dual-polarized crossed dipole 1, 1*a* and the signal connector 10 of the second dipole antenna element 3 of the second dual-polarized crossed dipole 1, 1*b* are formed together with their second connection 32 in a single part from a common bent and/or stamped and/or laser and/or angle part. They are single bodies.

The feed is provided as already described.

The earth connectors 4, 8 of both dipole antenna elements 2, 3 of the first dual-polarized crossed dipole 1, 1*a* and the earth connectors 4, 8 of both dipole antenna elements 2, 3 of the second dual-polarized crossed dipole 1, 1*b* are connected galvanically to one another via a third connection 33 and together with this third connection 33 are formed in a single part from a common bent and/or stamped and/or laser and/or angled part. They are single bodies.

The most important points of the dual-polarized crossed dipole 1 will be briefly presented again separately hereinafter. The particular signal connector 6 or 10 is fed exclusively at its second end 6*b* or 10*b* respectively. The earth connection to the earth connectors 4 and 8 is also achieved exclusively at the second end 4*b*, 8*b* of said connectors respectively. The term "end" is understood to mean a length of less than 30% or 20% or 10% or 5% of the total length.

The dual-polarized crossed dipole 1 is wireless. This means that no connection cables extend from the second ends 4*b*, 6*b*, 8*b*, 10*b* of the earth connectors 4 or 8 or the signal connectors 6 or 10 in the direction of the corresponding dipole signal wing 7 or 11 or in the direction of the dipole earth wing 5 or 9.

The dual-polarized crossed dipole 1 is additionally free from any additional soldered electrical connection pieces (for example additional connection plates), which connect different parts of a dipole half 2*a*, 2*b* or 3*a*, 3*b* electrically conductively to other parts of another or the same dipole half 2*a*, 2*b* or 3*a*, 3*b*. Each dipole half 2*a*, 2*b* or 3*a*, 3*b* is of single-part design. In principle, the first dipole halves 2*a* and 3*a* of the first and second dipole antenna element 2, 3 may be formed jointly from a single-part (sheet-metal) part. A single-part design does not include two different elements joined together by means of a soldered connection.

The structure is significantly simplified as a result of these features. The dual-polarized crossed dipole 1 is embodied here in particular without solder points. The only solder points are used for the connection of the second ends 4*b*, 8*b* and 6*b*, 10*b* to the corresponding signal earth and reference earth respectively or to the corresponding first and second high-frequency signal respectively.

By means of such a structure, very high insulation values of at least −20 dB, −30 dB, or −40 dB are achieved at the foot (base 13) of the crossed dipole 1. In group arrangements, further degrees of freedom in respect of the decoupling between different dipole antenna elements 2, 3 are additionally made possible, since the electrical phase centre and the mechanical centre run through different regions.

The dual-polarized crossed dipole 1, in plan view, may have dimensions of $\lambda/2\times\lambda/2$, whereas a distance between the dipole signal wings 7, 11 or the dipole earth wings 5, 9 and the at least one main body 15 is approximately $\lambda/4$. The wording "approximately" shall be understood to mean that deviations of preferably less than ±25%, 10%, or 5% are also included. The at least one main body 15 for example has a size of $\lambda\times\lambda$. Here, $\lambda$ preferably denotes the centre frequency at which the crossed dipole 1 is operated.

Figure 18A:
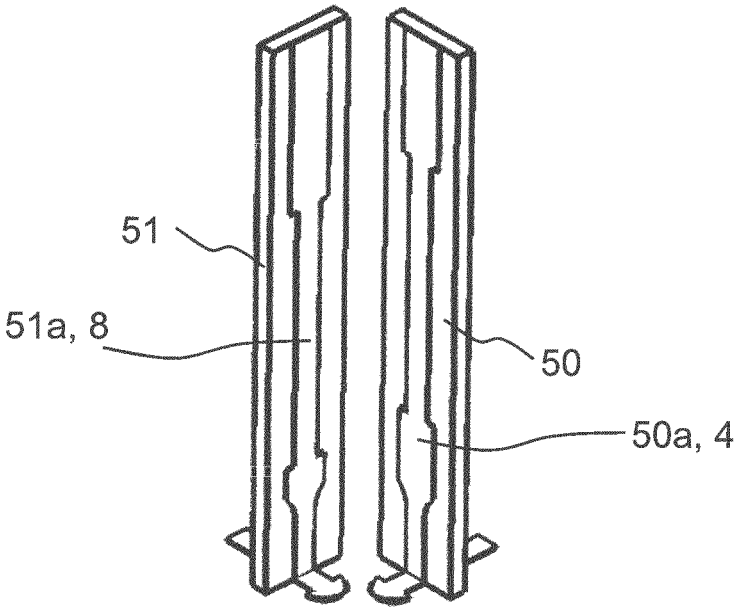

In FIG. 18A it is shown that the crossed dipole 1 is constructed from printed circuit boards 50, 51, 52. The earth connector 4 of the first dipole antenna element 2 and the signal connector 6 of the first dipole antenna element 2 may also be formed as conductor tracks 50*a* on different, opposite sides of a first printed circuit board 50. In particular, the conductor tracks 50*a* are copper areas which are arranged on a dielectric and are separated from one another by the dielectric.

The earth connector 8 of the second dipole antenna element 3 and the signal connector 10 of the second dipole antenna element 3 may also be formed as conductor tracks 51*a* on different, opposite sides of a second printed circuit board 51.

The dipole earth wing 5 and the dipole signal wing 7 of the first dipole antenna element 2 may be formed as conductor tracks 52*a*, 52*b* on a first side 52' of a third printed circuit board 52. In this exemplary embodiment the dipole earth wing 9 and the dipole signal wing 11 of the second dipole antenna element 3 are also formed as conductor tracks 52*c*, 52*d* on the first side 52' of the third printed circuit board 52.

It is also possible, however, for the dipole earth wing 9 and the dipole signal wing 11 of the second dipole antenna element 3 to be formed as conductor tracks 52*c*, 52*d* on a second side 52" of the third printed circuit board 52.

The first printed circuit board 50 runs perpendicularly to the third printed circuit board 52. The second printed circuit board 51 runs perpendicularly to the third printed circuit board 52. The first printed circuit board 50 is soldered or electromagnetically coupled to the third printed circuit board 52, in particular on the first side 52' of the third printed circuit board 52, such that the earth connector 4 of the first dipole antenna element 2 is connected galvanically or inductively or capacitively to the dipole earth wing 5 of the first dipole antenna element 2, and such that the signal connector 6 of the first dipole antenna element 2 is connected galvanically or inductively or capacitively to the dipole signal wing 7 of the first dipole antenna element 2.

The second printed circuit board 51 is soldered or electromagnetically coupled to the third printed circuit board 52, in particular on the second side 52" of the third printed circuit board 52, such that the earth connector 8 of the second dipole antenna element 3 is connected galvanically or inductively or capacitively to the dipole earth wing 9 of the second dipole antenna element 3, and such that the signal connector 10 of the second dipole antenna element 3 is connected galvanically or inductively or capacitively to the dipole signal wing 11 of the second dipole antenna element 3.

Figure 18B:
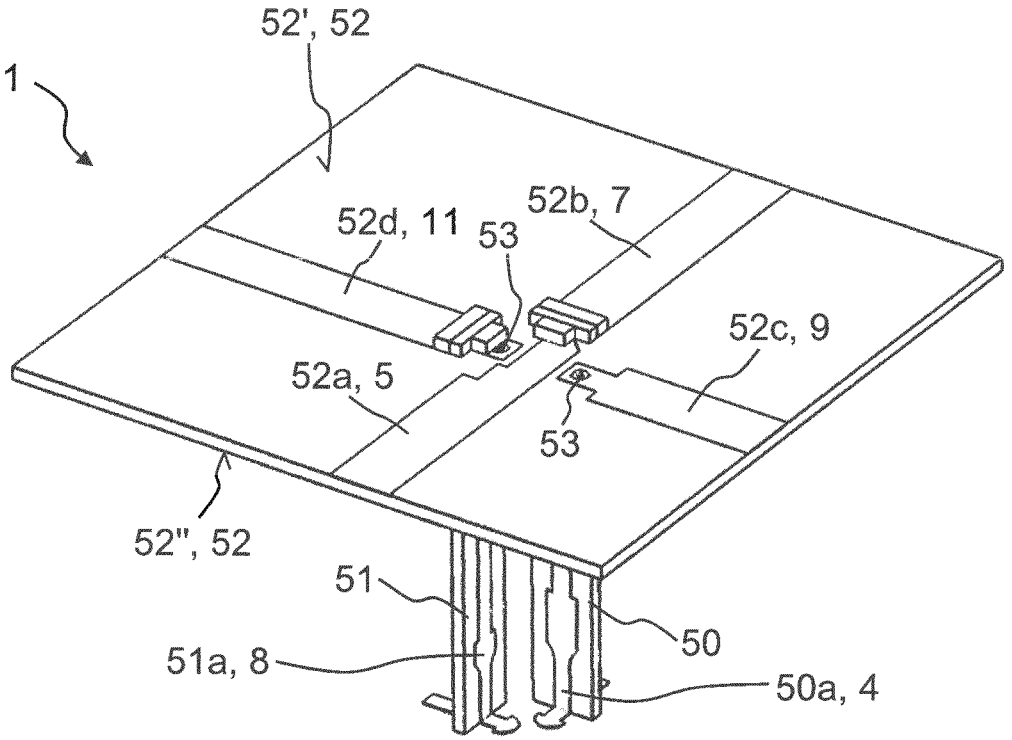

The second printed circuit board 51, as shown in FIG. 18B, could also be soldered or electromagnetically coupled to the third printed circuit board 52 on the first side 52' thereof.

It can be seen from FIG. 18B that the dipole earth wing 9 of the second dipole antenna element 3 passes through beneath the dipole earth wing 5 of the first dipole antenna element 2. This may be achieved for example in that, for example, the dipole earth wing 9 runs on the second side 52" of the third printed circuit board 52 in the region of overlap with the dipole earth wing 5, whereas the dipole earth wing 5 runs on the first side 52' of the third printed circuit board 52. By contrast, in FIG. 18B, the conductor tracks 52*a*, 52*c* of the dipole earth wings 5, 9 of both dipole antenna elements 2, 3 and the conductor tracks 52*b*, 52*d* of the dipole signal wings 7, 11 of both dipole antenna elements 2, 3 are soldered to the corresponding conductor tracks 50*a*, 51*a* of the earth connectors 4, 8 and the signal connectors 6, 10 of both dipole antenna elements 2, 3 on one side 52', 52" of the third printed circuit board 52, in particular on the first side 52'. The conductor track 52*c* of the dipole earth wing 9 of the second dipole antenna element 3 is guided to the opposite side 52", 52' of the third printed circuit board 52 by means of plated through-holes 53. In this case the conductor track 52*c* of the dipole earth wing 9 of the second dipole antenna element 3 changes from the first side 52' to the second side 52" of the third printed circuit board 52 (it may change back again later). In this region the conductor track 52*a* of the dipole earth wing 5 of the first dipole antenna element 2 also runs on the first side 52' of the third printed circuit board 52. The conductor track 52*c* of the dipole earth wing 9 of the second dipole antenna element 3 passes through beneath the conductor track 52*a* of the dipole earth wing 5 of the first dipole antenna element 2. This detail is shown again separately in FIG. 18C.

The third printed circuit board 52 preferably has engagement openings, through which the first and the second printed circuit board 50, 51 may be inserted. A higher stability of the crossed dipole 1 is thus also achieved.

Figure 18C:
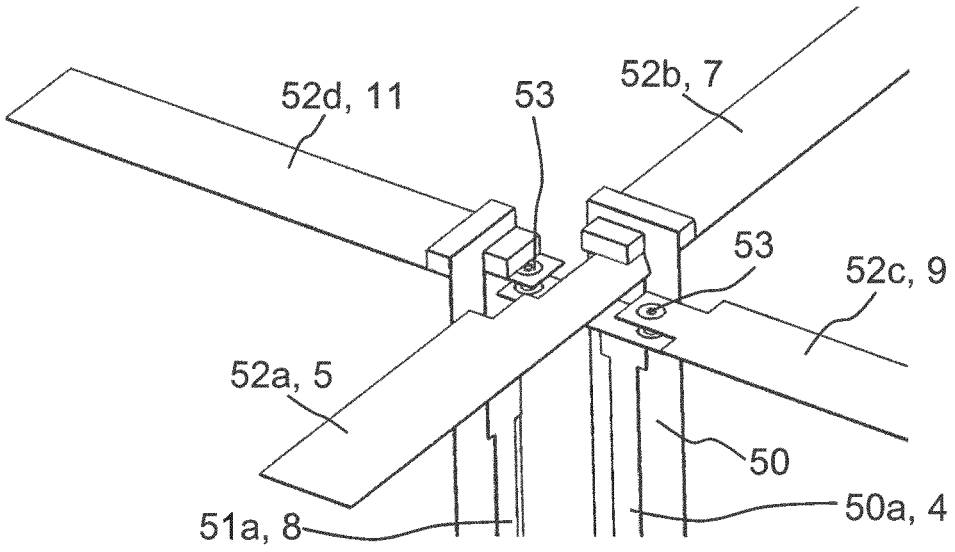
Figure 18D:
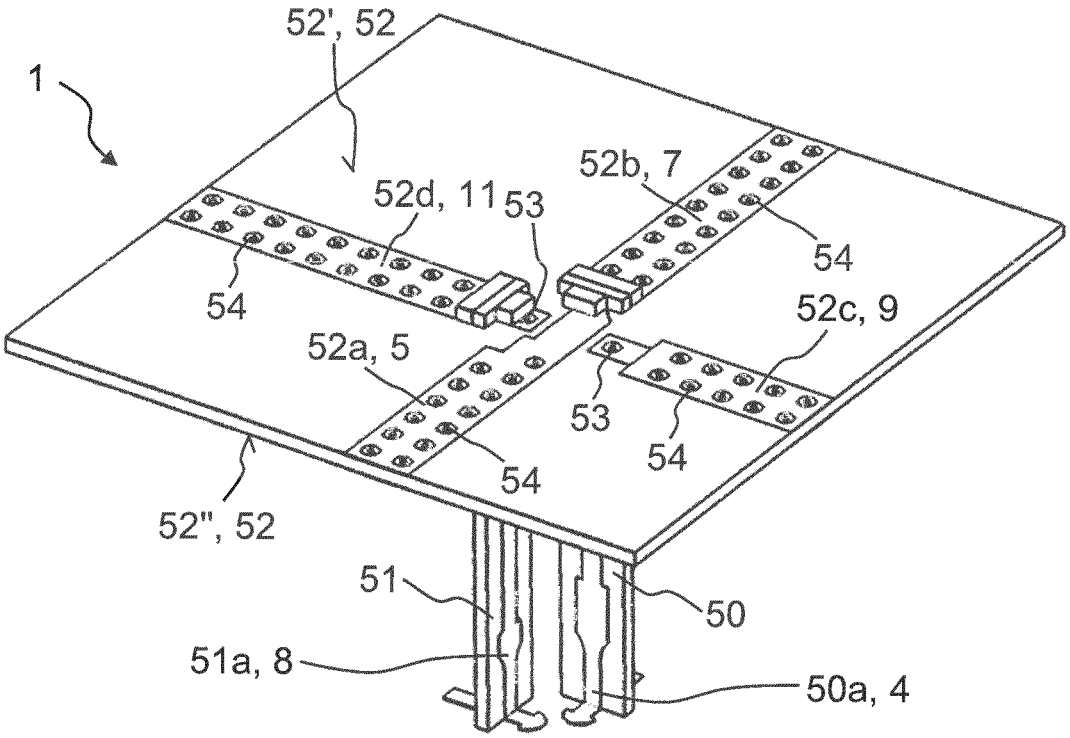

A further exemplary embodiment of the crossed dipole 1 from FIGS. 18A to 18C is shown in FIG. 18D. In this case the dipole earth wing 5 of the first dipole antenna element 2 runs at least over a partial length on both sides 52', 52" of the third printed circuit board 52. A plurality of further plated through-holes 54 connects the two conductor tracks 52*a* of the dipole earth wing 5 of the first dipole antenna element 2 to one another. The same applies also the dipole earth wing 9 of the second dipole antenna element 3 and the dipole signal wings 7, 11 of both dipole antenna elements 2, 3.

All of the above-mentioned embodiments would apply also for the arrangement with the printed circuit boards.

Another antenna arrangement 30, which comprises a plurality of further crossed dipoles 1, is described in FIG. 23. The further crossed dipoles 1 may be constructed in accordance with one of the previous examples. The further crossed dipoles 1 are arranged adjacently in at least two columns 60 and also one above the other in the columns 60. Eight columns 60 are shown in this exemplary embodiment. A plurality of further crossed dipoles 1 are arranged in each column 60. In this case eight further crossed dipoles 1 are arranged in each column 60. Arranged in each column 60 there are preferably as many further crossed dipoles 1 as there are columns 60. In this case the further crossed dipoles 1 are arranged in a chequerboard pattern (in columns 60 and rows 61). Besides eight columns 60 there are also eight rows 61 here. The number, however, may vary arbitrarily. There may be more columns 60 than rows 61 or more rows 61 than columns 60.

In the assembled position of the internal arrangement 30, the further crossed dipoles 1 are arranged vertically (one above the other) in a column 60, and the further crossed dipoles 1 are arranged horizontally (adjacently) in a row 61.

A distance of a further crossed dipole 1 within a first column 60 from its adjacent further crossed dipole 1 in the same column 60 preferably corresponds to the distance of a further crossed dipole 1 in another column 60 from its adjacent further crossed dipole 1 in the same, other column 60. All further crossed dipoles 1 in each column 60 are preferably arranged at the same distance from their neighbour. The same applies preferably also for the further crossed dipoles 1 in the various rows 61.

The arrangement of these further crossed dipoles 1 allows a MIMO operation of the antenna arrangement 30. The further crossed dipoles 1 are preferably oriented identically with respect to their dipole signal wings 7, 11 and the dipole earth wings 5, 9. In particular, the dipole signal wings 7, 11 and the dipole earth wings 5, 9 are rotated through approximately 45° relative to the columns 60 (vertical axis of the antenna arrangement 30) or relative to the rows 61 (horizontal axis of the antenna arrangement 30). A distance of the dipole signal wings 7, 11 and the dipole earth wings 5, 9 of the individual further crossed dipoles 1 from the main body 15 is preferably the same.

The shown further crossed dipoles 1 are designed in particular to be operated in a first frequency range (for example high-band).

There are furthermore also other crossed dipoles 62, which may be structured likewise in accordance with one of the previous examples. These other crossed dipoles 62 operate in a second frequency range (for example low-band). The second frequency range is lower than the first frequency range. In particular, the centre frequency of the second frequency range is lower than the centre frequency of the first frequency range.

The other crossed dipoles 62 in this case are structured in accordance with the example from FIG. 15D, to which reference is hereby made. The other crossed dipole 62 is larger than the further crossed dipoles 1. It is preferably more than twice as large or three times as large. This applies in particular for the length of the dipole signal wings 7, 11 and the dipole earth wings 5, 9. In the other crossed dipoles 62, they are longer accordingly (more than twice or three times as long) than in the further crossed dipoles 1. In the shown other crossed dipoles 62, this then applies for the individual wing segments 5, 5", 7', 7" of the dipole earth wing 5 and the dipole signal wing 7 of the first dipole antenna element 2 and for the individual wing segments 9', 9", 11', 11" of the dipole earth wing 9 and the dipole signal wing 11 of the second dipole antenna element 3.

The other crossed dipoles 62 are arranged in this exemplary embodiment between two columns 60 and between two rows 61 of the further crossed dipoles 1. Consequently, the other crossed dipoles 62 are arranged both horizontally and vertically offset in relation to the adjacent further crossed dipoles 1.

The individual wing segments 5', 5", 7', 7" of the dipole earth wing 5 and of the dipole signal wing 7 of the first dipole antenna element 2 and the individual wing segments 9', 9", 11', 11" of the dipole earth wing 9 and of the dipole signal wing 11 of the second dipole antenna element 3 of the other crossed dipoles 62 preferably run parallel or perpendicularly to the columns 60 (vertical axis of the antenna arrangement 30) or to the rows 61 (horizontal axis of the antenna arrangement 30).

The individual wing segments 5', 5", 7', 7" of the dipole earth wing 5 and of the dipole signal wing 7 of the first dipole antenna element 2 and the individual wing segments 9', 9", 11', 11" of the dipole earth wing 9 and of the dipole signal wing 11 of the second dipole antenna element 3 of the other crossed dipoles 62 run preferably in a space (between two rows and between two columns) between the further crossed dipoles 1.

A distance between the individual wing segments 5', 5", 7', 7" of the dipole earth wing 5 and of the dipole signal wing 7 of the first dipole antenna element 2 and the individual wing segments 9', 9", 11', 11" of the dipole earth wing 9 and of the dipole signal wing 11 of the second dipole antenna element 3 of the other crossed dipoles 62 from the main body 15 is preferably greater than (or smaller than or equal to) a distance of the dipole signal wings 7, 11 and the dipole earth wings 5, 9 of the further crossed dipoles 1 from the main body 15.

In the event that the antenna arrangement 30 from FIG. 23 does not have any (other) crossed dipoles 62 according to FIG. 15D, but instead crossed dipoles that do not have any wing segments 5', 5", 7', 7" or 9', 9", 11', 11", these other crossed dipoles 62 are rotated in such a way that the dipole signal wings 7, 11 and the dipole earth wings 5, 9 run parallel or perpendicularly to the columns 60 (vertical axis of the antenna arrangement 30) or to the rows 61 (horizontal axis of the antenna arrangement 30).

A distance between two adjacent (both horizontally adjacent and vertically adjacent) other crossed dipoles 62 is greater than a distance between two adjacent further crossed dipoles 1.

In this exemplary embodiment there are two columns with other crossed dipoles 62, wherein two other crossed dipoles 62 are arranged in each column. Consequently, reference may also be made here to two rows. However, there may also be provided more columns and/or rows with other crossed dipoles 62.

The earth connectors 4, 8 of both dipole antenna elements 2, 3 of all further crossed dipoles in a column 60 and/or a row 61 are optionally connected galvanically to one another via a connection and together with this connection are formed in a single part from a common bent and/or stamped and/or laser and/or angled part. The same may apply also for the other crossed dipoles 62.

The same could apply optionally also for the signal connectors 10 of the first dipole antenna elements 2 of the further crossed dipoles 1 at least in one column 60. This could apply also for the other crossed dipoles 62. In this case the first dipole antenna elements 2 would have a common feed.

This could apply optionally also for the signal connectors 10 of the second dipole antenna elements 3 of the further crossed dipoles 1 at least in one column 60. This could apply also for the other crossed dipoles 62. In this case the second dipole antenna elements 3 would have a common feed.

The dual-polarized crossed dipole 1 is preferably free from a balun.

Precisely one signal connector 6, 10 is furthermore preferably provided for each dipole signal wing 7, 11. In this case there are precisely as many signal connectors 6, 10 as dipole signal wings 7, 11. The feed is also provided (exclusively) via these signal connectors 6, 10. The same may also apply for each dipole earth wing 5, 9.

The dipole signal wings 7, 11 are preferably in contact only by means of their precisely one signal connector 6, 10. They could also be in contact additionally with the signal connector 6, 10 of the other dipole antenna element 2, 3. This applies when the signal connectors 6, 10 are of single-part design. This may apply also for the earth connectors 4, 8 and the dipole earth wings 5, 9.

The dipole signal wings 7, 11 are free from further connectors. The same applies also to the dipole earth wings 5, 9. Additional connections for the feed or for contact with an earth are not provided.

The first dipole antenna element 2 and the second dipole antenna element 3 each preferably comprise only precisely one earth connector 4, 8 and only precisely one signal connector 6, 10.

A first end 5*a* of the dipole earth wing 5 is connected only to precisely one further element (first end 4*a* of the earth connector 4). A first end 7*a* of the dipole signal wing 7 is connected only to precisely one further element (first end 6*a* of the signal connector 6). The same is true also for the dipole earth wing 9 and the dipole signal wing 11.

An electrical field between signal connector 6 and the earth connector 4 runs in the same direction as between the dipole earth wing 5 and the dipole signal wing 7.

An electrical field between signal connector 10 and the earth connector 8 runs in the same direction as between the dipole earth wing 9 and the dipole signal wing 11.

The invention is not limited to the described exemplary embodiments. All described and/or denoted features are combinable arbitrarily with one another within the scope of the invention.

The invention claimed is:

1. A dual-polarized crossed dipole comprising:

a first dipole antenna element and a second dipole antenna element;

the first dipole antenna element comprising a first dipole half and a second dipole half and the second dipole antenna element comprising a first dipole half and a second dipole half;

the first dipole half of the first dipole antenna element comprising an earth connector and a dipole earth wing, wherein a first end of the dipole earth wing is connected to a first end of the earth connector, and wherein a second end of the earth connector, which is opposite the first end, is arrangeable on at least one main body, wherein the first dipole half of the first dipole antenna element is of single-part design;

the second dipole half of the first dipole antenna element comprising a signal connector with a first end and an opposite, second end and a dipole signal wing, wherein a first end of the dipole signal wing is connected to the first end of the signal connector, wherein the second dipole half of the first dipole antenna element is of single-part design;

the first dipole half of the second dipole antenna element comprising an earth connector and a dipole earth wing, wherein a first end of the dipole earth wing is connected to a first end of the earth connector, and wherein a second end of the earth connector, which is opposite the first end, is arrangeable on the at least one main body, wherein the first dipole half of the second dipole antenna element is of single-part design;

the second dipole half of the second dipole antenna element comprising a signal connector with a first end and an opposite, second end and a dipole signal wing, wherein a first end of the dipole signal wing is connected to the first end of the signal connector, wherein the second dipole half of the second dipole antenna element is of single-part design;

the signal connector of the first dipole antenna element running parallel, or with a component predominantly parallel to the earth connector of the first dipole antenna element, and the signal connector of the second dipole antenna element running parallel, or with a component predominantly parallel to the earth connector of the second dipole antenna element;

the dipole signal wing and the dipole earth wing of the first dipole antenna element running in opposite directions;

the dipole signal wing and the dipole earth wing of the second dipole antenna element running in opposite directions; and the dipole signal wing of the second dipole antenna element passing through beneath the dipole signal wing of the first dipole antenna element, or the dipole earth wing of the second dipole antenna element passing through beneath the dipole earth wing of the first dipole antenna element, or the dipole earth wing of the first dipole antenna element passing through beneath the dipole signal wing of the second dipole antenna element, or the dipole signal wing of the second dipole antenna element passes through beneath the dipole earth wing of the first dipole antenna element.

2. The dual-polarized crossed dipole according to claim 1, wherein:

at least one of the first dipole half and the second dipole half of the first dipole antenna element is formed from:

a) one or more of a stamped sheet metal part, a cut sheet metal part, a bent sheet metal part, and an angled sheet metal part; or b) a flexible printed circuit board, or a flexible printed circuit board and one or more of the stamped sheet metal part, the cut sheet metal part, the bent sheet metal part, and the angled sheet metal part at least one of the first dipole half and the second dipole half of the second dipole antenna element is formed from at least one of:

a) one or more of a stamped sheet metal part, a cut sheet metal part; a bent sheet metal part; an angled sheet metal part; or b) a flexible printed circuit board or a flexible printed circuit board and one or more of the stamped sheet metal part, the cut sheet metal part, the bent sheet metal part, and the angled sheet metal part.

3. The dual-polarized crossed dipole according to claim 1, wherein at least one of:

the dipole signal wing of the first dipole antenna element and the dipole signal wing of the second dipole antenna element and the dipole earth wing of the first dipole antenna element and the dipole earth wing of the second dipole antenna element lie at least with a majority of longitudinal extent in a common plane or in at least two different planes arranged parallel to one another; and the dipole signal wing of the first dipole antenna element and the dipole signal wing of the second dipole antenna element and the dipole earth wing of the first dipole antenna element and the dipole earth wing of the second dipole antenna element are rectangular in cross-section, wherein longer sides of the cross-section run parallel, or with a component predominantly parallel to the at least one main body, and wherein shorter sides of the cross-section run perpendicularly or, with a component predominantly perpendicularly to the at least main body.

4. The dual-polarized crossed dipole according to claim 1, wherein:

at least one of:

the dipole signal wing and the dipole earth wing of the first dipole antenna element have a widening over a partial length; and the dipole signal wing and the dipole earth wing of the second dipole antenna element have a widening over a partial length; and at least one of:

the dipole signal wing and the dipole earth wing of the first dipole antenna element each have, at their open second ends, which are arranged opposite the first ends, which are connected to the signal connector and earth connector of the first dipole antenna element, a portion running curved over a partial length, wherein these portions are curved away from the second end of the earth connector; and the dipole signal wing and the dipole earth wing of the second dipole antenna element each have, at their open second ends, which are arranged opposite the first ends, which are connected to the signal connector and earth connector of the second dipole antenna element, a portion running curved over a partial length, wherein these portions are curved away from the second end of the earth connector.

5. The dual-polarized crossed dipole according to claim 1, wherein:

at least one of:

the dipole signal wing and the dipole earth wing of the first dipole antenna element are divided over a majority of their longitudinal extent or over their entire length by a separating slot into, in each case, two wing segments running at a distance from one another, wherein the wing segments running at a distance from one another are of the same length or are of different lengths; and the dipole signal wing and the dipole earth wing of the second dipole antenna element are divided over the majority of their longitudinal extent or over their entire length by a separating slot into, in each case, two wing segments running at a distance from one another, wherein the wing segments running at a distance from one another are of the same length or are of different lengths.

6. A dual-polarized crossed dipole comprising:

a first dipole antenna element and a second dipole antenna element;

the first dipole antenna element comprising a first dipole half and a second dipole half and the second dipole antenna element comprising a first dipole half and a second dipole half;

the first dipole half of the first dipole antenna element comprising an earth connector and a dipole earth wing, wherein a first end of the dipole earth wing is connected to a first end of the earth connector, and wherein a second end of the earth connector, which is opposite the first end, is arrangeable on at least one main body;

the second dipole half of the first dipole antenna element comprising a signal connector with a first end and an opposite, second end and a dipole signal wing, wherein a first end of the dipole signal wing is connected to the first end of the signal connector;

the first dipole half of the second dipole antenna element comprising an earth connector and a dipole earth wing, wherein a first end of the dipole earth wing is connected to a first end of the earth connector, and wherein a second end of the earth connector, which is opposite the first end, is arrangeable on the at least one main body;

the second dipole half of the second dipole antenna element comprising a signal connector with a first end and an opposite, second end and a dipole signal wing, wherein a first end of the dipole signal wing is connected to the first end of the signal connector;

the signal connector of the first dipole antenna element running parallel, or with a component predominantly parallel to the earth connector of the first dipole antenna element, and the signal connector of the second dipole antenna element running parallel, or with a component predominantly parallel to the earth connector of the second dipole antenna element;

the dipole signal wing and the dipole earth wing of the first dipole antenna element running in opposite directions;

the dipole signal wing and the dipole earth wing of the second dipole antenna element running in opposite directions; and the dipole signal wing of the second dipole antenna element passing through beneath the dipole signal wing of the first dipole antenna element, or the dipole earth wing of the second dipole antenna element passing through beneath the dipole earth wing of the first dipole antenna element, or the dipole earth wing of the first dipole antenna element passing through beneath the dipole signal wing of the second dipole antenna element, or the dipole signal wing of the second dipole antenna element passes through beneath the dipole earth wing of the first dipole antenna element, wherein at least one of:

the dipole signal wing of the first dipole antenna element is divided into at least two segments, which run parallel, or with a component predominantly parallel to one another, wherein these segments are arranged in different planes and are connected to one another via at least one intermediate segment, whereby a stepped profile results; and the dipole earth wing of the first dipole antenna element is divided into at least two segments, which run parallel, or with a component predominantly parallel to one another, wherein these segments are arranged in different planes and are connected to one another via at least one intermediate segment, whereby a stepped profile results; and the dipole signal wing of the second dipole antenna element is divided into at least two segments, which run parallel, or with a component predominantly parallel to one another, wherein these segments are arranged in different planes and are connected to one another via at least one intermediate segment, whereby a stepped profile results; and the dipole earth wing of the second dipole antenna element is divided into at least two segments, which run parallel, or with a component predominantly parallel to one another, wherein these segments are arranged in different planes and are connected to one another via at least one intermediate segment, whereby a stepped profile results;

wherein at least one of:

a first segment of the dipole signal wing of the first dipole antenna element, which first segment connects to the first end of the signal connector of the first dipole antenna element, is arranged closer to or further away from the second end of the signal connector than the first end of the signal connector, whereby the dipole signal wing of the first dipole antenna element has a U-shaped profile over a partial length; and a first segment of the dipole earth wing of the first dipole antenna element, which first segment connects to the first end of the earth connector of the first dipole antenna element, is arranged closer to or further away from the second end of the earth connector than the first end of the earth connector, whereby the dipole earth wing of the first dipole antenna element has a U-shaped profile over a partial length; and a first segment of the dipole signal wing of the second dipole antenna element, which first segment connects to the first end of the signal connector of the second dipole antenna element, is arranged closer to or further away from the second end of the signal connector than the first end of the signal connector, whereby the dipole signal wing of the second dipole antenna element has a U-shaped profile over a partial length; and a first segment of the dipole earth wing of the second dipole antenna element, which first segment connects to the first end of the earth connector of the second dipole antenna element, is arranged closer to or further away from the second end of the earth connector than the first end of the earth connector, whereby the dipole earth wing of the second dipole antenna element has a U-shaped profile over a partial length.

7. The dual-polarized crossed dipole according to claim 1, wherein at least one of:

the dipole signal wing of the first dipole antenna element has a length or a distance from the second end of the earth connector of the first dipole antenna element which is greater than 0.10λ, 0.15λ, 0.20λ, 0.25λ, 0.30λ, 0.35λ, or 0.40λ, and which is less than 0.45λ, 0.40λ, 0.35λ, 0.30λ, 0.25λ, 0.20λ, or 0.15λ, or corresponds to 0.15λ or 0.25λ, wherein λ is the center frequency of a first high-frequency signal transmittable via the first dipole antenna element; and the dipole earth wing of the first dipole antenna element has a length or a distance from the second end of the earth connector of the first dipole antenna element which is greater than 0.10λ, 0.15λ, 0.20λ, 0.25λ, 0.30λ, 0.35λ, or 0.40λ, and which is less than 0.45λ, 0.40λ, 0.35λ, 0.30λ, 0.25λ, 0.20λ, or 0.15λ, or corresponds to 0.15λ or 0.25λ, wherein λ is the center frequency of a first high-frequency signal transmittable via the first dipole antenna element; and the dipole signal wing of the second dipole antenna element has a length or a distance from the second end of the earth connector of the second dipole antenna element which is greater than 0.10λ, 0.15λ, 0.20λ, 0.25λ, 0.30λ, 0.35λ, or 0.40λ, and which is less than 0.45λ, 0.40λ, 0.35λ, 0.30λ, 0.25λ, 0.20λ, or 0.15λ, or corresponds to 0.15λ or 0.25λ, wherein λ is the center frequency of a second high-frequency signal transmittable via the second dipole antenna element; and the dipole earth wing of the second dipole antenna element has a length or a distance from the second end of the earth connector of the second dipole antenna element which is greater than 0.10λ, 0.15λ, 0.20λ, 0.25λ, 0.30λ, 0.35λ, or 0.40λ, and which is less than 0.45λ, 0.40λ, 0.35λ, 0.30λ, 0.25λ, 0.20λ, or 0.15λ, or corresponds to 0.15λ, or 0.25λ, wherein λ is the center frequency of a second high-frequency signal transmittable via the second dipole antenna element.

8. A dual-polarized crossed dipole comprising a first dipole antenna element and a second dipole antenna element;

the first dipole antenna element comprising a first dipole half and a second dipole half and the second dipole antenna element comprising a first dipole half and a second dipole half;

the first dipole half of the first dipole antenna element comprising an earth connector and a dipole earth wing, wherein a first end of the dipole earth wing is connected to a first end of the earth connector, and wherein a second end of the earth connector, which is opposite the first end, is arrangeable on at least one main body;

the second dipole half of the first dipole antenna element comprising a signal connector with a first end and an opposite, second end and a dipole signal wing, wherein a first end of the dipole signal wing is connected to the first end of the signal connector;

the first dipole half of the second dipole antenna element comprising an earth connector and a dipole earth wing, wherein a first end of the dipole earth wing is connected to a first end of the earth connector, and wherein a second end of the earth connector, which is opposite the first end, is arrangeable on the at least one main body;

the second dipole half of the second dipole antenna element comprising a signal connector with a first end and an opposite, second end and a dipole signal wing, wherein a first end of the dipole signal wing is connected to the first end of the signal connector;

the signal connector of the first dipole antenna element running parallel, or with a component predominantly parallel to the earth connector of the first dipole antenna element, and the signal connector of the second dipole antenna element running parallel, or with a component predominantly parallel to the earth connector of the second dipole antenna element;

the dipole signal wing and the dipole earth wing of the first dipole antenna element running in opposite directions;

the dipole signal wing and the dipole earth wing of the second dipole antenna element running in opposite directions; and the dipole signal wing of the second dipole antenna element passing through beneath the dipole signal wing of the first dipole antenna element, or the dipole earth wing of the second dipole antenna element passing through beneath the dipole earth wing of the first dipole antenna element, or the dipole earth wing of the first dipole antenna element passing through beneath the dipole signal wing of the second dipole antenna element, or the dipole signal wing of the second dipole antenna element passes through beneath the dipole earth wing of the first dipole antenna element, wherein:

the earth connector of the first dipole antenna element and the earth connector of the second dipole antenna element are electrically conductively connected to one another at their second end and on the whole are of single-part design; and the signal connector of the first dipole antenna element and the signal connector of the second dipole antenna element are electrically conductively connected to one another at their first end and on the whole are of single-part design.

9. The dual-polarized crossed dipole according to claim 8, wherein:

the earth connector of the first dipole antenna element and the earth connector of the second dipole antenna element are electrically conductively connected to one another exclusively at their respective second ends, wherein the earth connector of the first dipole antenna element and the earth connector of the second dipole antenna element are galvanically isolated from one another between their second ends and the first ends by a slot.

10. A dual-polarized crossed dipole comprising:

a first dipole antenna element and a second dipole antenna element;

the first dipole antenna element comprising a first dipole half and a second dipole half and the second dipole antenna element comprising a first dipole half and a second dipole half;

the first dipole half of the first dipole antenna element comprising an earth connector and a dipole earth wing, wherein a first end of the dipole earth wing is connected to a first end of the earth connector, and wherein a second end of the earth connector, which is opposite the first end, is arrangeable on at least one main body;

the second dipole half of the first dipole antenna element comprising a signal connector with a first end and an opposite, second end and a dipole signal wing, wherein a first end of the dipole signal wing is connected to the first end of the signal connector;

the first dipole half of the second dipole antenna element comprising an earth connector and a dipole earth wing, wherein a first end of the dipole earth wing is connected to a first end of the earth connector, and wherein a second end of the earth connector, which is opposite the first end, is arrangeable on the at least one main body;

the second dipole half of the second dipole antenna element comprising a signal connector with a first end and an opposite, second end and a dipole signal wing, wherein a first end of the dipole signal wing is connected to the first end of the signal connector;

the signal connector of the first dipole antenna element running parallel, or with a component predominantly parallel to the earth connector of the first dipole antenna element, and the signal connector of the second dipole antenna element running parallel, or with a component predominantly parallel to the earth connector of the second dipole antenna element;

the dipole signal wing and the dipole earth wing of the first dipole antenna element running in opposite directions;

the dipole signal wing and the dipole earth wing of the second dipole antenna element running in opposite directions; and the dipole signal wing of the second dipole antenna element passing through beneath the dipole signal wing of the first dipole antenna element, or the dipole earth wing of the second dipole antenna element passing through beneath the dipole earth wing of the first dipole antenna element, or the dipole earth wing of the first dipole antenna element passing through beneath the dipole signal wing of the second dipole antenna element, or the dipole signal wing of the second dipole antenna element passes through beneath the dipole earth wing of the first dipole antenna element, wherein:

the dual-polarized crossed dipole comprises precisely one first metal part, wherein the first dipole half of the first dipole antenna element and the first dipole half of the second dipole antenna element are formed from the one first metal part; and the dual-polarized crossed dipole comprises precisely two second metal parts, which are structured identically to one another, wherein each of the second dipole half of the first dipole antenna element and the second dipole half of the second dipole antenna element are formed from a second metal part; or the first dipole half of the first dipole antenna element and the first dipole half of the second dipole antenna element and the second dipole half of the first dipole antenna element and the second dipole half of the second dipole antenna element are formed from precisely three metal parts, which are constructed differently from one another, wherein at least two metal parts are produced using the same tool.

11. A dual-polarized crossed dipole comprising:

a first dipole antenna element and a second dipole antenna element;

the first dipole antenna element comprising a first dipole half and a second dipole half and the second dipole antenna element comprising a first dipole half and a second dipole half;

the first dipole half of the first dipole antenna element comprising an earth connector and a dipole earth wing, wherein a first end of the dipole earth wing is connected to a first end of the earth connector, and wherein a second end of the earth connector, which is opposite the first end, is arrangeable on at least one main body;

the second dipole half of the first dipole antenna element comprising a signal connector with a first end and an opposite, second end and a dipole signal wing, wherein a first end of the dipole signal wing is connected to the first end of the signal connector;

the first dipole half of the second dipole antenna element comprising an earth connector and a dipole earth wing, wherein a first end of the dipole earth wing is connected to a first end of the earth connector, and wherein a second end of the earth connector, which is opposite the first end, is arrangeable on the at least one main body;

the second dipole half of the second dipole antenna element comprising a signal connector with a first end and an opposite, second end and a dipole signal wing, wherein a first end of the dipole signal wing is connected to the first end of the signal connector;

the signal connector of the first dipole antenna element running parallel, or with a component predominantly parallel to the earth connector of the first dipole antenna element, and the signal connector of the second dipole antenna element running parallel, or with a component predominantly parallel to the earth connector of the second dipole antenna element;

the dipole signal wing and the dipole earth wing of the first dipole antenna element running in opposite directions;

the dipole signal wing and the dipole earth wing of the second dipole antenna element running in opposite directions; and the dipole signal wing of the second dipole antenna element passing through beneath the dipole signal wing of the first dipole antenna element, or the dipole earth wing of the second dipole antenna element passing through beneath the dipole earth wing of the first dipole antenna element, or the dipole earth wing of the first dipole antenna element passing through beneath the dipole signal wing of the second dipole antenna element, or the dipole signal wing of the second dipole antenna element passes through beneath the dipole earth wing of the first dipole antenna element, wherein at least one of:

the earth connector of the first dipole antenna element is wider than the signal connector of the first dipole antenna element at least along a partial length or along an entire length; and the earth connector of the second dipole antenna element is wider than the signal connector of the second dipole antenna element at least along a partial length or along the entire length.

12. A dual-polarized crossed dipole comprising:

a first dipole antenna element and a second dipole antenna element;

the first dipole antenna element comprising a first dipole half and a second dipole half and the second dipole antenna element comprising a first dipole half and a second dipole half;

the first dipole half of the first dipole antenna element comprising an earth connector and a dipole earth wing, wherein a first end of the dipole earth wing is connected to a first end of the earth connector, and wherein a second end of the earth connector, which is opposite the first end, is arrangeable on at least one main body;

the second dipole half of the first dipole antenna element comprising a signal connector with a first end and an opposite, second end and a dipole signal wing, wherein a first end of the dipole signal wing is connected to the first end of the signal connector;

the first dipole half of the second dipole antenna element comprising an earth connector and a dipole earth wing, wherein a first end of the dipole earth wing is connected to a first end of the earth connector, and wherein a second end of the earth connector, which is opposite the first end, is arrangeable on the at least one main body;

the second dipole half of the second dipole antenna element comprising a signal connector with a first end and an opposite, second end and a dipole signal wing, wherein a first end of the dipole signal wing is connected to the first end of the signal connector;

the signal connector of the first dipole antenna element running parallel, or with a component predominantly parallel to the earth connector of the first dipole antenna element, and the signal connector of the second dipole antenna element running parallel, or with a component predominantly parallel to the earth connector of the second dipole antenna element;

the dipole signal wing and the dipole earth wing of the first dipole antenna element running in opposite directions;

the dipole signal wing and the dipole earth wing of the second dipole antenna element running in opposite directions; and the dipole signal wing of the second dipole antenna element passing through beneath the dipole signal wing of the first dipole antenna element, or the dipole earth wing of the second dipole antenna element passing through beneath the dipole earth wing of the first dipole antenna element, or the dipole earth wing of the first dipole antenna element passing through beneath the dipole signal wing of the second dipole antenna element, or the dipole signal wing of the second dipole antenna element passes through beneath the dipole earth wing of the first dipole antenna element, further including wherein:

the earth connector of the first dipole antenna element has an opening at its second end;

the signal connector of the first dipole antenna element is guided via its second end through the opening, such that both the second end of the signal connector of the first dipole antenna element and the second end of the earth connector of the first dipole antenna element end in the same plane and are arrangeable on the same side of the at least one main body; and the earth connector of the second dipole antenna element has an opening at its second end;

the signal connector of the second dipole antenna element is guided via its second end through the opening, such that both the second end of the signal connector of the second dipole antenna element and the second end of the earth connector of the second dipole antenna element end in the same plane and are arrangeable on the same side of the at least one main body, whereby the dual-polarized crossed dipole is formed as a surface mount device, SMD, component part.

13. The dual-polarized crossed dipole according to claim 1, wherein:

the second end of the signal connector of the first dipole antenna element protrudes beyond the second end of the earth connector of the first dipole antenna element, such that the at least one main body is penetrable by the second end of the signal connector of the first dipole antenna element; and the second end of the signal connector of the second dipole antenna element protrudes beyond the second end of the earth connector of the second dipole antenna element, such that the at least one main body is penetrable by the second end of the signal connector of the second dipole antenna element.

14. The dual-polarized crossed dipole according to claim 1, further including:

a first holding device comprising or consisting of a dielectric material;

the first holding device being arranged between the earth connector of the first dipole antenna element and the signal connector of the first dipole antenna element;

the first holding device comprising a plurality of holding structures, which are all in engagement with the earth connector of the first dipole antenna element and also in engagement with the signal connector of the first dipole antenna element and prevent a displacement of the earth connector and of the signal connector relative to one another; and a second holding device comprising or consisting of a dielectric material;

the second holding device being arranged between the earth connector of the second dipole antenna element and the signal connector of the second dipole antenna element;

the second holding device comprising a plurality of holding structures, which are all in engagement with the earth connector of the second dipole antenna element and also in engagement with the signal connector of the second dipole antenna element and prevent a displacement of the earth connector and of the signal connector relative to one another;

the first holding device comprising a central body which has a front side and rear side, wherein on each of the front side and rear side of the first holding device, at least one of:

a) there is arranged a holding structure in the form of first and second locking pins, which locking pins protrude away from the central body, wherein the first locking pin dips into an opening in the earth connector and the second locking pin dips into an opening in the signal connector of the first dipole antenna element, whereby a displacement along a longitudinal axis of the dual-polarized crossed dipole is prevented; and/or b) there are arranged a plurality of locking fingers which protrude away from the central body in the direction of the earth connector and the signal connector and engage both the earth connector of the first dipole antenna element and the signal connector of the first dipole antenna element from behind, whereby a distance between the earth connector and the signal connector is prevented from increasing; and wherein the second holding device comprises a central body which has a front side and rear side, wherein on each of the front side and rear side of the second holding device, at least one of:

a) there is arranged first and second locking pins which locking pins protrude away from the central body, the first locking pin dipping into an opening in the earth connector and the second locking pin dipping into an opening in the signal connector of the second dipole antenna element, whereby a displacement along a longitudinal axis of the dual-polarized crossed dipole is prevented; and b) there are arranged a plurality of locking fingers, which protrude away from the central body in the direction of the earth connector and the signal connector of the second dipole antenna element and engage both the earth connector of the second dipole antenna element and the signal connector of the second dipole antenna element from behind, whereby a distance between the earth connector and the signal connector is prevented from increasing.

15. A dual-polarized crossed dipole comprising:

a first dipole antenna element and a second dipole antenna element;

the first dipole antenna element comprising a first dipole half and a second dipole half and the second dipole antenna element comprising a first dipole half and a second dipole half;

the first dipole half of the first dipole antenna element comprising an earth connector and a dipole earth wing, wherein a first end of the dipole earth wing is connected to a first end of the earth connector, and wherein a second end of the earth connector, which is opposite the first end, is arrangeable on at least one main body;

the second dipole half of the first dipole antenna element comprising a signal connector with a first end and an opposite, second end and a dipole signal wing, wherein a first end of the dipole signal wing is connected to the first end of the signal connector;

the first dipole half of the second dipole antenna element comprising an earth connector and a dipole earth wing, wherein a first end of the dipole earth wing is connected to a first end of the earth connector, and wherein a second end of the earth connector, which is opposite the first end, is arrangeable on the at least one main body;

the second dipole half of the second dipole antenna element comprising a signal connector with a first end and an opposite, second end and a dipole signal wing, wherein a first end of the dipole signal wing is connected to the first end of the signal connector;

the signal connector of the first dipole antenna element running parallel, or with a component predominantly parallel to the earth connector of the first dipole antenna element, and the signal connector of the second dipole antenna element running parallel, or with a component predominantly parallel to the earth connector of the second dipole antenna element;

the dipole signal wing and the dipole earth wing of the first dipole antenna element running in opposite directions;

the dipole signal wing and the dipole earth wing of the second dipole antenna element running in opposite directions; and the dipole signal wing of the second dipole antenna element passing through beneath the dipole signal wing of the first dipole antenna element, or the dipole earth wing of the second dipole antenna element passing through beneath the dipole earth wing of the first dipole antenna element, or the dipole earth wing of the first dipole antenna element passing through beneath the dipole signal wing of the second dipole antenna element, or the dipole signal wing of the second dipole antenna element passes through beneath the dipole earth wing of the first dipole antenna element, further including:

at least one holding device which comprises or consists of a dielectric material; the at least one holding device being formed as:

a) a sliding holder, which comprises a central body, which is penetrated by a plurality of receiving slots, wherein the earth connectors and the signal connectors are slidable or slid into these receiving slots, and wherein the sliding holder is displaceable at least along a partial length of the earth connectors or the signal connectors; or b) an overmoulded part, which is formed by an overmoulding of the earth connectors and the signal connectors with a plastics material.

16. The dual-polarized crossed dipole according to claim 1, wherein:

an electrical phase center and a mechanical center run through different regions of the dual-polarized crossed dipole; and the signal connectors of the first dipole antenna element and the second dipole antenna element are fed exclusively at their second ends; and the dual-polarized crossed dipole is free from solder points and cables, with an exception of the second ends of the earth connector of the first dipole antenna element and the earth connector of the second dipole antenna element and/or the signal connector of the first dipole antenna element and the signal connector of the second dipole antenna element.

17. The dual-polarized crossed dipole according to claim 1, wherein:

the earth connector of the first dipole antenna element and the signal connector of the first dipole antenna element are formed as conductor tracks on different, opposite sides of a first printed circuit board;

the earth connector of the second dipole antenna element and the signal connector of the second dipole antenna element are formed as conductor tracks on different, opposite sides of a second printed circuit board;

the dipole earth wing and the dipole signal wing of the first dipole antenna element are formed as conductor tracks on a first side of a third printed circuit board and are soldered or electromagnetically coupled to the earth connector of the first dipole antenna element and to the signal connector of the first dipole antenna element; the dipole earth wing and the dipole signal wing of the second dipole antenna element are formed as conductor tracks on the first side and the second side of the third printed circuit board and are soldered or electromagnetically coupled to the earth connector of the second dipole antenna element and to the signal connector of the second dipole antenna element.

18. An antenna arrangement having at least one first and one second dual-polarized crossed dipole, which are structured in accordance with claim 1, further comprising:

at least one main body;

the at least one first and one second dual-polarized crossed dipoles being arranged on the at least one main body;

the second end of the signal connector of the first dipole antenna element of the first dual-polarized crossed dipole being connected galvanically via a first connection to the second end of the signal connector of the first dipole antenna element of the second dual-polarized crossed dipole;

the second end of the signal connector of the second dipole antenna element of the first dual-polarized crossed dipole being connected galvanically via a second connection to the second end of the signal connector of the second dipole antenna element of the second dual-polarized crossed dipole; wherein:

the signal connector of the first dipole antenna element of the first dual-polarized crossed dipole and the signal connector of the first dipole antenna element of the second dual-polarized crossed dipole, together with their first connection, are formed in a single part from a common bent or stamped or laser or angled part; and the signal connector of the second dipole antenna element of the first dual-polarized crossed dipole and the signal connector of the second dipole antenna element of the second dual-polarized crossed dipole, together with their second connection, are formed in a single part from a common bent or stamped or laser or angled part; and the earth connector of the first dipole antenna element and the earth connector of the second dipole antenna element of the first dual-polarized crossed dipole and the earth connector of the first dipole antenna element and the earth connector of the second dipole antenna element of the second dual-polarized crossed dipole are connected to one another galvanically via a third connection and, together with this third connection, are formed in a single part from a common bent or stamped or laser or angled part.

* * * * *